US007960083B2

(12) United States Patent
Nakayama et al.

(10) Patent No.: US 7,960,083 B2
(45) **Date of Patent: *Jun. 14, 2011**

(54) IMAGE FORMING APPARATUS, IMAGE FORMING METHOD, AND PROCESS CARTRIDGE

(75) Inventors: Shinya Nakayama, Numazu (JP); Akihiro Kotsugai, Numazu (JP); Akiyoshi Sabu, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/142,311

(22) Filed: Jun. 19, 2008

(65) Prior Publication Data

US 2008/0318143 A1 Dec. 25, 2008

(30) Foreign Application Priority Data

Jun. 20, 2007 (JP) ..... 2007-163201

(51) Int. Cl.
*G03G 13/22* (2006.01)

(52) U.S. Cl. ..... 430/124.1

(58) Field of Classification Search ..... 430/124.1
See application file for complete search history.

(56) References Cited

U.S. PATENT DOCUMENTS

| | | | | |
|---|---|---|---|---|
| 7,713,672 | B2 * | 5/2010 | Watanabe et al. | 430/123.5 |
| 7,718,340 | B2 * | 5/2010 | Iwamoto et al. | 430/123.5 |
| 2003/0203301 | A1 | 10/2003 | Iga | |
| 2007/0248380 | A1 | 10/2007 | Iwamoto et al. | |
| 2007/0281236 | A1 | 12/2007 | Watanabe et al. | |
| 2007/0281237 | A1 | 12/2007 | Iwamoto et al. | |
| 2008/0118855 | A1 | 5/2008 | Nakayama et al. | |
| 2008/0261131 | A1 * | 10/2008 | Nakayama et al. | 430/48 |
| 2008/0280219 | A1 * | 11/2008 | Nakayama et al. | 430/48 |
| 2009/0175658 | A1 * | 7/2009 | Iwamoto et al. | 399/252 |

FOREIGN PATENT DOCUMENTS

| | | | |
|---|---|---|---|
| CN | 1388415 | A | 1/2003 |
| EP | 1 701 220 | A2 | 9/2006 |
| EP | 1 862 864 | A1 | 12/2007 |
| EP | 1 925 983 | A2 | 5/2008 |
| JP | 4-70765 | | 3/1992 |

(Continued)

OTHER PUBLICATIONS

U.S. Appl. No. 12/297,952, filed Oct. 21, 2008, Iwamoto, et al.

(Continued)

*Primary Examiner* — Hoa V Le

(74) *Attorney, Agent, or Firm* — Oblon, Spivak, McClelland, Maier & Neustadt, L.L.P.

(57) ABSTRACT

An image forming apparatus including a charging unit, an exposing unit, a developing unit, a transferring unit, and a fixing unit. A toner containing a colorant and a binder resin which contains a polyester resin (A) and a polyester resin (B) having a softening point 10° C. or more higher than that of the polyester resin (A); the polyester resin (A) is a (meth)acrylic acid-modified rosin derived resin having a polyester unit obtained by polycondensation of an alcohol component, which contains 65 mol % or more of 1,2-propanediol in a dihydric alcohol component, and a carboxylic acid component containing a (meth)acrylic acid-modified rosin; the polyester resin (B) is a purified rosin derived resin having a polyester unit obtained by polycondenstation of an alcohol component, which contains a total of 70 mol % or more of 1,2-propanediol and 1,3-propanediol in a dihydric alcohol component, and a carboxylic acid component containing purified rosin.

1 Claim, 18 Drawing Sheets

FOREIGN PATENT DOCUMENTS

| | | |
|---|---|---|
| JP | 4-307557 | 10/1992 |
| JP | 2007-137911 | 6/2007 |
| JP | 2007-139813 | 6/2007 |
| JP | 2008-129411 | 6/2008 |
| JP | 2008-129416 | 6/2008 |

OTHER PUBLICATIONS

U.S. Appl. No. 12/253,558, filed Oct. 17, 2008, Nakayama et al.
Office Action issued Jul. 20, 2010, in Patent Application No. 2008102103948.

* cited by examiner

IMAGE FORMING APPARATUS, IMAGE FORMING METHOD, AND PROCESS CARTRIDGE

BACKGROUND OF THE INVENTION

1. Field of the Invention

The present invention relates to an image forming apparatus, an image forming method, and a process cartridge for electrophotography in a copier, electrostatic printing, a printer, a facsimile, electrostatic recording, and the like.

2. Description of the Related Art

Various methods are conventionally known to form electrophotographic images. The surface of a latent electrostatic image bearing member (hereinafter, may be referred to as a "photoconductor," an "electrophotographic photoconductor," or an "image bearing member") is usually charged and exposed to form a latent electrostatic image thereon. Subsequently, the latent electrostatic image is developed with a toner to form a visible image on the latent electrostatic image bearing member. This visible image is transferred onto a recording medium directly or through an intermediate transfer member, and the transferred image is fixed by application of heat and/or pressure. Thus, the image is formed on the recording medium, and a record is obtained. After the visible image is transferred, residual toner on the latent electrostatic image bearing member is removed by a known method using a blade, a brush, a roller, or the like.

In general, there are two types of full-color image forming apparatuses utilizing this electrophotography. One is called a single (or single drum) image forming apparatus. This image forming apparatus is equipped with one latent electrostatic image bearing member and four developing units for four colors—cyan, magenta, yellow, and black. Visible images of the four colors are formed on the latent electrostatic image bearing member or a recording medium. Moreover, it is possible to use the same charging unit, exposing unit, transfer unit, and cleaning unit, which are disposed around the latent electrostatic image bearing member, for each image formation. Thus, the single image forming apparatus can be designed smaller at lower costs than a tandem image forming apparatus described later.

The other apparatus is called a tandem (or tandem drum) image forming apparatus. This image forming apparatus is equipped with a plurality of latent electrostatic image bearing members (refer to Japanese Patent Application Laid-Open (JP-A) No. 05-341617). A charging unit, a developing unit, a transferring unit, and a cleaning unit are generally disposed for one latent electrostatic image bearing member to form one image forming element as a whole. The image forming apparatus is equipped with the plurality of image forming elements (generally four). One image forming element forms a visible image of one color, and visible images are sequentially transferred onto a recording medium to form a full-color image. Thus, it is possible to form an image at high speed since a visible image of each color can be formed in parallel processing. More specifically, the tandem image forming apparatus takes time four times shorter than the single image forming apparatus takes to form an image so as to print four times faster than the single image forming apparatus. Moreover, each unit (e.g., a latent electrostatic image bearing member) of the image forming element can be substantially more durable. It is because each latent electrostatic image bearing member in the tandem image forming apparatus performs a sequence of charging, exposing, developing, and transferring steps only once to form one full-color image, whereas a latent electrostatic image bearing member in the single image forming apparatus performs the sequence four times.

However, the size and costs of the tandem image forming apparatus are disadvantageously increased since the plurality of image forming elements are disposed therein.

To overcome the problems, the latent electrostatic image bearing member and each unit disposed therearound are made smaller to decrease the size of one image forming element. As a result, not only the size of the image forming apparatus, but also the material costs are reduced so that the entire costs of the image forming apparatus are lowered to some extent. However, as the image forming apparatus is made more compact and smaller, it is necessary to enhance the performance and greatly increase the stability of each unit in the image forming element.

In addition, energy-saving and high-speed image forming apparatuses such as printers, copiers, and facsimiles have been recently demanded in the market. To achieve these performances, it is important to improve thermal efficiency of a fixing unit in the image forming apparatus.

An unfixed toner image is commonly formed on a recording medium (e.g., a recording sheet, printing paper, photographic paper, or electrostatic recording paper) in an image forming apparatus by image forming process (e.g., electrophotographic recording, electrostatic recording, or magnetic recording) through indirect transfer or direct transfer. A contact heating fixing unit (e.g., a heat roller fixing unit, a film heating fixing unit, or an electromagnetic induction heating fixing unit) is widely employed to fix this unfixed toner image.

The heat roller fixing unit basically has a heat source such as a halogen lamp inside and a pair of rollers. One of the rollers is a fixing roller adjusted to be at a predetermined temperature. The other roller is a pressure roller pressured to contact the fixing roller. A recording medium is inserted into a contact portion (i.e., a nip) of the pair of rollers and transported. An unfixed toner image is fused and fixed by heat and pressure from the fixing roller and the pressure roller.

A film heating fixing unit has been proposed in Japanese Patent Application Laid-Open (JP-A) Nos. 63-313182 and 01-263679, for example. This film heating fixing unit contacts a recording medium to a heat body, which is fixed and supported by a support member, through a thin, heat-resistant fixing film. The fixing film is slit and moved along the heat body so that the heat body heats a recording medium through the fixing film.

For example, a ceramic heater is used for the heat body. This ceramic heater has a resistive layer on a ceramic substrate made of alumina, aluminum nitride, or the like. Alumina and aluminum nitride have properties such as thermal resistance, insulating properties, and good thermal conductivity. A thin fixing film with low heat capacity can be used in this fixing unit to enhance heat transfer efficiency, to shorten time for warming-up, and to enable quick-start and energy-saving, compared with the heat roller fixing unit.

A technique has been proposed for the electromagnetic induction heating fixing unit as an example (refer to JP-A 08-22206). In this technique, an alternating current magnetic field causes an eddy current in a magnetic metal material to generate Joule heat, and a heat body containing a metal material is heated by electromagnetic induction.

A film having an elastic rubber layer on its surface is disposed between the heat body and a recording medium in this electromagnetic induction heating fixing unit to cover a visible image adequately so that the image is uniformly heated and fused. When the elastic rubber layer is made of silicone rubber or the like, thermal responsiveness degrades due to its low thermal conductivity. As a result, a difference between temperatures of inner and outer surfaces of the film becomes very large. Herein, the inner surface is heated by the heat body, and the outer surface contacts the toner. When a large amount of toner is adhered, the surface temperature of a belt decreases rapidly, and the toner cannot be fixed sufficiently. This may cause cold offset.

Moreover, releasability (hereinafter, may be referred to as "anti-offset property") of toner from the heat member is demanded during the fixing step. The anti-offset property can be improved by the presence of a releasing agent on the surface of the toner. However, when a toner (except a predetermined toner) is recycled, the amount of releasing agent is decreased on the surface of the toner. In addition, when particles designed to have a core-shell structure with two or more layers are localized in the surface of the toner, the minimum fixing temperature is increased, and low-temperature fixing property, in other words, energy-saving fixing property cannot be sufficient. Furthermore, when the toner needs to be fixed at lower temperature in a low-temperature fixing system, the toner cannot be fixed well because of fine inorganic particles localized in the surface of the toner. Therefore, a wide range of the fixing temperature could not have been obtained.

In line with the development of electrophotography, a toner needs to have excellent low-temperature fixing property, anti-offset property, and storage stability (anti-blocking property). Accordingly, various types of toner have been reported, and examples of the toner include: a toner which contains a linear polyester resin with defined physical properties such as molecular weight (refer to JP-A 2004-245854); a toner containing a non-linear cross-linked polyester resin using rosins as an acidic component of the polyester (refer to JP-A 04-70765); a toner having fixing property improved by using a rosin modified by maleic acid; and a toner using a resin made by blending a low molecular weight resin and a high molecular weight resin (refer to JP-A 02-82267).

However, as recent machines become faster and energy-saving, a conventional toner binder resin is insufficient to meet the demand in the market. More specifically, it is very difficult to maintain sufficient fixing property when fixing time is shortened during the fixing step and a heating temperature of a fixing machine is lowered. Particularly, a glass transition temperature is inevitably decreased when a low-molecular weight resin is employed. Consequently, the toner is aggregated when stored.

Moreover, when a strong stress is applied during printing, image degradation is significant under high-speed repetitive printing because of insufficient toner durability and filming due to insufficient dispersion of an internal additive.

Furthermore, when the low molecular weight resin and high molecular weight resin are blended, the pulverizability is disadvantageously inferior in a resin production process due to presence of the high molecular weight component and in a pulverized toner production process using the binder resin.

Further, rosin monomers used in JP-A 04-70765 and 04-307557 effectively improve the low-temperature fixing property while the monomers are likely to cause odor.

Therefore, it is desirable to promptly provide an image forming apparatus, an image forming method, and a process cartridge, which employ a toner having excellent low-temperature fixing property, anti-offset property, durability, pulverizability, and storage stability and causing less odor, have stability over time, and are enabled to form a high quality image for a long period of time.

BRIEF SUMMARY OF THE INVENTION

An object of the present invention is to provide an image forming apparatus, an image forming method, and a process cartridge, which employ a toner having excellent low-temperature fixing property, anti-offset property, durability, pulverizability, and storage stability and causing less odor, and are enabled to form an extremely high quality image without varying a color tone over long-term printing or abnormality such as decrease in density, fog, or fading.

Means for overcoming the problems are as follows:

<1> An image forming apparatus, including:

a latent electrostatic image bearing member;

a charging unit configured to charge a surface of the latent electrostatic image bearing member;

an exposing unit configured to expose the surface, which is charged, of the latent electrostatic image bearing member to form a latent electrostatic image;

a developing unit configured to develop the latent electrostatic image with a toner to form a visible image;

a transferring unit configured to transfer the visible image onto a recording medium; and a fixing unit configured to fix the image on the recording medium, wherein the toner contains at least a binder resin and a colorant, and the binder resin contains a polyester resin (A) and a polyester resin (B) which has a softening point 10° C. or more higher than that of the polyester resin (A), the polyester resin (A) is a (meth)acrylic acid-modified rosin derived resin having a polyester unit obtained by polycondensation of an alcohol component and a carboxylic acid component, the alcohol component containing 65 mol % or more of 1,2-propanediol in a dihydric alcohol component, and the carboxylic acid component containing a (meth) acrylic acid-modified rosin, and the polyester resin (B) is a purified rosin derived resin having a polyester unit obtained by polycondensation of an alcohol component and a carboxylic acid component, the alcohol component containing a total of 70 mol % or more of 1,2-propanediol and 1,3-propanediol in a dihydric alcohol component, and the carboxylic acid component containing a purified rosin.

<2> The image forming apparatus according to <1>, wherein the charging unit configured to charge the latent electrostatic image bearing member without contact.

<3> The image forming apparatus according to <1>, wherein the charging unit configured to charge the latent electrostatic image bearing member with contact.

<4> The image forming apparatus according to any one of <1> to <3>, wherein the developing unit has a magnetic field generating unit fixed inside the developing unit; and a rotatable developer bearing member bearing a two-component developer on a surface thereof, the two-component developer comprising a magnetic carrier and a toner.

<5> The image forming apparatus according to any one of <1> to <3>, wherein the developing unit has a developer bearing member to which a toner is supplied; and a layer thickness regulating member for forming a thin layer of the toner on a surface of the developer bearing member.

<6> The image forming apparatus according to any one of <1> to <5>, wherein the transferring unit is configured to transfer the visible image, which is on the latent electrostatic image bearing member, onto the recording medium.

<7> The image forming apparatus according to any one of <1> to <6>, including a plurality of image forming elements, each including the latent electrostatic image bearing member, the charging unit, the developing unit, and the transferring unit, wherein the transferring units sequentially transfer visible images, which are formed on the latent electrostatic image bearing members, onto a recording medium, a surface of which moves to pass through transfer positions facing each of the latent electrostatic image bearing members of the plurality of image forming elements.

<8> The image forming apparatus according to any one of <1> to <5>, wherein the transferring unit includes:

an intermediate transfer member to which the visible image formed on the latent electrostatic image bearing member is primarily transferred; and a secondary transferring unit configured to secondarily transfer the visible image, which is on the intermediate transfer member, onto the recording medium.

<9> The image forming apparatus according to any one of <1> to <8>, further including a cleaning unit, wherein the cleaning unit has a cleaning blade contacting the surface of the latent electrostatic image bearing member.

<10> The image forming apparatus according to any one of <1> to <8>, wherein the developing unit has a developer bearing member contacting the surface of the latent electrostatic image bearing member, and is configured to develop the latent electrostatic image formed on the latent electrostatic image bearing member and collect residual toner on the latent electrostatic image bearing member.

<11> The image forming apparatus according to any one of <1> to <10>, wherein the fixing unit has at least any one of a roller and a belt and is configured to heat from a surface which does not contact the toner and fix the image on the recording medium by application of heat and pressure.

<12> The image forming apparatus according to any one of <1> to <10>, wherein the fixing unit comprises at least any one of a roller and a belt and is configured to heat from a surface which contacts the toner and fix the image on the recording medium by application of heat and pressure.

<13> The image forming apparatus according to any one of <1> to <12>, wherein a modification degree of the (meth) acrylic acid-modified rosin in the polyester resin (A) is 5 to 105.

<14> The image forming apparatus according to any one of <1> to <13>, wherein a molar ratio of the 1,2-propanediol to the 1,3-propanediol (1,2-propanediol/1,3-propanediol) in the alcohol component of the polyester resin (B) ranges from 70/30 to 99/1.

<15> The image forming apparatus according to any one of <1> to <14>, wherein at least any one of the polyester resin (A) and the polyester resin (B) contains at least any one of trivalent or more polyhydric alcohol as the alcohol component and a trivalent or more polyhydric carboxylic acid compound as the carboxylic acid component.

<16> The image forming apparatus according to any one of <1> to <15>, wherein at least any one of the polyester resin (A) and the polyester resin (B) is obtained by polycondensation of the alcohol component and the carboxylic acid component under presence of any one of a titanium compound and a tin (II) compound and an Sn—C bond-free tin (II) compound.

<17> The image forming apparatus according to any one of <1> to <16>, wherein the polyester resin (A) and the polyester resin (B) as well as a hybrid resin are used as the binder resin.

<18> An image forming method, including steps of charging a surface of a latent electrostatic image bearing member;

exposing the surface, which is charged, of the latent electrostatic image bearing member to form a latent electrostatic image;

developing the latent electrostatic image with a toner to form a visible image;

transferring the visible image onto a recording medium; and fixing the image on the recording medium, wherein the toner contains at least a binder resin and a colorant, and the binder resin contains a polyester resin (A) and a polyester resin (B) which has a softening point 10° C. or more higher than that of the polyester resin (A), the polyester resin (A) is a (meth)acrylic acid-modified rosin derived resin having a polyester unit obtained by polycondensation of an alcohol component and a carboxylic acid component, the alcohol component containing 65 mol % or more of 1,2-propanediol in a dihydric alcohol component, and the carboxylic acid component containing a (meth) acrylic acid-modified rosin, and the polyester resin (B) is a purified rosin derived resin having a polyester unit obtained by polycondensation of an alcohol component and a carboxylic acid component, the alcohol component containing a total of 70 mol % or more of 1,2-propanediol and 1,3-propanediol in a dihydric alcohol component, and the carboxylic acid component containing a purified rosin.

<19> In the image forming method according to <18>, the charging step is performed by the charging unit which charges the latent electrostatic image bearing member without contact.

<20> In the image forming method according to <18>, the charging step is performed by the charging unit which charges the latent electrostatic image bearing member with contact.

<21> In the image forming method according to any one of <18> to <20>, the developing step is performed by the developing unit which includes a magnetic field generating unit fixed inside the developing unit; and a rotatable developer bearing member bearing a two-component developer on a surface thereof, the two-component developer including a magnetic carrier and the toner.

<22> In the image forming method according to any one of <18> to <20>, the developing step is performed by the developing unit which includes a developer bearing member where the toner is supplied; and a layer thickness regulating member for forming a thin layer of the toner on a surface of the developer bearing member.

<23> In the image forming method according to any one of <18> to <22>, the transferring step is performed by the transferring unit which transfers the visible image, which is on the latent electrostatic image bearing member, onto the recording medium.

<24> In the image forming method according to any one of <18> to <23>, an image forming apparatus includes a plurality of image forming elements, each including the latent electrostatic image bearing member, the charging unit, the developing unit, and the transferring unit, in which the transferring units sequentially transfer visible images, which are formed on the latent electrostatic image bearing members, onto a recording medium, a surface of which moves to pass through transfer positions facing each of the latent electrostatic image bearing members of the plurality of image forming elements.

<25> In the image forming method according to any one of <18> to <22>, the transferring step is performed by the transferring unit which includes an intermediate transfer member to which the visible image formed on the latent electrostatic image bearing member is primarily transferred; and a secondary transferring unit configured to secondarily transfer the visible image, which is on the intermediate transfer member, onto the recording medium.

<26> The image forming method according to any one of <18> to <25> further including a cleaning step, in which the cleaning step is performed by the cleaning unit including a cleaning blade contacting the surface of the latent electrostatic image bearing member.

<27> In the image forming method according to any one of <18> to <25>, the developing step is performed by a developing unit which includes a developer bearing member contacting the surface of the latent electrostatic image bearing member, and is configured to develop the latent electrostatic image formed on the latent electrostatic image bearing member and collect residual toner on the latent electrostatic image bearing member.

<28> In the image forming method according to any one of <18> to <27>, the fixing step is performed by the fixing unit which includes at least any one of a roller and a belt and is configured to heat from a surface which does not contact the toner and fix the image on the recording medium by application of heat and pressure.

<29> In the image forming method according to any one of <18> to <27>, the fixing step is performed by the fixing unit which includes at least any one of a roller and a belt each configured to heat from a surface which contacts the toner and fix the image transferred onto the recording medium by application of heat and pressure.

<30> In the image forming method according to any one of <18> to <29>, a modification degree of the (meth)acrylic acid-modified rosin in the polyester resin (A) is 5 to 105.

<31> In the image forming method according to any one of <18> to <30>, a molar ratio of the 1,2-propanediol to the 1,3-propanediol (1,2-propanediol/1,3-propanediol) in the alcohol component of the polyester resin (B) ranges from 70/30 to 99/1.

<32> In the image forming method according to any one of <18> to <31>, at least any one of the polyester resin (A) and the polyester resin (B) contains at least any one of trivalent or more polyhydric alcohol as the alcohol component and a trivalent or more polyhydric carboxylic acid compound as the carboxylic acid component.

<33> In the image forming apparatus according to any one of <18> to <32>, the polycondensation of the alcohol component and the carboxylic acid component is performed under presence of any one of a titanium compound and a tin (II) compound without an Sn—C bond for at least any one of the polyester resin (A) and the polyester resin (B).

<34> In the image forming apparatus according to any one of <18> to <33>, the polyester resin (A) and the polyester resin (B) as well as a hybrid resin are used as the binder resin.

<35> A process cartridge detachable from an image forming apparatus, including:

a latent electrostatic image bearing member; and a developing unit configured to develop a latent electrostatic image, which is formed on the latent electrostatic image bearing member, with a toner to form a visible image, wherein the toner contains at least a binder resin and a colorant, and the binder resin contains a polyester resin (A) and a polyester resin (B) which has a softening point 10° C. or more higher than that of the polyester resin (A), the polyester resin (A) is a (meth)acrylic acid-modified rosin derived resin having a polyester unit obtained by polycondensation of an alcohol component and a carboxylic acid component, the alcohol component containing 65 mol % or more of 1,2-propanediol in a dihydric alcohol component, and the carboxylic acid component containing a (meth) acrylic acid-modified rosin, and the polyester resin (B) is a purified rosin derived resin having a polyester unit obtained by polycondensation of an alcohol component and a carboxylic acid component, the alcohol component containing a total of 70 mol % or more of 1,2-propanediol and 1,3-propanediol in a dihydric alcohol component, and the carboxylic acid component containing a purified rosin.

An image forming apparatus of the present invention includes: a latent electrostatic image bearing member; a charging unit configured to charge a surface of the latent electrostatic image bearing member; an exposing unit configured to expose the surface, which is charged, of the latent electrostatic image bearing member to form a latent electrostatic image; a developing unit configured to develop the latent electrostatic image with a toner to form a visible image; a transferring unit configured to transfer the visible image onto a recording medium; and a fixing unit configured to fix the image on the recording medium wherein the toner contains at least a binder resin and a colorant, and the binder resin contains a polyester resin (A) and a polyester resin (B) which has a softening point 10° C. or more higher than that of the polyester resin (A), the polyester resin (A) is a (meth)acrylic acid-modified rosin derived resin having a polyester unit obtained by polycondensation of an alcohol component and a carboxylic acid component, the alcohol component containing 65 mol % or more of 1,2-propanediol in a dihydric alcohol component, and the carboxylic acid component containing a (meth)acrylic acid-modified rosin, and the polyester resin (B) is a purified rosin derived resin having a polyester unit obtained by polycondensation of an alcohol component and a carboxylic acid component, the alcohol component containing a total of 70 mol % or more of 1,2-propanediol and 1,3-propanediol in a dihydric alcohol component, and the carboxylic acid component containing a purified rosin.

In an image forming apparatus of the present invention, the charging unit charges the surface of the latent electrostatic image bearing member uniformly. The exposing unit exposes the surface of the latent electrostatic image bearing member to form a latent electrostatic image. The developing unit develops the latent electrostatic image, which is formed on the latent electrostatic image bearing member, with a toner to form a visible image. The transferring unit transfers the visible image onto a recording medium. The fixing unit fixes the image transferred onto the recording medium. At this time, the toner contains a binder resin, and the binder resin contains a polyester resin (A) and a polyester resin (B) which has a softening point 10° C. or more higher than that of the polyester resin (A). The polyester resin (A) is a (meth)acrylic acid-modified rosin derived resin having a polyester unit obtained by polycondensation of an alcohol component and a carboxylic acid component. The alcohol component contains 65 mol % or more of 1,2-propanediol in a dihydric alcohol component, and the carboxylic acid component contains a (meth)acrylic acid-modified rosin. The polyester resin (B) is a purified rosin derived resin having a polyester unit obtained by polycondensation of an alcohol component and a carboxylic acid component. The alcohol component contains a total of 70 mol % or more of 1,2-propanediol and 1,3-propanediol in a dihydric alcohol component, and the carboxylic acid component contains a purified rosin. This toner has excellent low-temperature fixing property, anti-offset property, durability, pulverizability, and storage stability and causes less odor. Therefore, it is possible to form an extremely high quality image without varying a color tone over long-term printing or abnormality such as decrease in density and a background smear.

The image forming method of the present invention includes steps of charging a surface of a latent electrostatic image bearing member; exposing the surface, which is charged, of the latent electrostatic image bearing member to form a latent electrostatic image; developing the latent electrostatic image with a toner to form a visible image; transferring the visible image onto a recording medium; and fixing the image on the recording medium. The binder resin contains a polyester resin (A) and a polyester resin (B) which has a softening point 10° C. or more higher than that of the polyester resin (A). The polyester resin (A) is a (meth)acrylic acid-modified rosin derived resin having a polyester unit obtained by polycondensation of an alcohol component and a carboxylic acid component. The alcohol component contains 65 mol % or more of 1,2-propanediol in a dihydric alcohol component, and the carboxylic acid component contains a (meth)acrylic acid-modified rosin. The polyester resin (B) is a purified rosin derived resin having a polyester unit obtained by polycondensation of an alcohol component and a carboxylic acid component. The alcohol component contains a total of 70 mol % or more of 1,2-propanediol and 1,3-propanediol in a dihydric alcohol component, and the carboxylic acid component contains a purified rosin.

In an image forming method according to the present invention, the charging step charges the surface of the latent electrostatic image bearing member uniformly. The exposing step exposes the surface of the latent electrostatic image bearing member to form a latent electrostatic image. The developing step develops the latent electrostatic image, which is formed on the latent electrostatic image bearing member, with a toner to form a visible image. The transferring step transfers the visible image onto a recording medium. The fixing step fixes the image transferred onto the recording medium. At this time, the toner contains a binder resin, and the binder resin contains a polyester resin (A) and a polyester resin (B) which has a softening point 10° C. or more higher than that of the polyester resin (A). The polyester resin (A) is a (meth)acrylic acid-modified rosin derived resin having a polyester unit obtained by polycondensation of an alcohol component and a carboxylic acid component. The alcohol component contains 65 mol % or more of 1,2-propanediol in a dihydric alcohol component, and the carboxylic acid component contains a (meth)acrylic acid-modified rosin. The polyester resin (B) is a purified rosin derived resin having a polyester unit obtained by polycondensation of an alcohol component and a carboxylic acid component. The alcohol component contains a total of 70 mol % or more of 1,2-propanediol and 1,3-propanediol in a dihydric alcohol component, and the carboxylic acid component contains a purified rosin. This toner has excellent low-temperature fixing property, anti-offset property, durability, pulverizability, and storage stability and causes less odor. Therefore, it is possible to form an extremely high quality image without varying a color tone over long-term printing or abnormality such as decrease in density and a background smear.

The process cartridge of the present invention is detachable from the image forming apparatus and includes: a latent electrostatic image bearing member; and a developing unit configured to develop a latent electrostatic image, which is formed on the latent electrostatic image bearing member, with a toner to form a visible image. The toner contains a binder resin, and the binder resin contains a polyester resin (A) and a polyester resin (B) which has a softening point 10° C. or more higher than that of the polyester resin (A). The polyester resin (A) is a (meth)acrylic acid-modified rosin derived resin having a polyester unit obtained by polycondensation of an alcohol component and a carboxylic acid component. The alcohol component contains 65 mol % or more of 1,2-propanediol in a dihydric alcohol component, and the carboxylic acid component contains a (meth)acrylic acid-modified rosin. The polyester resin (B) is a purified rosin derived resin having a polyester unit obtained by polycondensation of an alcohol component and a carboxylic acid component. The alcohol component contains a total of 70 mol % or more of 1,2-propanediol and 1,3-propanediol in a dihydric alcohol component, and the carboxylic acid component contains a purified rosin. This toner has excellent low-temperature fixing property, anti-offset property, durability, pulverizability, and storage stability and causes less odor. Therefore, it is possible to form an extremely high quality image without varying a color tone over long-term printing or abnormality such as decrease in density and a background smear.

Figure 1:
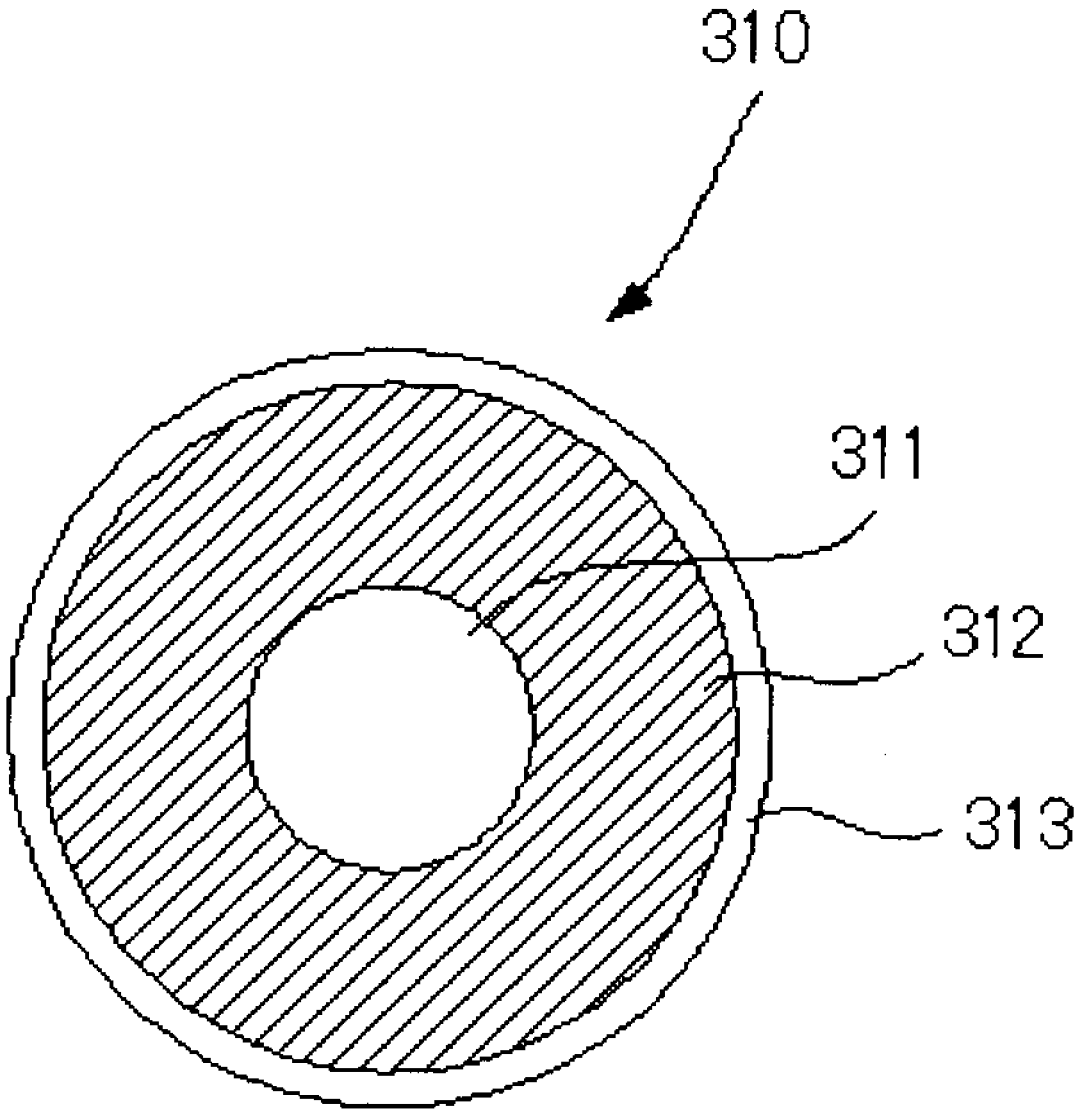
FIG. 1 is a schematic sectional view showing an example of a charging roller in an image forming apparatus of the present invention.

DETAILED DESCRIPTION OF THE INVENTION (Image Forming Apparatus and Image Forming Method)

An image forming apparatus of the present invention includes at least a latent electrostatic image bearing member, a charging unit, an exposing unit, a developing unit, a transferring unit, and a fixing unit. The image forming apparatus may further include a cleaning unit and other units optionally selected as necessary (e.g., a charge eliminating unit, a recycling unit, and a controlling unit). Note that the charging unit and the exposing unit may be generically referred to as a latent electrostatic image forming unit.

An image forming method of the present invention includes at least a charging step, an exposing step, a developing step, a transferring step, and a fixing step. The image forming method may further include a cleaning step and other steps optionally selected as necessary (e.g., a charge eliminating step, a recycling step, and a controlling step). Note that the charging step and the exposing step may be generically referred to as a latent electrostatic image forming step.

The image forming method of the present invention can be suitably performed by the image forming apparatus of the present invention. The charging step can be performed by the charging unit. The exposing step can be performed by the exposing unit. The developing step can be performed by the developing unit. The transferring step can be performed by the transferring unit. The fixing step can be performed by the fixing unit. The cleaning step can be performed by the cleaning unit, and other steps can be performed by other units.

<Latent Electrostatic Image Bearing Member>

The material, shape, structure, size, and the like of the latent electrostatic image bearing member are not particularly limited and can be appropriately selected according to the purpose. The shape can be, for example, a drum, a sheet, or an endless belt. The structure may be a singe-layered structure or a multi-layered structure. The size can be appropriately adjusted depending on the size and specification of the image forming apparatus. Examples of the material include inorganic photoconductors such as amorphous silicon, selenium, CdS, and ZnO; and organic photoconductors (OPC) such as polysilane and phthalopolymethine.

The amorphous silicon photoconductor is obtained, for example, by heating a substrate to 50° C. to 400° C. Subsequently, an a-Si photoconductive layer is formed on the substrate by film deposition such as vacuum deposition, sputtering, ion plating, thermal CVD, photo-CVD, or plasma CVD. Among these, the plasma CVD is particularly preferable. Specifically, it is preferable to decompose a source gas by direct current, high frequency, or microwave glow discharge to form an a-Si photoconductive layer on a substrate.

The organic photoconductor (OPC) is commonly and widely used for the following reasons: (1) the OPC has excellent optical properties—for example, the OPC has a wide light absorption wavelength range and absorbs a large amount of light; (2) the OPC has excellent electrical properties—for example, the OPC has high sensitivity and stable charge properties; (3) wide selection of materials; (4) the OPC is easily produced; (5) low production costs; and (6) nontoxicity. The organic photoconductor generally has either a single-layered structure or a multi-layered structure.

The photoconductor having a singe-layered structure includes a substrate and a single-layered photoconductive layer formed on the substrate. The photoconductor may further include a protective layer, an intermediate layer, and other layers as necessary.

The photoconductor having a multi-layered structure includes a substrate and a multi-layered photoconductive layer formed on the substrate. The multi-layered photoconductive layer has at least a charge generation layer and a charge transport layer on the substrate in this order. The photoconductor may further include a protective layer, an intermediate layer, and other layers as necessary.

<Charging Step and Charging Unit>

In the charging step, the charging unit charges the surface of the latent electrostatic image bearing member.

The charging unit is not particularly limited and can be appropriately selected according to the purpose as long as the charging unit can uniformly charge the surface of the latent electrostatic image bearing member by applying a voltage. In general, there are two types of the charging unit. One is a contact charging unit (1) which charges the latent electrostatic image bearing member with contact. The other is a non-contact charging unit (2) which charges the latent electrostatic image bearing member without contact.

—Contact Charging Unit—

Examples of the contact charging unit (1) include a conductive or semiconductive charging roller, a magnetic brush, a fur brush, a film, and a rubber blade. Among these, the charging roller can significantly reduce ozone generation, compared with corona discharge. Thus, the charging roller has excellent stability for repetitive use of the latent electrostatic image bearing member and is effective in preventing degradation of image quality.

The magnetic brush is composed of a non-magnetic conductive sleeve and a magnet roll, for example. The sleeve supports various ferrite particles such as Zn—Cu ferrite, and the magnet roll is enveloped in the sleeve. The fur brush is formed by winding or affixing a fur, which has been subjected to conduction treatment by carbon, copper sulfide, metal, metal oxide, or the like, around or to a metal or a conductive core metal.

FIG. 1 is a sectional view showing an example of a charging roller. This charging roller 310 includes a core metal 311, a resistance controlling layer 312, and a protective layer 313. The core metal 311 is a cylindrical conductive substrate. The resistance controlling layer 312 is formed on the circumference of the core metal 311. The protective layer 313 covers the surface of the resistance controlling layer 312 to prevent leakage.

The resistance controlling layer 312 is formed by extrusion molding or injection molding of a thermoplastic resin composition, which contains at least thermoplastic resin and a polymer ion conductive agent, on the peripheral surface of the core metal 311.

A volume resistivity of the resistance controlling layer 312 is preferably from $10^6$ Ω·cm to $10^9$ Ω·cm. When the volume resistivity exceeds $10^9$ Ω·cm, a charge amount is insufficient, and a photoconductor drum may not obtain a charge potential sufficient to obtain an image without unevenness. When the volume resistivity is less than $10^6$ Ω·cm, leakage may occur to the entire photoconductor drum.

The thermoplastic resin used for the resistance controlling layer 312 is not particularly limited and can be appropriately selected according to the purpose. Examples of the thermoplastic resin include polyethylene (PE), polypropylene (PP), polymethyl methacrylate (PMMA), polystyrene (PS), and copolymers (e.g., AS and ABS) thereof.

The polymer ion conductive agent itself has a resistivity of approximately $10^6$ Ω·cm to $10^{10}$ Ω·cm and easily decreases the resistance of the resin. Examples of the agent include a compound which contains a polyetheresteramide component. To adjust the resistivity of the resistance controlling layer 312 within the range, the amount of the ion conductive agent is preferably from 30 parts by mass to 70 parts by mass per 100 parts by mass of the thermoplastic resin.

A quaternary ammonium salt group-containing polymer compound can also be used as the polymer ion conductive agent. Examples of the quaternary ammonium salt group-containing polymer compound include a quaternary ammonium salt group-containing polyolefin. To adjust the resistivity of the resistance controlling layer 312 within the range, the amount of the ion conductive agent is preferably from 10 parts by mass to 40 parts by mass per 100 parts by mass of the thermoplastic resin.

The polymer ion conductive agent can be dispersed in the thermoplastic resin by a twin screw kneader, a kneader, or the like. The polymer ion conductive agent is uniformly dispersed in the thermoplastic resin composition at molecular level so that the resistivity of the resistance controlling layer 312 does not vary, whereas a resistivity of a resistance controlling layer varies where conductive pigment is poorly dispersed. Moreover, the polymer ion conductive agent is uniformly dispersed and fixed in the thermoplastic resin composition since the polymer ion conductive agent is a polymer compound. Therefore, bleedout is less likely to occur.

The protective layer 313 is formed so that its resistivity is higher than that of the resistance controlling layer 312. However, charge efficiency decreases when the resistivity of the protective layer 313 is extremely high. Thus, a difference between the resistivities of the protective layer 313 and the resistance controlling layer 312 is preferably $10^3$ Ω·cm or less.

The material of the protective layer 313 is preferably a resin material in terms of film formability. For example, the resin material is preferably a fluororesin, a polyamide resin, a polyester resin, or a polyvinyl acetal resin because of their excellent non-viscosity to prevent adhesion of the toner. Moreover, the charging roller cannot function properly if the protective layer 313 is made of only the resin material since the resin material generally has electrical insulating property. Thus, the resistivity of the protective layer 313 is adjusted by dispersing various conductive agents in the resin material. To improve adhesion between the protective layer 303 and the resistance controlling layer 302, a reactive curing agent such as an isocyanate may be dispersed in the resin material.

The charging roller 310 is connected to a power supply, and a predetermined voltage is applied thereto. The voltage may be only a direct current (DC) voltage, but is preferably a voltage in which an alternating current (AC) voltage is superimposed on the DC voltage. The surface of the photoconductor drum can be charged even more uniformly by applying the AC voltage.

Figure 2:
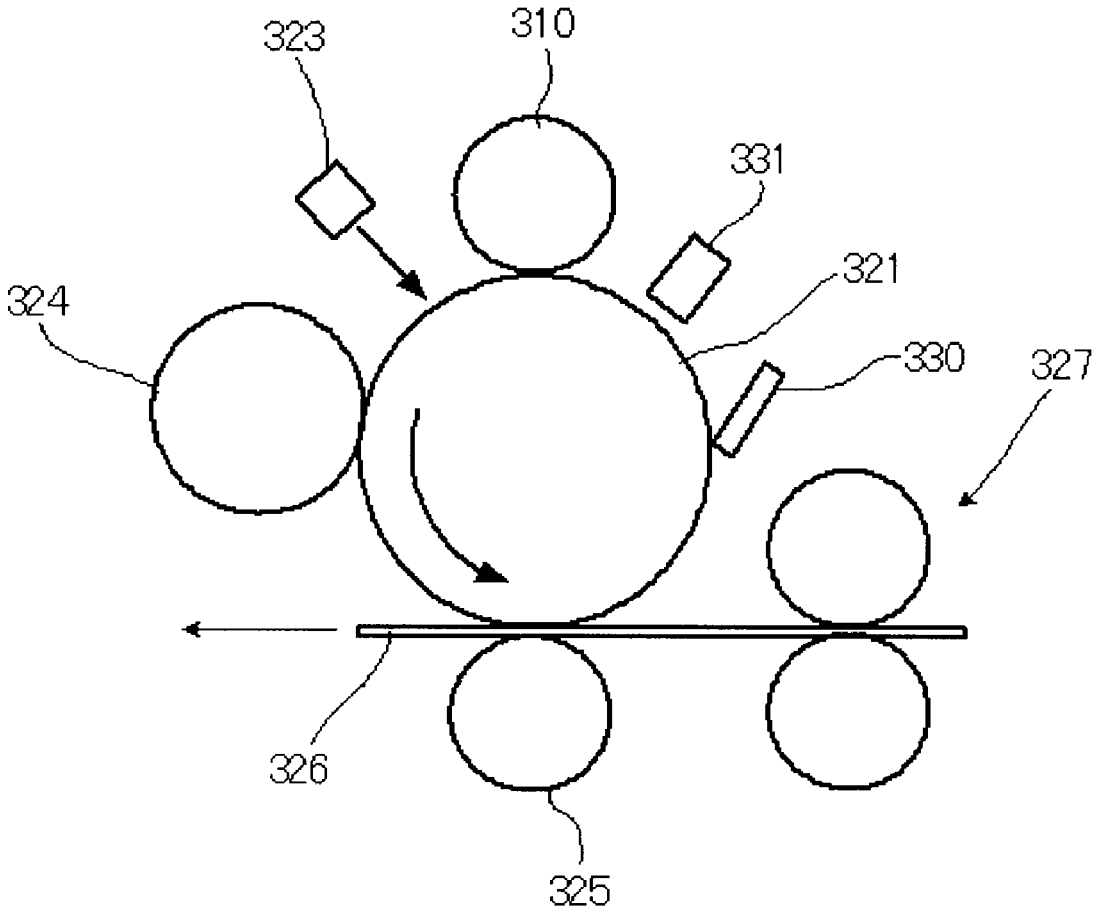
FIG. 2 is a schematic view showing an example of application of a contact charging roller in an image forming apparatus of the present invention.

FIG. 2 is a schematic view showing an example of application of the contact charging roller 310 shown in FIG. 1 in the image forming apparatus. Herein, the charging roller 310 serves as a charging unit. In FIG. 2, a charging unit 310, an exposing unit 323, a developing unit 324, a transferring unit 325, a fixing unit 327, a cleaning unit 330, and a charge eliminating unit 331 are disposed around a photoconductor drum 321 in this order. The photoconductor drum 321 serves as the latent electrostatic image bearing member. The charging unit 310 charges the surface of the photoconductor drum 321. The exposing unit 323 forms a latent electrostatic image on the charged surface. The developing unit 324 makes a toner adhere to the latent electrostatic image on the surface of the photoconductor drum 321 to form a visible image. The transferring unit 325 transfers the visible image, which is formed on the photoconductor drum 321, onto a recording medium 326. The fixing unit 327 fixes the transferred image on the recording medium. The cleaning unit 330 removes and collects the residual toner on the photoconductor drum 321. The charge eliminating unit 331 removes the residual potential on the photoconductor drum 321. The contact charging roller 310 shown in FIG. 1 is provided as the charging unit 310 and charges the surface of the photoconductor drum 321 uniformly.

—Non-Contact Charging Unit—

Examples of the non-contact charging unit (2) include a non-contact charger, a needle electrode device, a solid discharge element, and a conductive or semiconductive charging roller. The non-contact charger utilizes corona discharge. The conductive or semiconductive charging roller is disposed so that there is a microgap between the charging roller and the latent electrostatic image bearing member.

Corona discharge gives positive or negative ions generated by corona discharge in air to the surface of the latent electrostatic image bearing member without contact. Examples of the corona charger include a corotron charger and a scorotron charger. The corotron charger gives a predetermined charge amount to the latent electrostatic image bearing member, and the scorotron charger gives a predetermined potential thereto.

The corotron charger is composed of a casing electrode and a discharge wire. The casing electrode occupies a half space around the discharge wire, and the discharge wire is placed near the center thereof.

The scorotron charger has the same basic structure as the corotron charger, except that the scorotron charger has a grid electrode. The grid electrode is provided 1.0 mm to 2.0 mm apart from the surface of the latent electrostatic image bearing member.

Figure 3:
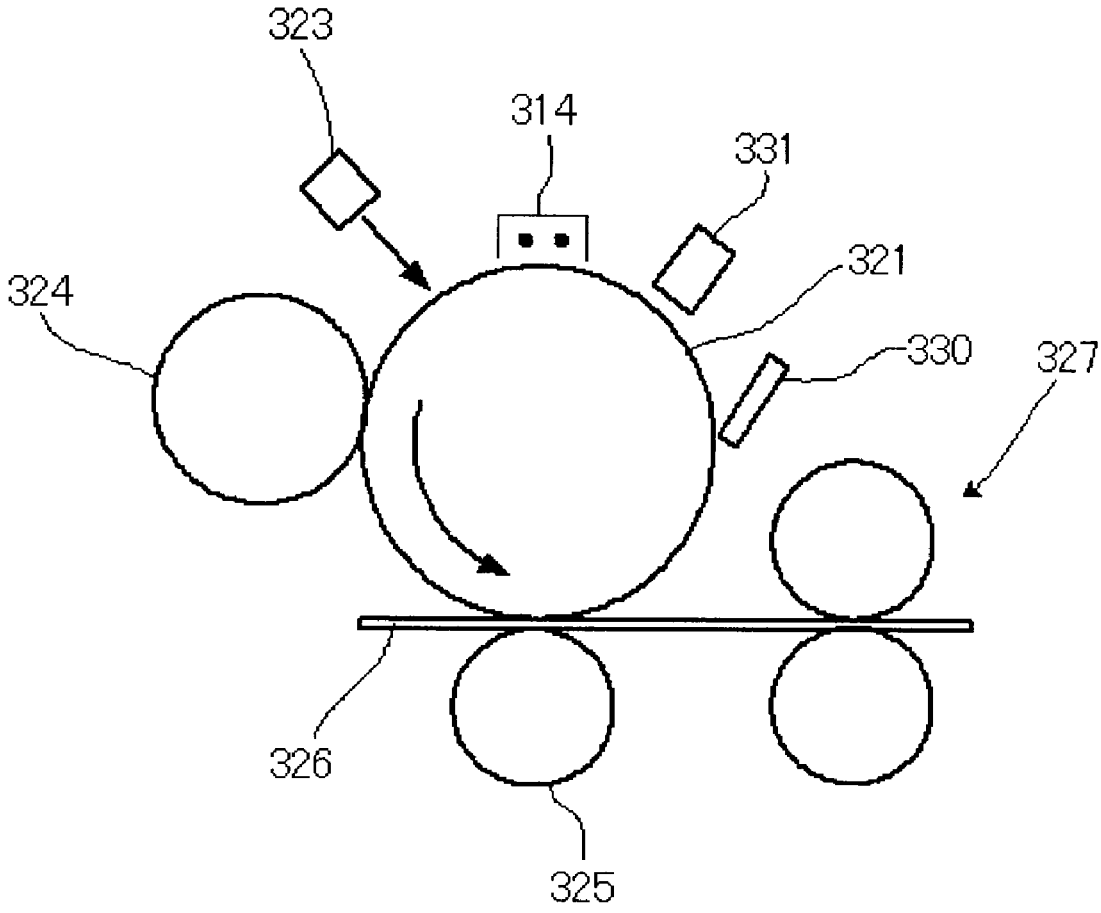
FIG. 3 is a schematic view showing an example of application of a non-contact corona charger in an image forming apparatus of the present invention.

FIG. 3 is a schematic view showing an example of application of a non-contact corona charger in the image forming apparatus. Herein, the non-contact corona charger serves as a charging unit. In FIG. 3, the same reference numerals as in FIG. 2 denote the same parts.

A non-contact corona charger 314 is provided as the charging unit and is configured to charge the surface of the photoconductor drum 321 uniformly.

The charging roller is disposed so that there is a microgap between the charging roller and the latent electrostatic image bearing member. This charging roller is improved so as to keep a microgap with the latent electrostatic image bearing member. The microgap is preferably from 10 μm to 200 μm and more preferably from 10 μm to 100 μm.

Figure 4:
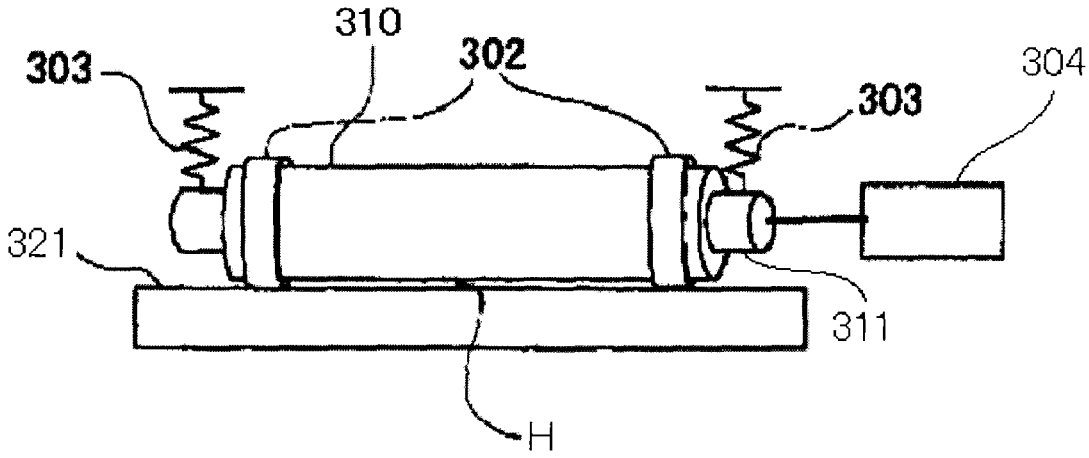
FIG. 4 is a schematic view showing an example of non-contact charging roller in an image forming apparatus of the present invention.

FIG. 4 is a schematic view showing an example of a non-contact charging roller. In FIG. 4, the charging roller 310 is disposed so that there is a microgap H between the charging roller 310 and the photoconductor drum 321. The microgap H can be obtained by winding spacer members, which have predetermined thickness, around non-image formation regions at both ends of the charging roller 310 to contact the surfaces of the spacer members to the surface of the photoconductor drum 321. Note that the reference numeral 304 denotes a power supply in FIG. 4.

In FIG. 4, films 302 are wound around both ends of the charging roller 310 to serve as spacer members, thereby keeping the microgap H. These spacers 302 contact the photoconductive surface of the latent electrostatic image bearing member to obtain the predetermined microgap H in an image forming region between the charging roller and the latent electrostatic image bearing member. Moreover, a bias, an AC superimposed voltage, is applied, and the latent electrostatic image bearing member is charged by discharge generated in the microgap H between the charging roller and the latent electrostatic image bearing member. As shown in FIG. 4, an axis 311 of the charging roller is pressurized by springs 303 so that the microgap H is maintained more accurately.

The spacer members and the charging roller may be integrally molded. At least the surfaces facing the gap should be insulators. Consequently, discharge is eliminated at the gap, and discharge products are not accumulated at the gap. Thus, it is possible to prevent the gap from widening because the toner does not adhere to the gap due to the viscosity of the discharge products.

Heat-shrinkable tubings may be used as the spacer members. Examples of the heat-shrinkable tubings include Sumitube for 105° C. (trade name: F105° C., manufactured by Sumitomo Chemical Co., Ltd.).

<Exposing Step and Exposing Unit>

For example, the surface of the latent electrostatic image bearing member can be imagewisely exposed by the exposing unit.

The optical systems for the exposure are generally classified into an analog optical system and a digital optical system. The analog optical system projects an original directly onto the latent electrostatic image bearing member. The digital optical system converts image information into electrical signals and then into optical signals and exposes the latent electrostatic image bearing member to form an image.

The exposing unit is not particularly limited and can be appropriately selected according to the purpose as long as the exposing unit can imagewisely expose the surface of the latent electrostatic image bearing member, which has been charged by the charging unit. Examples of the exposing unit include various exposure devices such as a copying optical system, a rod lens array system, a laser optical system, a liquid crystal shutter optical system, and an LED optical system.

In the present invention, a rear light system may be employed to imagewisely expose the latent electrostatic image bearing member.

<Developing Step and Developing Unit>

In the developing step, the latent electrostatic image is developed with a toner or developer to form a visible image.

The visible image can be formed, for example, by developing the latent electrostatic image with the toner or developer, and this can be performed by the developing unit.

The developing unit is not particularly limited and can be appropriately selected from known units as long as the developing unit can develop the image with a toner or developer. The developing unit preferably accommodates the toner or developer and can give the toner or developer to the latent electrostatic image with or without contact.

[Toner]

The toner contains at least a binder resin and a colorant. The toner preferably contains a releasing agent, a charge control agent, and an external additive and may further contain other components as necessary.

—Binder Resin—

The binder resin contains a polyester resin (A) and a polyester resin (B) which has a softening point 10° C. or more higher than that of the polyester resin (A). The binder resin may contain other components as necessary.

The polyester resin (A) is a (meth)acrylic acid-modified rosin derived resin having a polyester unit obtained by polycondensation of an alcohol component and a carboxylic acid component. The alcohol component contains 65 mol % or more of 1,2-propanediol in a dihydric alcohol component, and the carboxylic acid component contains a (meth)acrylic acid-modified rosin.

The polyester resin (B) is a purified rosin derived resin having a polyester unit obtained by polycondensation of an alcohol component and a carboxylic acid component. The alcohol component contains a total of 70 mol % or more of 1,2-propanediol and 1,3-propanediol in a dihydric alcohol component, and the carboxylic acid component contains a purified rosin.

The polyester resins (A) and (B) are obtained by polycondensation of the alcohol component and the carboxylic acid component. To achieve low-temperature fixing property, anti-hot offset property, and thermal resistance and storage stability, a softening point Tm (A) of the polyester resin (A) is preferably from 80° C. or more to less than 120° C., more preferably from 85° C. or more to 115° C. or less, and still more preferably from 90° C. or more to 110° C. or less. A softening point Tm (B) of the polyester resin (B) is preferably from 120° C. or more to 160° C. or less, more preferably from 130° C. or more to 155° C. or less, and still more preferably from 135° C. or more to 155° C. or less.

When the softening points Tm (A) and (B) are in the above ranges, it is possible to achieve low-temperature fixing property, anti-hot offset property, and thermal resistance and storage stability and obtain extremely good fixing quality.

A difference between Tm (A) and (B) (ΔTm; Tm(b)—Tm (A)) is 10° C. or more, preferably from 15° C. to 55° C., and more preferably from 20° C. to 50° C. When the difference is less than 10° C., the toner can be fixed in a narrow temperature range, and cold offset and hot offset are likely to occur.

Moreover, to achieve low-temperature fixing property, anti-hot offset property, and thermal resistance and storage stability, a mass ratio of the polyester resin (A) to the polyester resin (B) ((A)/(B)) is preferably from 10/90 to 90/10, more preferably from 20/80 to 80/20, and still more preferably from 30/70 to 70/30.

Having these properties, the polyester resin (A) with the low softening point improves the low-temperature fixing property, and the polyester resin (B) with the high softening point improves the anti-offset property. Using the polyester resins (A) and (B) together is effective in achieving both the low-temperature fixing property and the anti-offset property.

Glass transition temperatures of the polyester resins (A) and (B) are preferably from 45° C. to 75° C. and more preferably from 50° C. to 70° C. to achieve fixing property, storage stability, and durability. To achieve charging property and environmental stability, acid values of the resins are preferably from 1 mg KOH/g to 80 mg KOH/g, more preferably 5 mg KOH/g to 60 mg KOH/g, and still more preferably from 5 mg KOH/g to 50 mg KOH/g, and hydroxyl values thereof are preferably from 1 mg KOH/g to 80 mg KOH/g, more preferably from 8 mg KOH/g to 50 mg KOH/g, and still more preferably from 8 mg KOH/g to 40 mg KOH/g.

The polyester resins (A) and (B) contain low molecular weight components having a molecular weight of 500 or less, including a residual monomer component and an oligomer component. To achieve low-temperature fixing property, anti-offset property, and storage stability, the amount of low molecular weight components in the polyester resins is preferably 12% or less, more preferably 10% or less, still more preferably 9% or less, and further preferably 8% or less. It is possible to reduce the amount of low molecular weight components by enhancing rosin modification or the like. Note that the amount of low molecular weight components corresponds to an area ratio of the molecular weight measured by gel permeation chromatography (GPC) described later.

In the present invention, the polyester resin means a resin having a polyester unit. The polyester unit indicates a site having a polyester structure. Examples of the polyester resin do not include only polyester, but also other polyesters which are modified without substantially losing their properties. However, both the polyester resins (A) and (B) are preferably polyesters in the present invention. Examples of the modified polyesters include polyesters grafted or blocked by phenol, urethane, epoxy, or the like as described in JP-A Nos. 11-133668, 10-239903, 08-20636, or the like; and a composite resin which has two or more resin units including a polyester unit.

The polyester units in the polyester resins (A) and (B) of the present invention are preferably amorphous rather than crystalline. In this specification, an amorphous resin means a resin having a softening point and a glass transition temperature (Tg) with a difference of 30° C. or more.

The polyester resin (A) in the present invention has a polyester unit obtained by polycondensation of the alcohol component and the carboxylic acid component. The alcohol component has 65 mol % or more of 1,2-propanediol content in a dihydric alcohol component and is substantially composed of only aliphatic alcohol. The carboxylic acid component contains a (meth)acrylic acid-modified rosin.

1,2-propanediol employed as the alcohol component of the polyester resin (A) is branched chain alcohol and has 3 carbon atoms and surprising effects that extremely low-temperature fixing is enabled and storage stability is improved. It is because, compared with alcohol having two or less carbon atoms, 1,2-propanediol is effective in improving low-temperature fixing property while keeping anti-offset property. Moreover, compared with branched chain alcohol having 4 or more carbon atoms, 1,2-propanediol is effective in preventing degradation of storage stability caused by reduction in glass transition temperature. Furthermore, the polyester resin containing 1,2-propanediol as its alcohol component has excellent compatibility with a releasing agent so that the releasing agent can be easily and finely dispersed. Especially when the amount of 1,2-propanediol in the dihydric alcohol component is 65 mol % or more, it is possible to achieve both excellent low-temperature fixing property and anti-offset property.

The alcohol component of the polyester resin (A) may contain alcohol other than 1,2-propanediol as long as the objects and effects of the present invention can be attained. The amount of 1,2-propanediol in dihydric alcohol component is 65 mol % or more, preferably 70 mol % or more, still more preferably 80 mol % or more, and further preferably 90 mol % or more. Examples of the dihydric alcohol component other than 1,2-propanediol include aliphatic dialcohols such as 1,3-propanediol, ethylene glycols having different numbers of carbon atoms, hydrogenated bisphenol A, and alkylene (having two to four carbon atoms) oxide (average number of moles for addition is from 1 to 16) adducts thereof.

The amount of dihydric alcohol component in the alcohol component is preferably from 60 mol % to 95 mol % and more preferably from 65 mol % to 90 mol %.

The alcohol component of the polyester resin (A) preferably contains 1,3-propanediol for anti-offset property. A molar ratio of 1,2-propanediol to 1,3-propanediol (1,2-propanediol/1,3-propanediol) in the alcohol component of the polyester resin (A) is preferably from 99/1 to 65/35, more preferably from 95/5 to 70/30, still more preferably from 90/10 to 75/25, and further preferably from 85/15 to 77/23.

The alcohol component of the polyester resin (A) may contain aromatic alcohol including alkylene oxide adducts of bisphenol A such as polyoxypropylene (2,2)-2,2-bis(4-hydroxyphenyl)propane and polyoxyethylene (2,2)-2,2-bis(4-hydroxyphenyl)propane. However, the alcohol component of the polyester resin (A) is preferably composed substantially of only aliphatic alcohol. In this specification, the phrase "the alcohol component composed substantially of only aliphatic alcohol" means that the amount of aliphatic alcohol in the alcohol component is 90 mol % or more.

The carboxylic acid component of the polyester resin (A) is not particularly limited and can be appropriately selected according to the purpose as long as the component contains a (meth)acrylic acid-modified rosin.

The polyester resin (A), a (meth)acrylic acid-modified rosin-containing resin, can be fixed at very low temperature and improves the storage stability. Moreover, the resin contains a (meth)acrylic acid-modified rosin as part of a main chain of the polyester unit, thereby increasing the molecular weight thereof. Meanwhile, it is possible to achieve low-temperature fixing property, anti-offset property, and storage stability although it seems to be contradictory, since the low molecular weight components with a molecular weight of 500 or less (i.e., the residual monomer component and the oligomer component) are reduced. Specifically, a resin with a low softening point improves low-temperature fixing property, but degrades storage stability of the toner. Thus, using a (meth)acrylic acid-modified rosin-containing resin as the polyester resin (A) achieves both low-temperature fixing property and storage stability. In this specification, the resin of the present invention is mentioned as a (meth)acrylic acid-modified rosin derived rein for convenience. This "derived" means that a (meth)acrylic acid-modified rosin is used as at least one of the ingredient monomers.

—(Meth)acrylic Acid Modified Rosin—

The (meth)acrylic acid-modified rosin is a rosin modified with (meth)acrylic acid and is obtained by addition reaction of a rosin with(meth)acrylic acid. The rosin is mainly composed of, for example, abietic acid, neoabietic acid, palustric acid, pimaric acid, isopimaric acid, sandaracopimaric acid, dehydroabietic acid, and levopimaric acid. Specifically, the rosin can be obtained by the Diels-Alder reaction of the main component of the rosin, which has a conjugated double bond (i.e., levopimaric acid, abietic acid, neoabietic acid, and palustric acid), with (meth)acrylic acid under heat.

In this specification, "(meth)acryl" means acryl or methacryl. Accordingly, (meth)acrylic acid means acrylic acid or methacrylic acid, and "(meth)acrylic acid-modified rosin" means a rosin modified with acrylic acid or a rosin modified with methacrylic acid. The (meth)acrylic acid-modified rosin in the present invention is preferably a rosin modified with acrylic acid causing less steric hindrance for active Diels-Alder reaction.

To increase the molecular weight of the polyester resin and decrease the low molecular weight oligomer component, rosin modification degree with (meth)acrylic acid ((meth) acrylic acid modification degree) is preferably from 5 to 105, more preferably from 20 to 105, still more preferably from 40 to 105, and further preferably from 60 to 105.

Herein, the (meth)acrylic acid modification can be calculated by the following equation (1).

$$\text{Modification Degree of (Meth)acrylic Acid} = \frac{X_1 - Y}{X_2 - Y} \times 100 \qquad \text{(Equation 1)}$$

In the equation (1), $X_1$ denotes an SP value of a (meth) acrylic acid-modified rosin to calculate the modification thereof, $X_2$ denotes a saturated SP value of a (meth)acrylic acid-modified rosin obtained by reacting 1 mol of (meth) acrylic acid with 1 mol of a rosin, and Y denotes an SP value of a rosin.

The SP value means a softening point measured by an automatic ring-and-ball softening point tester as shown in Examples described later. The saturated SP value means an SP value obtained when the reaction of the (meth)acrylic acid with the rosin is repeated until the SP value of the resulting (meth)acrylic acid-modified rosin reaches a saturation value. The numerator $(X_1-Y)$ of the equation (1) means an increase in the SP value of the rosin modified with (meth)acrylic acid. A large value of (meth)acrylic acid modification degree represented by the equation (1) indicates a large degree of the modification.

A method for preparing the (meth)acrylic acid-modified rosin is not particularly limited and can be appropriately selected according to the purpose. For example, the (meth) acrylic acid-modified rosin can be obtained by mixing a rosin and (meth)acrylic acid and heating the mixture to approximately 180° C. to 260° C., preferably 180° C. to 210° C. This adds the (meth)acrylic acid to an acid is having a conjugated double bond in the rosin through the Diels-Alder reaction. The obtained (meth)acrylic acid-modified rosin may be used as it is or further subjected to purification by distillation or the like to be used.

The rosin used for the (meth)acrylic acid-modified rosin is not particularly limited, and any known rosin may be used as long as the rosin is mainly composed of abietic acid, neoabietic acid, palustric acid, pimaric acid, isopimaric acid, sandaracopimaric acid, dehydroabietic acid, or levopimaric acid. Examples of the rosin include a natural rosin obtained from pine trees, an isomerized rosin, a dimerized rosin, a polymerized rosin, and a disproportioned rosin. For color, the rosin is preferably a natural rosin such as a tall rosin, a gum rosin, or a wood rosin. The tall rosin is obtained from tall oil produced as a by-product in the process for producing a natural rosin pulp. The gum rosin is obtained from a raw rosin. The wood rosin is obtained from a pine stump. The tall rosin is more preferable for low-temperature fixing property.

The (meth)acrylic acid-modified rosin contains less impurities which cause odor since the rosin is obtained through the Diels-Alder reaction under heat. Thus, the rosin has less odor. To further reduce odor and improve storage stability, the (meth)acrylic acid-modified rosin is preferably obtained by modifying a purified rosin with (meth)acrylic acid and more preferably obtained by modifying a purified tall rosin with (meth)acrylic acid.

The purified rosin has less impurities through the purifying step. Impurities in the rosin are removed by purifying the rosin. Examples of impurities are mainly 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethylcyclohexanone, 1-methyl-2-(1-methylethyl)benzene, 3,5-dimethyl-2-cyclohexene, and 4-(1-methylethyl)benzaldehyde. In the present invention, it is possible to use peak intensities of hexanoic acid, pentanoic acid, and benzaldehyde as an indicator of the purified rosin. The peak intensities are detected as volatile components of the three types of impurities by headspace GC-MS. For the indicator, the volatile components of the impurities are used instead of absolute quantities thereof of impurities because the purified rosin in the present invention aims to reduce odor, compared with conventional rosin-containing polyester resins.

Specifically, the purified rosin has hexanoic acid, pentanoic acid, and benzaldehyde with peak intensities of $0.8\times10^7$ or less, $0.4\times10^7$ or less, and $0.4\times10^7$ or less respectively under measurement conditions for the headspace GC-MS in Examples described later. For storage stability and odor, the peak intensity of hexanoic acid is preferably $0.6\times10^7$ or less and more preferably $0.5\times10^7$ or less. The peak intensity of pentanoic acid is preferably $0.3\times10^7$ or less and more preferably $0.2\times10^7$ or less. The peak intensity of benzaldehyde is preferably $0.3\times10^7$ or less and more preferably $0.2\times10^7$ or less.

Beside the three substances described above, amounts of n-hexanal and 2-pentylfuran are preferably reduced for storage stability and odor. A peak intensity of n-hexanal is preferably $1.7\times10^7$ or less, more preferably $1.6\times10^7$ or less, and still more preferably $1.5\times10^7$ or less. A peak intensity of 2-pentylfuran is preferably $1.0\times10^7$ or less, more preferably $0.9\times10^7$ or less, and still more preferably $0.8\times10^7$ or less.

A method for purifying the rosin is not particularly limited, and a known method such as distillation, recrystallization, and extraction can be employed. Distillation is preferable for purification. For example, distillation under reduced pressure, molecular distillation, or steam distillation may be employed as described in JP-A No. 07-286139. Distillation under reduced pressure is preferable for purification. For example, distillation is usually performed under a pressure of 6.67 kPa or less at a still temperature of 200° C. to 300° C. Herein, simple distillation, thin film distillation, rectification, or the like may be used. Under normal distillation conditions, a high molecular weight substance is removed as a pitch fraction in the proportion of 2% by mass to 10% by mass with respect to the rosin. Simultaneously, 2% by mass to 10% by mass of a first fraction is removed.

Before modification, the softening point of the rosin is preferably from 50° C. to 100° C., more preferably from 60° C. to 90° C., and still more preferably from 65° C. to 85° C. The softening point of rosin is measured by a measurement method in Examples described later, in which a rosin is once melted and naturally cooled down for one hour at a temperature of 25° C. with a relative humidity of 50%.

Before modification, the acid value of the rosin is preferably from 100 mg KOH/g to 200 mg KOH/g, more preferably from 130 mg KOH/g to 180 mg KOH/g, and still more preferably from 150 mg KOH/g to 170 mg KOH/g. The acid value of the rosin can be measured, for example, based on the method described in JIS K0070.

The amount of (meth)acrylie acid-modified rosin in the carboxylic acid component is preferably 15% by mass or more and more preferably from 25% by mass or more for low-temperature fixig property. Moreover, the amount of (meth)acrylic acid-modified rosin is preferably 85% by mass or less, more preferably 65% by mass or less, and still more preferably 50% by mass or less for storage stability. Thus, the amount of (meth)acrylic acid-modified rosin in the carboxylic acid component is preferably from 15% by mass to 85% by mass, more preferably from 25% by mass to 65% by mass, and still more preferably from 25% by mass to 50% by mass.

A carboxylic acid compound other than the (meth)acrylic acid-modified rosin in the carboxylic acid component is not particularly limited and can be appropriately selected depending on the purposes. Examples of carboxylic acid include aliphatic dicarboxylic acids such as oxalic acid, malonic acid, maleic acid, (meth)acrylic acid, citraconic acid, itaconic acid, glutaconic acid, succinic acid, adipic acid, sebacic acid, azelaic acid, n-dodecylsuccinic acid, and n-dodecenylsuccinic acid; aromatic dicarboxylic acids such as phthalic acid, isophthalic acid, and terephthalic acid; alicyclic dicarboxylic acids such as cyclohexanedicarboxylic acid; trivalent or more polyhydric carboxylic acids such as trimellitic acid and pyromellitic acid; and anhydrides and alkyl (having 1 to 3 carbon atoms) esters of these acids. In this specification, these acids, anhydrides and alkyl esters thereof are generically referred to as a carboxylic acid compound.

The polyester resin (B) in the present invention has a polyester unit obtained by polycondensation of the alcohol component and the carboxylic acid component. The alcohol component contains a total of 70 mol % or more of 1,2-propanediol and 1,3-propanediol in a dihydric alcohol component and is substantially composed of only aliphatic alcohol. The carboxylic acid component contains a purified rosin.

1,2-propanediol employed as the alcohol component of the polyester resin (B) is branched chain alcohol and has 3 carbon atoms and effects that extremely low-temperature fixing is enabled and storage stability is improved. Similar to 1,2-propanediol employed as the alcohol component of the polyester resin (A) in the present invention, 1,2-propanediol of the polyester resin (B) is effective in improving low-temperature fixing property while keeping anti-offset property, compared with alcohol having two or less carbon atoms. Moreover, compared with branched chain alcohol having 4 or more carbon atoms, 1,2-propanediol is effective in preventing degradation of storage stability caused by reduction in glass transition temperature. Furthermore, the polyester resin containing 1,2-propanediol as its alcohol component has excellent compatibility is with a releasing agent so that the releasing agent can be easily and finely dispersed.

By using 1,2-propanediol and 1,3-propanediol together, it is possible to prevent an increase in the glass transition temperature although the polyester resin (B) in the present invention has a high softening point. Thus, the polyester resin (B) has good compatibility with the polyester resin (B).

A molar ratio of 1,2-propanediol to 1,3-propanediol (1,2-propanediol/1,3-propanediol) in the alcohol component of the polyester resin (B) is preferably from 70/30 to 99/1, more preferably from 75/25 to 90/10, and still more preferably from 85/15 to 77/23.

Especially when a total of 70 mol % or more of 1,2-propanediol and 1,3-propanediol is contained in the dihydric alcohol component, the effects of the present invention can be exerted. It is more preferable to contain 80 mol % or more and still more preferable to contain 90 mol % or more of the diols.

The alcohol component of the polyester resin (B) may contain alcohol other than 1,2-propanediol and 1,3-propanediol as long as the objects and effects of the present invention can be attained. Examples of the dihydric alcohol component other than 1,2-propanediol and 1,3-propanediol include aliphatic dialcohols such as ethylene glycols having different numbers of carbon atoms, hydrogenated bisphenol A, and alkylene (having two to four carbon atoms) oxide (average number of moles for addition is from 1 to 16) adducts thereof. Moreover, the alcohol component may contain aromatic alcohol including alkylene oxide adducts of bisphenol A such as polyoxypropylene (2,2)-2,2-bis(4-hydroxyphenyl)propane and polyoxyethylene (2,2)-2,2-bis(4-hydroxyphenyl)propane. However, the alcohol component of the polyester resin (B) is preferably composed substantially of only aliphatic alcohol.

The carboxylic acid component of the polyester resin (B) is not particularly limited and can be appropriately selected according to the purpose.

The molecular weight of the polyester resin (B) is higher than that of the polyester resin (A) since the polyester resin (B) has a high softening point. Molecular chains of a resin with high molecular weigh are easily cut off when the resin is fused and kneaded in a toner production process. The molecular chains are likely to be cut off especially when a main chain skeleton has a rosin skeleton. Thus, the molecular chains are less likely to be cut off by introducing the rosin skeleton into an end of the molecular chains when the rosin skeleton is introduced into the polyester resin (B). Therefore, the molecular chains are less likely to be cut off when the carboxylic acid component of the polyester resin (B) contains a purified rosin so that the rosin is easily introduced into an end of the molecular chains of the resin. In addition, the carboxylic acid component of the polyester resin (B) may contain a purified rosin as well as a modified rosin such as a (meth) acrylic acid-modified rosin as long as it does not promote the molecular chains to be cut off or exert adverse effects on fixing property or the like.

An acid value of the purified rosin used for the polyester resin (B) is preferably from 100 mg KOH/g to 200 mg KOH/g, more preferably from 130 mg KOH/g to 180 mg KOH/g, and still more preferably from 150 mg KOH/g to 170 mg KOH/g.

The amount of purified rosin used for the polyester rosin (B) is preferably from 2 mol % to 50 mol %, more preferably from 5 mol % to 40 mol %, and still more preferably from 10 mol % to 30 mol % in the carboxylic acid component.

Besides the purified rosin and the modified rosin, the carboxylic acid component preferably contains an aliphatic dicarboxylic acid compound having 2 to 4 carbon atoms. Examples of the aliphatic dicarboxylic acid compound having 2 to 4 carbon atoms include adipic acid, maleic acid, malic acid, succinic acid, fumaric acid, citraconic acid, itaconic acid, and anhydrides of these acids. Among these, an aliphatic dicarboxylic acid compound is preferably at least one selected from succinic acid, fumaric acid, citraconic acid, and itaconic acid to improve the low-temperature fixing property. Itaconic acid is particularly preferable.

The amount of aliphatic dicarboxylic acid compound having 2 to 4 carbon atoms in the carboxylic acid component is preferably from 0.5 mol % to 20 mol % and more preferably from 1 mol % to 10 mol % to improve low-temperature fixing property and prevent reduction in glass transition temperature. The polyester resin is obtained by polycondensation of the aliphatic carboxylic acid compound without an aromatic ring and 1,2-propanediol and/or 1,3-propanediol. Thus, the resin has better compatibility with a releasing agent. Therefore, it is possible to further improve anti-filming property with the releasing agent.

The carboxylic acid component of the polyester resin (B) may contain a carboxylic acid compound other than the aliphatic carboxylic acid compound and rosin as long as the effects of the present invention can be exerted. The carboxylic acid component preferably contains an aromatic dicarboxylic acid such as phthalic acid, isophthalic acid, or terephthalic acid to ensure glass transition temperature. The amount of aromatic dicarboxylic acid in the carboxylic acid component is preferably from 40 mol % to 95 mol %, more preferably from 50 mol % to 90 mol %, and still more preferably from 60 mol % to 80 mol %.

The polyester resin (B) is preferably a cross-linked polyester resin. At least one of the alcohol component and the carboxylic acid component contains a trivalent or more source monomer as a cross-hnker. The amount of the trivalent or more source monomer is preferably from 0 mol % to 40 mol % and more preferably from 5 mol % to 30 mol % in the total amount of alcohol component and carboxylic acid component.

For the trivalent or more source monomer, trimellitic and derivative thereof are preferable as a trivalent or more polyhydric carboxylic acid compound, for example. Examples of the trivalent or more polyhydric alcohol include glycerin, pentaerythritol, trimethylolpropane, sorbitol, and alkylene (having two to four carbon atoms) oxide (average number of moles for addition is from 1 to 16) adducts thereof. Among these, glycerin is particularly preferable since glycerin acts as a cross-linker and is effective in improving low-temperature fixing property. Thus, the alcohol component of at least one of the polyester resins (A) and (B) preferably contains glycerin. The amount of glycerin in the alcohol component is preferably 5 mol % to 40 mol % and more preferably from 10 mol % to 35 mol %.

—Esterifying Catalyst—

Polycondensation of the alcohol component and the carboxylic acid component is preferably performed under presence of an esterifying catalyst. Examples of the esterifying catalyst include titanium compounds, and Sn—C bond-free tin (II) compounds, and Lewis acids such as p-toluenesulfonic acid. These esterifying catalysts may be used alone or in combination. Among these, titanium compounds and Sn—C bond-free tin (II) compounds are particularly preferable.

The titanium compound preferably a titanium compound having a Ti—O bond and more preferably a compound having an alkoxy group, an alkenyloxy group, or an acyloxy group with 1 to 28 carbon atoms in total.

Examples of the titanium compound include titanium diisopropylate bistriethanolaminate [$Ti(C_6H_{14}O_3N)_2(C_3H_7O)_2$], titanium diisopropylate bisdiethanolaminate [$Ti(C4H_{10}O_2N)_2(C_3H_7O)_2$], titanium dipentylate bistriethanolaminate [$Ti(C_6H_{14}O_3N)_2(C_5H_{11}O)_2$], titanium diethylate bistriethanolaminate [$Ti(C_6H_{14}O_3N)_2(C_2H_5O)_2$], titanium dihydroxyoctylate bistriethanolaminate [$Ti(C_6H_{14}O_3N)_2(OHC_8H_{16}O)_2$], titanium distearate bistriethanolaminate [$Ti(C_6H_{14}O_3N)_2(C_{18}H_{37}O)_2$], titanium triisopropylate triethanolaminate [$Ti(C_6H_{14}O_3N)_1(C_3H_7O)_3$], and titanium monopropylate tris(triethanolaminate) [$Ti(C_6H_{14}O_3N)_3(C_3H_7O)_1$]. Among these, titanium diisopropylate bistriethanolaminate, titanium diisopropylate bisdiethanolaminate, and titanium dipentylate bistriethanolaminate are particularly preferable and commercially available from Matsumoto Trading Co., Ltd.

Specific examples of other preferable titanium compounds include tetra-n-butyl titanate [$Ti(C_4H_9O)_4$], tetrapropyl titanate [$Ti(C_3H_7O)_4$], tetrastearyl titanate [$Ti(C_{18}H_{37}TO)_4$], tetramyristyl titanate [$Ti(C_{14}H_{29}O)_4$], tetraoctyl titanate [$Ti(C_8H_{17}O)_4$], dioctyldihydroxyoctyl titanate [$Ti(C_8H_{17}O)_2(OHC_8H_{16}O)_2$], and dimyristyldioctyl titanate [$Ti(C_{14}H_{29}O)_2(C_8H_{17}O)_2$]. Among these, tetrastearyl titanate, tetramyristyl titanate, tetraoctyl titanate, and dioctyldihydroxyoctyl titanate are preferable. These compounds can be obtained by reacting titanium halide with a corresponding alcohol and are commercially available from Nisso Co., Ltd and the like.

The amount of titanium compound is preferably from 0.01 parts by mass to 1.0 part by mass and more preferably from 0.1 parts by mass to 0.7 parts by mass per 100 parts by mass of the total amount of the alcohol component and the carboxylic acid component.

The tin (II) compound without an Sn—C bond is preferably a tin (II) compound with an Sn—O bond, a tin (II) compound with an Sn—X (X represents a halogen atom) bond, or the like. A tin (II) compound with an Sn—O bond is more preferable.

Examples of the tin (II) compound with an Sn—O bond include tin (II) carboxylate having a carboxylic acid group with 2 to 28 carbon atoms, such as tin (II) oxalate, tin (II) diacetate, tin (II) dioctanoate, tin (II) dilaurate, tin (II) distearate, and tin (II) dioleate; dialkoxy tin (II) having an alkoxy group with 2 to 28 carbon atoms, such as dioctyloxy tin (II), dilauroxy tin (II), distearoxy tin (II), and dioleyloxy tin (II); tin (II) oxide; and tin (II) sulfate.

Examples of the compound with an Sn—X (X represents a halogen atom) bond include tin (II) halide such as tin (II) chloride and tin (II) bromide. For fast charging and catalytic effects, preferable compounds are tin (II) fatty acid represented by $(R^1COO)_2Sn$ ($R^1$ represents an alkyl or alkenyl group having 5 to 19 carbon atoms), dialkoxy tin (II) represented by $(R^2O)_2Sn$ ($R^2$ represents an alkyl or alkenyl group having 6 to 20 carbon atoms), and tin (II) oxide represented by SnO. Tin (II) fatty acid and tin (II) oxide represented by $(R^1COO)_2Sn$ are more preferable, and tin (II) dioctanoate, tin (II) distearate, and tin (II) oxide are still more preferable.

The amount of tin (II) compound without an Sn—C bond is preferably from 0.01 parts by mass to 1.0 part by mass and more preferably from 0.1 parts by mass to 0.7 parts by mass per 100 parts by mass of the total amount of the alcohol component and the carboxylic acid component.

When the titanium compound is used in combination with the tin (II) compound without an Sn—C bond, the total amount of the titanium compound and the tin (II) compound is preferably from 0.01 parts by mass to 1.0 part by mass and more preferably from 0.1 parts by mass to 0.7 parts by mass per 100 parts by mass of the total amount of the alcohol component and the carboxylic acid component.

Polycondensation of the alcohol component and the carboxylic acid component can be performed, for example, under presence of the esterifying catalyst in an inert gas atmosphere at a temperature of 180° C. to 250° C.

The binder resin of the toner used in the present invention contains both the polyester resins (A) and (B) described above. A synergy of these resins optimally exerts effects of the present invention.

In the present invention, the binder resin may contain other resins besides the polyester resins (A) and (B). When the binder resin is composed of three or more types of polyester resins, two optional types of resins, which have the total amount of 50% by mass or more in the binder resin, need to satisfy the softening points of the polyester resins (A) and (B). Therefore, the binder resin may be used in combination with a known binder resin including a polyester resin other than the polyester resins (A) and (B) or other resins. Examples of other resins include a vinyl resin such as styrene-acrylic resin, epoxy resin, and a composite resin (may be referred to as a hybrid resin) having two or more types of resin units such as polycarbonate, polyurethane, and a polyester unit. The total amount of polyester resins (A) and (B) in the binder resin is preferably 70% by mass or more, more preferably from 80% by mass to 95% by mass, and still more preferably from 85% by mass to 90% by mass.

The binder resin of the toner in the present invention is preferably used in combination with a hybrid resin among the above compounds as other resins besides the polyester resins (A) and (B).

By using the hybrid resin in combination with the polyester resins (A) and (B) in the present invention, the toner has excellent fixing property and releasability and maintains good mechanical strength. The polyester resins (A) and (B) in the present invention have excellent low-temperature fixing property, anti-offset property, and thermal resistance and storage stability. However, since these resins are substantially composed of only aliphatic alcohol, the resins have inferior mechanical strength. Moreover, although a releasing agent can be uniformly and finely dispersed, the releasing agent is extremely compatible. Accordingly, the releasing agent is difficult to be phase-separated on the surface layer of the toner upon fixing, and fixing property and releasability become unfavorable. The hybrid resin in the present invention appropriately suppresses the compatibility of the polyester resins (A) and (B) with the releasing agent so that the toner has excellent fixing property and releasability. Furthermore, the hybrid resin can give mechanical strength to the toner without degrading low-temperature fixing property and thermal resistance and storage stability.

The hybrid resin preferably has a resin unit obtained by addition polymerization of a polyester unit and a vinyl resin, or the like.

Examples of the source monomer of the polyester unit include polyhydric alcohol and polyhydric carboxylic acid which form the polyester unit.

Examples of the dihydric alcohol component include 1,2-propanediol, 1,3-propanediol, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and a diol obtained by polymerizing bisphenol A with a cyclic ether such as ethylene oxide and propylene oxide.

Examples of the trivalent or more polyhydric alcohol include sorbitol, 1,2,3,6-hexane tetrol, 1,4-sorbitan, pentaerythritol, dipentaerythritol, tripentaerythritol, 1,2,4-butane triol, 1,2,5-pentatriol, glycerol, 2-methylpropane triol, 2-methyl-1,2,4-butane triol, trimethylol ethane, trimethylol propane, and 1,3,5-trihydroxybenzene.

Among these, the alcohol component having a bisphenol A skeleton (e.g., hydrogenated bisphenol A or a diol obtained by polymerizing bisphenol A with a cyclic ether such as ethylene oxide and propylene oxide) can be favorably used to give thermal resistance and storage stability and mechanical strength to the resins.

Examples of the carboxylic acid component include benzenedicarboxylic acids such as phthalic acid, isophthalic acid, and terephthalic acid and anhydrides thereof; alkyldicarboxylic acids such as succinic acid, adipic acid, sebacic acid, and azelaic acid and anhydrides thereof, unsaturated dibasic acids such as maleic acid, citraconic acid, itaconic acid, alkenyl succinic acid, fumaric acid, and mesaconic acid; and unsaturated dibasic acid anhydrides such as maleic acid anhydride, citraconic acid anhydride, itaconic acid anhydride, and alkenyl succinic acid anhydride. Examples of the trivalent or more polyhydric carboxylic acid component include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxy)methane, 1,2,7,8-octanetetracarboxylic acid, enpol trimer acid, and anhydrides and partial lower alkyl esters thereof.

Among these, aromatic polyhydric carboxylic acid compounds such as phthalic acid, isophthalic acid, terephthalic acid, and trimellitic acid are suitably used for thermal resistance and storage stability and mechanical strength of the resins.

Examples of the source monomer of the vinyl resin unit include styrene compounds such as styrene and α-methylstyrene; ethylenically unsaturated monoolefins such as ethylene and propylene; diolefines such as butadiene; halovinyls such as vinyl chloride; vinylesters such as vinyl acetate and vinyl propionate; esters of ethylenical monocarboxylic acids, such as alkyl (having 1 to 18 carbon atoms) ester of (meth)acrylic acid and dimethylaminoethyl (meth)acrylate; vinylethers such as vinyl methyl ether; vinylidene halides such as vinylidene chloride; and N-vinyl compounds such as N-vinyl pyrrolidone. Among these, styrene, 2-ethylhexyl acrylate, butyl acrylate, and a long chain alkyl (having 12 to 18 carbon atoms) ester of acrylic acid are preferable. Styrene is preferable for charging property, and an alkyl ester of (meth)acrylic acid is preferable for fixing property and control of a glass transition temperature. The amount of styrene in the source monomer of the vinyl resin is preferably from 50% by mass to 90% by mass and more preferably from 75% by mass to 85% by mass. A monomer mass ratio of styrene to an alkyl ester of (meth)acrylic acid (styrene/alkyl ester of (meth)acrylic acid) is preferably from 50/50 to 95/5 and more preferably from 70/30 to 95/5.

A polymerization initiator, a cross-linker, or the like may be used for addition polymerization of the source monomer of the vinyl resin unit.

It is preferable that a continuous phase be a polyester unit and a discontinuous phase be an addition polymerization resin unit in the present invention. Thus, a mass ratio of the source monomer of the polyester unit to the source monomer of the addition polymerization resin unit (the source monomer of the polyester unit/the source monomer of the addition polymerization resin unit) is preferably from 50/50 to 95/5 and more preferably from 60/40 to 95/5.

In the present invention, the hybrid resin is preferably obtained by using a compound (bireactive monomer) capable of reacting with both the source monomer of the polyester unit and the source monomer of the addition polymerization resin unit, in addition to the source monomer of the polyester unit and the source monomer of the addition polymerization resin unit.

The bireactive monomer is preferably a compound having at least one functional group selected from the group consisting of hydroxyl group, carboxyl group, epoxy group, primary amino group, and secondary amino group, and an ethylenically unsaturated bond in the molecule. Dispersibility of the resin serving as the discontinuous phase can be further improved by using such a bireactive monomer. Specific examples of the bireactive monomer include acrylic acid, fumaric acid, methacrylic acid, citraconic acid, maleic acid, 2-hydroxyethyl (meth)acrylate, glycidyl (meth)acrylate, and anhydrides and derivatives such as alkyl (having 1 to 2 carbon atoms) ester of these carboxylic acids. Among these, acrylic acid, methacrylic acid, fumaric acid, maleic acid, and derivatives of these carboxylic acids are preferable for reactivity, In the present invention, among the above bireactive monomers, a monomer having two or more functional groups (e.g., polycarboxylic acid) or a derivative thereof is handled as the source monomer of the polyester unit, and a monomer having one functional group (e.g., monocarboxylic acid) or a derivative thereof is handled as the source monomer of the addition polymerizaton resin unit. The amount of bireactive monomer is preferably from 1 mol to 30 mol per 100 mol of the source monomer of the polyester unit excluding the bireactive monomer. To further improve dispersibility of the addition polymerization resin unit, the amount of bireactive monomer is preferably from 1.5 mol to 20 mol and more preferably from 2 mol to 10 mol when the reaction is performed at high temperature after addition polymerization in a method for producing binder resin. The amount of bireactive monomer is preferably from 4 mol to 15 mol and more preferably from 4 mol to 10 mol when a relatively large amount of bireactive monomer is used after addition polymerization while constant reaction temperature is maintained.

In the present invention, the hybrid resin is preferably obtained by mixing a source monomer of a polyester unit with a source monomer of an addition polymerization resin unit in advance and simultaneously performing polycondensation and addition polymerization reaction in the same reaction vessel for uniformity of the polyester unit and the addition polymerization resin unit. When the composite resin is a hybrid resin obtained by further using a bireactive monomer, the composite resin is preferably obtained by mixing the bireactive monomer with a mixture of a source monomer of a polyester unit and a source monomer of an addition polymerization resin unit in advance and simultaneously performing polycondensation and addition polymerization in the same reaction vessel.

In the present invention, it is not necessary that proceeding and completion of polycondensation and addition polymerization are simultaneously performed. The reactions may proceed and be completed by appropriately selecting reaction temperature and time depending on each reaction mechanism. For example, a source monomer of a polyester unit, a source monomer of an addition polymerization resin unit, and a bireactive monomer are mixed. Subsequently, addition polymerization is performed at a suitable temperature (e.g., 50° C. to 180° C.) to form an addition polymerization resin having a functional group which can be subjected to polycondensation. The reaction temperature is then increased to a suitable temperature for polycondensation (e.g., 190° C. to 270° C.), and a polycondensation resin is formed mainly by polycondensation.

To achieve low-temperature fixing property, anti-hot offset property, thermal resistance and storage stability as well as optimally disperse a releasing agent, a mass ratio of the hybrid resin to the polyester resins (A) and (B) (mass of hybrid resin/total mass of polyester resins (A) and (B)) is preferably from 3/97 to 20/80, more preferably from 5/95 to 15/85, and still more preferably from 8/92 to 13/87.

A softening point TM of the hybrid resin is preferably from 90° C. to 130° C. and more preferably from 100° C. to 120° C. When the softening point is less than 90° C., thermal resistance and storage stability and anti-offset property are degraded. When the softening point exceeds 130° C., low-temperature fixing property is degraded. Meanwhile, a glass transition temperature of the hybrid resin is preferably from 45° C. to 80° C., more preferably from 50° C. to 70° C. and still more preferably from 53° C. to 65° C. for fixing property, storage stability, and durability. An acid value of the hybrid resin is preferably from 5 mg KOH/g to 80 mg KOH/g and more preferably from 15 mg KOH/g to 40 mg KOH/g for charging property and environmental stability.

—Colorant—

The colorant is not particularly limited and can be appropriately selected from known dyes and pigments according to the purpose. Examples of the colorant include carbon black, Nigrosine dyes, iron black, NAPHTHOL YELLOW S, HANSA YELLOW(10G, 5G and G), Cadmium yellow, yellow iron oxide, ocher, chrome yellow, Titan Yellow, polyazo yellow, Oil Yellow, HANSA YELLOW (GR, A, RN and R), Pigment Yellow L, BENZIDINE YELLOW (G and GR), PERMANET YELLOW (NCG), VULCAN FAST YELLOW (5G and R), Tartrazine Lake, Quinoline Yellow Lake, ANTHRAZANE YELLOW BGL, isoindolinone yellow, colcothar, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL, and F4RH), Fast Scarlet VD, VULCAN FAST RUBIN B, Brilliant Scarlet G, LITHOL RUBIN GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone. These colorants can be used alone or in combination.

The color of the colorant is not particularly limited and can be appropriately selected according to the purpose. For example, the colorant may be for black or for color. These colorants may be used alone or in combination.

Examples of the colorant for black include carbon blacks (C.I. Pigment Black 7) such as furnace black, lamp black, acetylene black, and channel black; metals such as copper, iron (C.I. Pigment Black 11), and titanium oxide; and organic pigments such as aniline black (C.I. Pigment Black 1).

Examples of the coloring pigment for magenta include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; and C.I. Violet 1, 2, 10, 13, 15, 23, 29, and 35.

Examples of the coloring pigment for cyan include C.I. Pigment Blue 2, 3, 15, 15:1, 15:2, 15:3, 15:4, 15:6, 16, 17, 60; C.I. Bat Blue 6; C.I. Acid Blue 45, copper phthalocyanine pigment in which a phthalocyanine skeleton is substituted with 1 to 5 phthalimidemethyl groups, Green 7, and Green 36.

Examples of the coloring pigment for yellow include C.I. Pigment Yellow 0-16, 1 2, 3, 4, 5, 6, 7, 10, 11, 12, 13, 14, 15, 16, 17, 23, 55, 65, 73, 74, 83, 97, 110, 151, 154, 180; C.I. Bat Yellow 1, 3, 20, and Orange 36.

The amount of colorant in the toner is not particularly limited and can be appropriately selected according to the purpose. The amount is preferably from 1% by mass to 15% by mass and more preferably from 3% by mass to 10% by mass. When the amount is less than 1% by mass, a tinting strength of the toner is reduced. On the other hand, when the amount exceeds 15% by mass, the pigment is poorly dispersed in the toner. This may reduce the tinting strength and electrical properties of the toner.

The colorant may be used as a masterbatch which is combined with a resin. The resin is not particularly limited and can be appropriately selected from known resins according to the purpose. Examples of the resin include styrene or a polymer of a substituted styrene, styrene copolymer, polymethyl methacrylate resin, polybutyl methacrylate resin, polyvinyl chloride resin, polyvinyl acetate resin, polyethylene resin, polypropylene resin, polyester resin, epoxy resin, epoxy-polyol resin, polyurethane resin, polyamide resin, polyvinyl butyral resin, polyacrylic acid resin, rosin, modified rosin, terpene resin, aliphatic hydrocarbon resin, alicyclic hydrocarbon resin, aromatic petroleum resin, chlorinated paraffin, and paraffin. These resins may be used alone or in combination.

Examples of the styrene or the polymer of the substituted styrene include polyester resin, polystyrene resin, poly p-chlorostyrene resin, and polyvinyltoluene resin. Examples of the styrene copolymer include styrene-p-chlorostyrene copolymer, styrene-propylene copolymer, styrene-vinyltoluene copolymer, styrene-vinyl naphthaline copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate ester copolymer.

The masterbatch can be manufactured by mixing and kneading a resin for a masterbatch and the colorant while applying a high shear force. In this case, an organic solvent is preferably added to enhance an interaction between the colorant and the resin. In addition, a flushing method is preferable because a wet cake of a colorant can be used as it is without being dried. In the flushing method, an aqueous paste containing colorant water is mixed or kneaded with a resin and an organic solvent, and the colorant is moved to the resin to remove water and the organic solvent. A high shear dispersing device such as three roll mill is suitably used for the mixing and kneading.

—Releasing Agent—

The releasing agent is not particularly limited and can be appropriately selected from known releasing agents according to the purpose. Examples of the releasing agent include waxes such as carbonyl group-containing wax, polyolefin wax, and long chain hydrocarbon. These releasing agents may be used alone or in combination. Among these releasing agents, carbonyl group-containing wax is more preferable.

Examples of the carbonyl group-containing wax include polyalkanate ester, polyalkanol ester, polyalkanoic acid amide, polyalkylamide, and dialkylketone. Examples of the polyalkanoate ester include carnauba wax, montan wax, trimethylolpropane tribehenate, pentaerythritol tetrabehenate, pentaerythritol diacetate dibehenate, glycerin tribehenate, and 1,18-octadecanediol distearate. Examples of the polyalkanol ester include tristearyl trimellitate and distearyl maleate. Examples of the polyalkanoic acid amide include dibehenylamide. Examples of the polyalkylamide include trimellitic acid tristearylamide. Examples of the dialkylketone include distearylketone. Among these carbonyl group-containing waxes, a polyalkanate ester is particularly preferable.

Examples of the polyolefin wax include polyethylene wax and polypropylene wax.

Examples of the long chain hydrocarbon include paraffin wax and sazol wax.

The melting point of the releasing agent is not particularly limited and can be appropriately selected according to the purpose and is preferably from 40° C. to 160° C., more preferably from 50° C. to 120° C., and still more preferably from 60° C. to 90° C. When the melting point is lower than 40° C., thermal resistance and storage stability may be degraded. When the melting point exceeds 160° C., cold offset may occur upon low-temperature fixing.

The maximum peak of heat of fusion can be obtained as the meting point of the releasing agent by using a differential scanning calorimeter (DSC210 manufactured by Seiko Electronic Industry Co., Ltd). For example, the temperature of a sample is increased to 200° C., cooled down to 0° C. at a rate of 10° C./min, and increased at a rate of 10° C./min.

The melt viscosity of the releasing agent is preferably from 5 cps to 1,000 cps and more preferably from 10 cps to 100 cps when measured at a temperature 20° C. higher than a melting point of the wax. When the melt viscosity is less than 5 cps, releasability may be degraded. When the melt viscosity exceeds 1,000 cps, anti-hot offset property and low-temperature fixing property may not be improved.

The amount of releasing agent in the toner is not particularly limited and can be appropriately selected according to the purpose. The amount is preferably from 0% by mass to 40% by mass and more preferably from 3% by mass to 30% by mass.

When the amount exceeds 40% by mass, fluidity of the toner may be degraded.

—Charge Control Agent—

The charge control agent is not particularly limited and can be appropriately selected from known charge control agents according to the purpose. When a colored material is used, a color tone may vary. Thus, a colorless or nearly white material is preferable, and examples thereof include triphenylmethane dye, chelate molybdate pigment, rhodamine dye, alkoxy amine, quaternary ammonium salt (including fluorine modified quaternary ammonium salt), alkylamide, a single substance of phosphorus or a compound thereof, a single substance of tungsten or a compound thereof, fluorine activator, a metal salt of salicylic acid, and a metal salt of a salicylic acid derivative. These charge control agents may be used alone or in combination.

The charge control agent may be commercially available. Examples of the commercially available charge control agent includes quaternary ammonium salt Bontron P-51, oxynaphthoic acid metal complex E-82, salicylic acid metal complex E-84, and phenol condensate E-89 (all of which are manufactured by Orient Chemical Industries, Ltd.); quaternary ammonium salt molybdenum complex TP-302 and TP-415 (manufactured by Hodogaya Chemical Industries Co., Ltd.), quaternary ammonium salt Copy Charge PSY VP2038, triphenylmethane derivative Copy Blue PR, quaternary ammonium salt Copy Charge NEG VP2036, and Copy Charge NX VP434 (all of which are manufactured by Hoechst, Co.); LRA-901 and boron complex LR-147 (manufactured by Japan Carlit Co., Ltd.); quinacridone and azo pigment; and polymer compounds having a functional group such as sulfonic acid group, carboxyl group, or quaternary ammonium salt.

The charge control agent may be dissolved or dispersed after melt-kneaded with the masterbatch. Moreover, the charge control agent as well as each component of the toner may be directly dissolved or dispersed in the organic solvent. Furthermore, the charge control agent may be fixed on the surface of the toner after toner particles are manufactured.

The amount of the charge control agent in the toner varies depending on the type of the binder resin, presence or absence of the additive, dispersion method, and the like. Thus, the amount and is not unconditionally defined. For example, the amount is preferably from 0.1 parts by mass to 10 parts by mass and more preferably from 0.2 parts by mass to 5 parts by mass per 100 parts by mass of the binder resin. When the amount is less than 0.1 parts by mass, charge controllability may not be obtained. On the other hand, when the amount exceeds 10 parts by mass, charging property of the toner becomes extremely high. This reduces the effects of the charge control agent and increases electrostatic attraction with the developing roller, thereby decreasing fluidity of the developer and image density.

—External Additive—

The external additive is not particularly limited and can be appropriately selected from known external additives according to the purpose. Examples of fine silica particles include fine hydrophobized silica particles, fatty acid metal salt (e.g., zinc stearate and aluminum stearate); metal oxide (e.g., titania, alumina, tin oxide, and antimony oxide) or a hydrophobized substance thereof, and fluoropolymer. Among these, fine hydrophobized silica particles, titania particles, and fine hydrophobized titania particles are preferable.

Examples of the fine silica particles include HDK H 2000, HDK H 2000/4, HDK H 2050EP, HVK21, and HDK H1303 (all of which are manufactured by Hoechst Co.); and R972, R974, RX200, RY200, R202, R805, and R812 (all of which are manufactured by Nippon Aerosil Co., Ltd.). Examples of the fine titania particles include P-25 (manufactured by Nippon Aerosil Co., Ltd.); STT-30 and STT-65C-S (all of which are manufactured by Titan Kogyo Kabushiki Kaisha); TAF-140 (manufactured by Fuji Titanium Industry Co., Ltd.); and MT-150W, MT-500B, MT-600B, and MT-150A (all of which are manufactured by Tayca Corporation). Examples of the fine hydrophobized titanium oxide particles include T-805 (manufactured by Nippon Aerosil Co., Ltd.); STT-30A and STT-65S-S (all of which are manufactured by Titan Kogyo Kabushiki Kaisha); TAF-500T and TAF-1500T (all of which are manufactured by Fuji Titanium Industry Co., Ltd.); MT-100S and MT-100T (all of which are manufactured by Tayca Corporation); and IT-S (manufactured by Ishihara Sangyo Kaisha, Ltd.).

The fine hydrophobized silica particles, fine hydrophobized titania particles, and fine hydrophobized alumina particles can be obtained by treating fine hydrophilic particles with a silane coupling agent such as methyltrimethoxysilane, methyltriethoxy silane, or octyltrimethoxy silane.

Examples of the hydrophobizing agent include a silane coupling agent such as dialkyl-dihalogenated silane, trialkyl-halogenated silane, alkyl-trihalogenated silane, or hexaalkyldisilazane, a silylating agent, a silane coupling agent having a fluorinated alkyl group, an organic titanate coupling agent, an aluminum coupling agent, silicone oil, and silicone varnish.

Moreover, fine inorganic particles treated with silicone oil are preferable. These particles are obtained by treating the fine inorganic particles with silicone oil optionally under heat.

Examples of the fine inorganic particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, and silicon nitride. Among these, silica and titanium dioxide are particularly preferable.

Examples of the silicone oil include dimethyl silicone oil, methylphenyl silicone oil, chlorophenyl silicone oil, methylhydrogen, silicone oil, alkyl modified silicone oil, fluorine modified silicone oil, polyether modified silicone oil, alcohol modified silicone oil, amino modified silicone oil, epoxy modified silicone oil, epoxy-polyether modified silicone oil, phenol modified silicone oil, carboxyl modified silicone oil, mercapto modified silicone oil, acryl or methacryl modified silicone oil, and Δ-methylstyrene modified silicone oil.

The average particle size of primary particles of the fine inorganic particles is preferably from 1 nm to 100 nm and more preferably from 3 nm to 70 nm. When the average particle size is less than 1 nm, the fine inorganic particles are embedded in the toner and the function may not be effectively exerted. On the other hand, when the average particle size exceeds 100 nm, the surface of the latent electrostatic image bearing member may be unevenly scratched. Fine inorganic particles and fine hydrophobized inorganic particles can be used in combination as the external additive. The average particle size of the hydrophobized primary particles is preferably from 1 nm to 100 nm and more preferably from 5 nm to 70 nm. It is preferable to contain at least two types of fine inorganic particles in which the average particle size of the hydrophobized primary particles is 20 nm or less. It is more preferable to contain at least one type of fine inorganic particles having the average particle size of 30 nm or more. The specific surface of the fine inorganic particles, which is measured by a BET method, is preferably from 20 $m^2/g$ to 500 $m^2/g$.

The amount of external additive in the toner is preferably from 0.1% by mass to 5% by mass and more preferably from 0.3% by mass to 3% by mass.

Fine resin particles can also be added as the external additive. Examples of the particles include polystyrene obtained by soap-free emulsion polymerization, suspension polymerization, or dispersion polymerization; a copolymer of methacrylate ester or acrylate ester; polycondensates such as silicone, benzoguanamine, or nylon; and polymer particles of thermosetting resin. By using the external additive with these fine resin particles, it is possible to enhance charging property of the toner and reduce the reversely charged toner and a background smear. The amount of fine resin particles in the toner is preferably from 0.01% by mass to 5% by mass and more preferably from 0.1% by mass to 2% by mass.

—Other Components—

Other components are not particularly limited and can be appropriately selected according to the purpose. Examples of other components include fluidity improver, a cleanability improver, a magnetic material, and a metal soap.

The fluidity improver enhances hydrophobicity by a surface treatment and can prevent degradation of fluidity and charging property even under high humidity. Examples of the fluidity improver include a silane coupling agent, a silylating agent, a silane coupling agent having a fluorinated alkyl group, an organic titanate coupling agent, an aluminum coupling agent, a silicone oil, and a modified silicone oil.

The cleanability improver is added to the toner to remove the residual toner on the latent electrostatic image bearing member or on the intermediate transfer member after transfer. Examples of the cleanability improver include fatty acid metal salts such as zinc stearate, calcium stearate, and stearic acid; and fine polymer particles produced by soap-free emulsion polymerization, such as fine polymethyl methacrylate particles and fine polystyrene particles. The fine polymer particles preferably have relatively narrow particle size distribution and favorably have a volume average particle size of 0.01 μm to 1 μm.

The magnetic material is not particularly limited and can be appropriately selected from known magnetic materials according to the purposes. Examples of the magnetic material include iron powder, magnetite and ferrite. Among these, a white magnetic material is preferable for color tone.

—Toner Production Method—

A method for producing the toner is not particularly limited and can be appropriately selected from conventional toner production methods according to the purpose. Examples of the method include kneading pulverization, polymerization, dissolution suspension, and spray granulation.

—Kneading and Pulverization—

In the kneading pulverization, toner materials containing at least a binder resin and a colorant are melt-kneaded. Subsequently, the kneaded mixture is pulverized and classified to manufacture toner base particles.

In the melt-kneading process, the toner materials are mixed, and the mixture is set in a melt-kneader to be melt-kneaded. Examples of the melt kneader include a single or twin screw continuous kneader or a batch kneader using a roll mill can be used as the melt-kneader. For example, a KTF twin screw extruder manufactured by Kobe Steel., Ltd., a TEM extruder manufactured by Toshiba Machine Co., Ltd., a twin screw extruder manufactured by KCK Co., a PCM twin screw extruder manufactured by Ikegai Tekkosho K.K., and a cokneader manufactured by Buss Co. are preferably used. This melt-kneading process is preferably performed under proper conditions to prevent breakage of the molecular chain of the binder resin. Specifically, the melt-kneading temperature is set with reference to the softening point of the binder resin. When the melt-kneading temperature is extremely higher than the softening point, severe breakage occurs. On the other hand, when the melt-kneading temperature is extremely lower than the softening point, dispersion may not proceed.

In the pulverization, the kneaded mixture obtained in the kneading process is pulverized. In this pulverization, it is preferred that the kneaded mixture be roughly pulverized and then finely pulverized. In this case, the particles are preferably pulverized by colliding the particles against an impact plate in a jet stream, by colliding the particles with each other in a jet stream, or by a narrow gap between a mechanically rotating rotor and a stator.

In the classification, the pulverized products obtained by the pulverization are classified to obtain particles having a predetermined particle size. The classification can be performed, for example, by removing fine particles using a cyclone, a decanter, or a centrifuge.

After the completion of pulverization and classification, the pulverized product is classified in an airflow by a centrifugal force. Thus, it is possible to manufacture toner base particles having a predetermined particle size.

Next, the external additive is externally added to the toner base particles. The external additive covers the surface of the toner base particles while being disentangled by mixing and stirring the toner base particles and the external additive. At this time, it is important, for durability, to adhere the external additive (e.g., fine inorganic particles or fine resin particles onto the toner base particles) uniformly and firmly.

—Polymerization—

In the toner production method employing polymerization, a toner material, which contains at least a urea or urethane bondable modified polyester resin and a colorant, is dissolved or dispersed in an organic solvent. The obtained solution or dispersoid is dispersed in an aqueous medium and subjected to the polyaddition. The solvent of the dispersion solution is removed and washed to obtain a toner.

The urea or urethane bondable modified polyester resin is, for example, a polyester prepolymer having an isocyanate group obtained by reacting a carboxyl group or a hydroxyl group at the end of polyester with a polyhydric isocyanate compound (PIC). A modified polyester resin is obtained by cross-linking and/or extension of the molecular chain through the reaction of the polyester prepolymer and amines and can improve anti-hot offset property while maintaining low-temperature fixing property.

Examples of the polyhydric isocyanate compound (PIC) include aliphatic polyhydric isocyanates (e.g., tetramethylene diisocyanate, hexamethylene diisocyanate, and 2,6-diisocyanatomethyl caproate); alicyclic polyisocyanates (e.g., isophorone diisocyanate and cyclohexylmethane diisocyanate); aromatic diisocyanates (e.g., tolylene diisocyanate and diphenylmethane diisocyanate); araliphatic diisocyanates (e.g., $\alpha,\alpha,\alpha',\alpha'$-tetramethylxylylene diisocyanate); isocyanates; and those obtained by blocking the polyisocyanate with a phenol derivative, oxime, or caprolactam. These polyhydric isocyanate compounds may be used alone or in combination.

A ratio of the polyhydric isocyanate compound (PIC) is preferably from 5/1 to 1/1, more preferably from 4/1 to 1.2/1, and still more preferably from 2.5/1 to 1.5/1 in an equivalent ratio [NCO]/[OH] of an isocyanate group [NCO] to a hydroxyl group [OH] of a polyester having a hydroxyl group.

The number of isocyanate groups contained per one molecule of the polyester prepolymer having the isocyanate group (A) is preferably 1 or more, more preferably from 1.5 to 3 on average, and still more preferably from 1.8 to 2.5 on average.

Examples of amines (B), which is reacted with the polyester prepolymer include a divalent amine compound (B1), a trivalent or more polyhydric amine compound (B2), an aminoalcohol (B3), aminomercaptan (B4), amino acid (B5), and a compound (B6) in which amino groups of B1 to B5 are blocked.

Examples of the divalent amine compound (B1) include aromatic diamines (e.g., phenylenediamine, diethyltoluene diamine, and 4,4'-diaminodiphenylmethane); alicyclic diamines (e.g., 4,4'-diamino-3,3'-dimethyldicyclohexylmethane, diamine cyclohexane, and isophoronediamine); and aliphatic diamines (e.g., ethylenediamine, tetramethylene diamine, and hexamethylenediamine).

Examples of the trivalent or more polyhydric amine compound (B2) include diethylenetriamine and triethylenetetramine.

Examples of the aminoalcohol (B3) include ethanolamine and hydroxyethylaniline.

Examples of the aminomercaptan (B4) include aminoethylmercaptan and aminopropylmercaptan.

Examples of the amino acid (B5) include aminopropionic acid and aminocaproic acid.

Examples of the compound (B6) in which amino groups of B1 to B5 are blocked include a ketimine compound and an oxazolidine compound, which are obtained from the amines B1 to B5 and ketones (e.g., acetone, methyl ethyl ketone, and methyl isobutyl ketone). Among these amines (B), B1 and a mixture of B1 and a small amount of B2 are particularly preferable.

A ratio of the amines (B) is preferably from 1/2 to 2/1, more preferably from 1.5/1 to 1/1.5, and still more preferably from 1.2/1 to 1/1.2 in an equivalent ratio [NCO]/[NHx] of an isocyanate group [NCO] in the polyester prepolymer (A) having an isocyanate group to an amino group [NHx] in the amines (B).

According to the toner production method employing the polymerization, it is possible to prepare small, round toner at low costs with less environmental loads.

Color of the toner is not particularly limited and can be appropriately selected according to the purpose. The toner may be at least one selected from black toner, cyan toner, magenta toner, and yellow toner. Each color of the toner can be obtained by appropriately selecting the colorant, and a color toner is preferable.

The weight average particle size of the toner is not particularly limited and can be appropriately selected according to the purpose. The weight average particle size of the toner can be determined in the following manner.

[Weight Average Particle Size of Toner]

Measuring Device: Coulter Multisizer II (manufactured by BECKMAN COULTER Co.)

Aperture Diameter: 100 μm

Analyzing Software: Coulter Multisizer Acucomp Version 1.19 (manufactured by BECKMAN COULTER Co.)

Electrolytic Solution: Isotone II (manufactured by BECKMAN COULTER Co.)

Dispersion Solution: 5 mass % electrolytic solution of EMULGEN 109P (manufactured by Kao Corporation, polyoxyethylene lauryl ether, HLB=13.6)

Dispersion Conditions: 10 mg of a sample is added to 5 ml of a dispersion solution and dispersed for one minute using an ultrasonic disperser. Thereafter, 25 ml of the electrolytic solution is added, and the solution is further dispersed for one minute using the ultrasonic disperser.

Measurement Conditions: 100 ml of an electrolytic solution and the dispersion solution are added in a beaker, and the size of 30,000 particles is measured at a density, at which the size of 30,000 particles can be measured in 20 seconds. From the particle size distribution, the weight average particle size is determined.

[Developer]

The developer includes at least the toner and other appropriately selected components such as carrier. The developer may be a one-component developer or a two-component developer. When the developer is used for a high-speed printer which is suitable for recent information processing speed, the developer is preferably a two-component developer to increase life.

When the developer is the one-component developer using the toner, there is less variation in toner particle size even after toner is reloaded, thereby preventing toner filming to a developing roller, a developer support member, and fusion to a layer thickness regulating member such as a blade for decreasing the thickness of the toner layer. Thus, it is possible to obtain favorable stable developability and images even after the developing unit is used (stirring) for a long period of time. When the developer is the two-component developer using the toner, there is less variation in toner particle size in the developer even after toner is reloaded for a long period of time. Thus, it is possible to obtain favorable, stable developability even after the developing unit stirs for a long period of time.

[Carrier]

The carrier is not particularly limited and can be appropriately selected according to the purpose. The carrier preferably has a core material and a resin layer which coats the core material.

The material of the core material is not particularly limited and can be appropriately selected from known materials. The material is preferably, for example, a manganese-strontium (Mn—Sr) material or manganese-magnesium (Mn—Mg) material of 50 emu/g to 90 emu/g. For image density, a highly magnetized material such as iron powder (100 emu/g or more) or magnetite (75 emu/g to 120 emu/g) is preferable. For high image quality, a weakly magnetized material such as copper-zinc (Cu—Zn) material (30 emu/g to 80 emu/g) is preferable because it is possible to decrease contact to a latent electrostatic image bearing member in which the toner is in a standing state. These materials may be used alone or in combination.

The particle size of the core material is preferably from 10 μm to 200 μm and more preferably from 40 μm to 100 μm in terms of an average particle size (volume average particle size ($D_{50}$)). When the average particle size (volume average particle size ($D_{50}$)) is less than 10 μm, the amount of fine powders increases in the distribution of carrier particles, and magnetization per one particle decreases. Thus, the carrier particles may scatter. On the other hand, when the average particle size exceeds 200 μm, the specific surface area decreases, and the toner may scatter. Reproduction of the solid portion may deteriorate in full-color printing including many solid portions.

The material of the resin layer is not particularly limited and can be appropriately selected from known resins according to the purpose. Examples of the material include amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, a copolymer of vinylidene fluoride and an acryl monomer, a copolymer of vinylidene fluoride and vinyl fluoride, a fluoroterpolymer (fluorinated triple (multi) copolymer) such as a terpolymer of tetrafluoroethylene, vinylidene fluoride, and a non-fluorinated monomer, and a silicone resin. These materials may be used alone or in combination. Among these materials, a silicone resin is particularly preferable.

The silicone resin is not particularly limited and can be appropriately selected from generally known silicone resins according to the purpose. Examples of the silicone resin include straight silicone resins having only organosoloxane bonds; and silicone resins modified with alkyd resins, polyester resins, epoxy resins, acrylic resins, or urethane resins.

The silicone resin is commercially available. Examples of the commercially available silicone resin include KR271, KR255, and KR152 manufactured by Shin-Etsu Chemical Co., Ltd.; and SR2400, SR2406, and SR2410 manufactured by Dow Corning Toray Silicone Co., Ltd.

The modified silicone resin is commercially available. Examples of the commercially available modified silicone resin include KR206 (modified with alkyd), KR5208 (modified with acryl), ES1001N (modified with epoxy), and KR305 (modified with urethane) manufactured by Shin-Etsu Chemical Co., Ltd.; and SR2115 (modified with epoxy) and SR2110 (modified with alkyd) manufactured by Dow Corning Foray Silicon Co., Ltd.

The silicone resin can also be used alone or can in combination with a cross-linkable component or a charge amount control component.

The resin layer may contain a conductive powder as necessary. Examples of the conductive powder include metal powder, carbon black, titanium oxide, tin oxide, and zinc oxide. The average particle size of the conductive powder is preferably 1 μm or less. When the average particle size exceeds 1 μm, it may be difficult to control the electrical resistance.

For example, the resin layer can be formed as follows: the silicone resin or the like is dissolved in a solvent to prepare a coating solution; the coating solution is uniformly applied on the surface of the core material using a known coating method; and the surface is dried and baked. Examples of the coating method include immersion, spray, and a brush coating method.

The solvent is not particularly limited and can be appropriately selected according to the purpose. Examples of the solvent include toluene, xylene, methyl ethyl ketone, methyl isobutyl ketone, cellosolve, and butyl acetate.

The baking method is not, particularly limited and may be a method using an external heating system or an internal heating system. Example of the baking method include a method using a fixed electric furnace, a flow electric furnace, a rotary electric furnace, or a burner furnace, and a method using microwave.

The amount of the resin layer in the carrier is preferably from 0.01% by mass to 5.0% by mass. When the amount is less than 0.01% by mass, a uniform resin layer may not be formed on the surface of the core material. On the other hand, when the amount exceeds 5.0% by mass, uniform carrier particles may not be obtained because the resin layer becomes extremely thick and carriers are combined.

When the developer is a two-component developer, the amount of carriers in the two-component developer is not particularly limited. The amount is preferably, for example, from 90% by mass to 98% by mass and more preferably from 93% by mass to 97% by mass.

A mixing ratio of the toner to the carrier in the two-component developer is preferably from 1 part by mass to 10.0 parts by mass of the toner to 100 parts by mass of the carrier in general.

The developing unit may be a unit using a dry developing system or a wet developing system. The developing unit may be a single-color developing unit or a multi-color developing unit and include, for example, a stirrer and a magnet roller. The stirrer charges the toner and the developer by frictional stirrer.

In the developing unit, for example, the toner and the carrier are stirred, and the toner is charged by friction and maintained on the surface of the rotating magnet roller in a standing state to form a magnetic brush. Since the magnet roller is disposed in the vicinity of the latent electrostatic image bearing member, a portion of the toner, which constitutes the magnetic brush formed on the surface of the magnet roller, moves to the surface of the latent electrostatic image bearing member by an electrical attraction. As a result, the latent electrostatic image is developed with the toner to form a visible image on the surface of the latent electrostatic image bearing member.

The developer contained in the developing unit contains the toner, and the developer may be a one-component developer or a two-component developer.

[One-Component Developing Unit]

The one-component developing unit preferably includes a developer bearing member and a layer thickness regulating member, for example. The toner is supplied to the developer bearing member. The layer thickness regulating member forms a thin layer of the toner on the surface of the developer bearing member.

Figure 5:
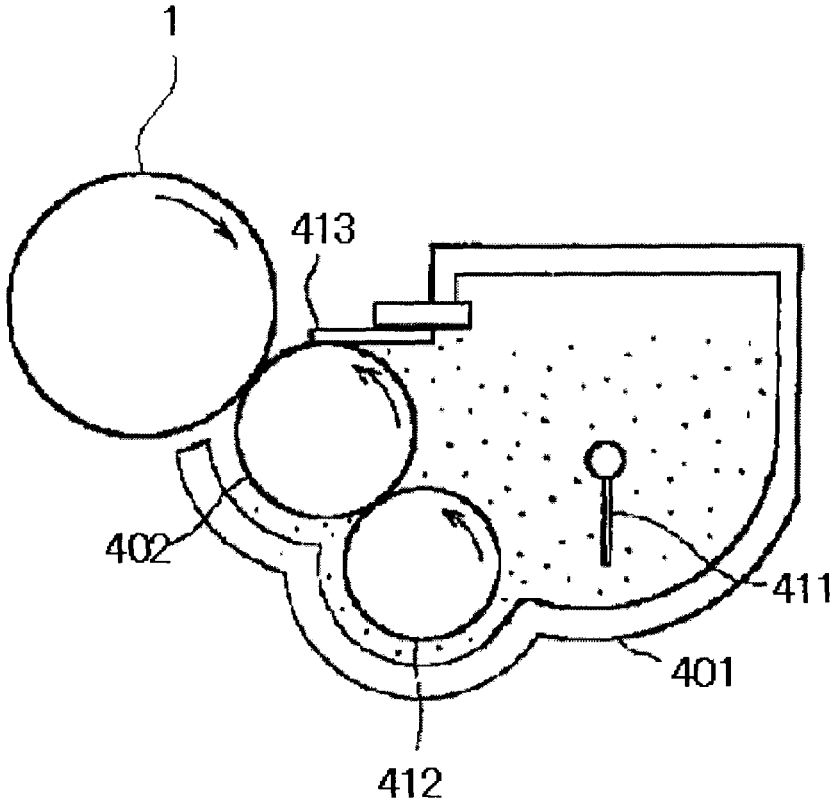
FIG. 5 is a schematic view showing an example of a one-component developing unit in an image forming apparatus of the present invention.

FIG. 5 is a schematic view showing an example of a one-component developing apparatus. The one-component developing apparatus performs contact one-component development and forms a latent electrostatic image on the photoconductor drum 1 as follows: a one-component developer composed of a toner is used to form a toner layer on a developing roller 402 serving as a developer bearing member; and the toner layer on the developing roller 402 is transported in contact with a photoconductor drum 1 serving as a latent electrostatic image bearing member.

In FIG. 5, the toner in a casing 401 is stirred by rotation of an agitator 411 serving as a stirring unit and is mechanically fed to a feeding roller 412 serving as a toner feeding member. The feeding roller 412 is formed of a polyurethane foam or the like and has pliability and a structure where the toner is easily retained in a cell with a diameter of 50 μm to 500 μm. Moreover, the feeding roller has relatively low JIS-A hardness of 10° to 30° and can uniformly contact the developing roller 402.

The feeding roller 412 and the developing roller 402 are rotatably driven in the same direction so that the surfaces of opposing portions of both rollers move in an opposite direction. A linear velocity ratio (feeding roller/developing roller) of both rollers is preferably from 0.5 to 1.5. Moreover, the feeding roller 412 and the developing roller 402 may be rotated in an opposite direction so that the surfaces of the opposing portions of both rollers are moved in the same direction. In this embodiment, the feeding roller 412 and the developing roller 402 were rotated in the same direction, and the linear velocity ratio was set to 0.9. An encroaching amount of the feeding roller 412 on the developing roller 402 is set within a range from 0.5 mm to 1.5 mm. In the present embodiment, when a unit effective width is 240 mm (A4 vertical size), a required torque is from 14.7 N/cm to 24.5 N/cm.

The developing roller 402 is constituted by a surface layer made of a rubber material on a conductive substrate and has a diameter of 10 mm to 30 mm. Surface roughness Rz is adjusted within a range from 1 μm to 4 μm by appropriately roughening the surface. The value of the surface roughness Rz is preferably from 13% to 80% of the average particle size of the toner. Consequently, the toner is transported without being embedded in the surface of the developing roller 402. The surface roughness Rz of the developing roller 402 is preferably from 20% to 30% of the average particle size of the toner so as not to retain an extremely low-charged toner.

Examples of the rubber material include a silicone rubber, a butadiene rubber, an NBR rubber, a hydrin rubber, and an EPDM rubber. The surface of the developing roller 402 is preferably coated with a coat layer so as to particularly stabilize quality with time. Examples of the material of the coat layer include a silicone material and a TEFLON material. The silicone material has excellent toner charging property, and the TEFLON material has excellent releasability. To obtain conductivity, a conductive material such as carbon black may be appropriately contained. The thickness of the coat layer is preferably from 5 μm to 50 μm. When the thickness is not within the above range, cracking or the like is likely to occur.

The toner with predetermined polarity (negative polarity in this embodiment) on or in the feeding roller 412 is retained on the developing roller 402 by interposing the toner between the developing rollers 402 and the feeding roller 412, which rotate in an opposite direction at a contact point, through the rotations, by an electrostatic force applied after negative charge is obtained by frictional electrification effect, and by the transportation effect through surface roughness of the developing roller 402. However, the toner layer on the developing roller 402 is not uniform and excessive toner adheres thereto (1 mg/cm$^2$ to 3 mg/cm$^2$). Thus, a thin toner layer with a uniform thickness is formed on the developing roller 402 by contacting a regulating blade 413 with the developing roller 402. The regulating blade 413 serves as the layer thickness regulating member. The tip of the regulating blade 413 faces the downstream side of the rotating direction of the developing roller 402 and contacts the center portion of the regulating blade 413. In other words, the tip is in a so-called "belly contact state." It is also possible to set in the opposite direction and realize edge contact.

The material of the regulating blade is preferably a metal such as SUS304, and the thickness is from 0.1 mm to 0.15 mm. Besides the metal, a rubber material such as polyurethane rubber having a thickness of 1 mm to 2 mm and a resin material having relatively high hardness such as silicone resin can be used. Because the resistance can be decreased by blending carbon black or the like besides the metal, an electric field can also be formed between the regulating blade 413 and the developing roller 402 by connecting a bias power supply.

The regulating blade 413, which serves as the layer thickness regulating member, a free end length from a holder is preferably from 10 mm to 15 mm. When the free end length exceeds 15 mm, the developing unit becomes larger and the image forming apparatus cannot accommodate the developing unit. On the other hand, when the free end length is less than 10 mm, vibration is likely to occur by contacting the regulating blade with the surface of the developing roller 402. Thus, an abnormal image such as stepwise unevenness on the image may be likely to occur in the lateral direction.

The contact pressure of the regulating blade 413 is preferably within a range from 0.049 N/cm to 2.45 N/cm. When the contact pressure exceeds 2.45 N/cm, the amount of the toner adhered to the developing roller 402 decreases and the toner charge amount increases extremely. Thus, the developing amount may decrease, thereby decreasing the image density. When the contact pressure is less than 0.049 N/cm, a thin layer is not uniformly formed and a mass of the toner may pass through the regulating blade. Accordingly, the image quality may significantly deteriorate. In this embodiment, the developing roller 402 having JIS-A hardness of 30° was used, and a 0.1 mm thick SUS plate was used as the regulating blade 413. The contact pressure was set to 60 gf/cm. At this time, the objective amount of the toner adhered to the developing roller was obtained.

The contact angle of the regulating blade 413, which serves as the layer thickness regulating member, is preferably from 10° to 45° to a tangent of the developing roller 402 in the direction in which the tip portion faces the downstream side of the developing roller 402. The toner, which is not required for formation of a thin toner layer interposed between the regulating blade 413 and the developing roller 402, is removed from the developing roller 402 to form a thin layer having a uniform thickness within the objective range from 0.4 mg/cm$^2$ to 0.8 mg/cm$^2$ per unit area. At this time, in this example, the toner charge is finally within a range from −10 μC/g to −30 μC/g and development is performed in the state of facing the latent electrostatic image on the photoconductor drum 1.

Therefore, according to the one-component developing apparatus of this embodiment, the distance between the surfaces of the photoconductor drum 1 and the developing roller 402 are further reduced, compared with the conventional two-component developing unit. Thus, developability is enhanced, and it is possible to develop at a lower potential.

[Two-Component Developing Unit]

The two-component developing unit preferably includes a magnetic is generation unit and a developer bearing member. The magnetic generation unit is fixed inside the unit. The developer bearing member is rotatable and bears a two-component developer on its surface, and the two-component developer is composed of a magnetic carrier and a toner.

Figure 6:
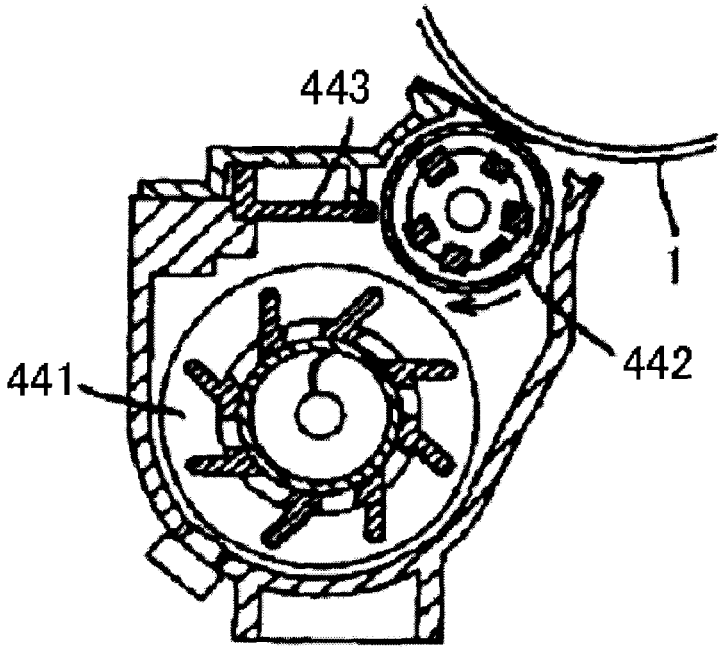
FIG. 6 is a schematic view showing an example of a two-component developing unit in an image forming apparatus of the present invention.

FIG. 6 is a schematic view showing an example of a two-component developing apparatus using a two-component developer composed of a toner and a magnetic carrier. In the two-component developing apparatus shown in FIG. 6, the two-component developer is stirred and transported by a screw 441 and fed to a developing sleeve 442 which serves as a developer bearing member. The two-component developer to be fed to the developing sleeve 442 is regulated by a doctor blade 443 serving as a layer thickness regulating member, and the amount of developer to be fed is controlled by a doctor gap, which is a gap between the doctor blade 443 and the developing sleeve 442. When the doctor gap is extremely small, the image density is insufficient because of the extremely small amount of developer. On the other hand, when the doctor gap is extremely large, the developer is excessively fed. This causes the carrier to adhere to the photoconductor drum 1 serving as the latent electrostatic image bearing member. Thus, a magnet is provided in the developing sleeve 442. This magnet serves as a magnetic field generating unit, which forms a magnetic field to cause a standing state of the developer on the peripheral surface. The developer is deposited on the developing sleeve 442 in a chain-shaped standing state, along with a magnetic line in a normal line direction of a magnetic force is produced from the magnet to form a magnetic brush.

The developing sleeve 442 and the photoconductor drum 1 are proximately disposed at a fixed interval (developing gap), and a developing area is formed at the opposite portions of both of them. The developing sleeve 442 is formed in a cylindrical form made of a non-magnetic material such as aluminum, brass, stainless steel, or a conductive resin and is rotated by a rotation driving mechanism (not shown). The magnetic brush is transported to the developing area by rotation of the developing sleeve 442. A developing voltage is applied to the developing sleeve 442 from a power supply for development (not shown), and the toner on the magnetic brush is separated from the carrier by a developing electric field formed between the developing sleeve 442 and the photoconductor drum 1. Finally, the toner is deposited on the latent electrostatic image on the photoconductor drum 1. An alternating current may be superimposed on the developing voltage.

The developing gap is preferably about 5 times to 30 times larger than the particle size of the developer. When the particle size of the developer is 50 μm, the developing gap is preferably set within a range from 0.5 mm to 1.5 mm. Consequently, when the developing gap is widen, desired image density may not be obtained.

The doctor gap is preferably the same as or relatively larger than the developing gap. The drum size and the drum linear velocity of the photoconductor drum 1 as well as the sleeve diameter and the sleeve linear velocity of the developing sleeve 442 are determined by limitations such as the copying velocity and the size of the apparatus. A ratio of the sleeve linear velocity to the drum linear velocity is preferably adjusted to 1.1 or more to obtain a necessary image density. It is also possible to control the process conditions by providing a sensor at the position after the development and detecting the amount of toner adhesion from an optical reflectance.

<Transferring Step and Transferring Unit>

In the transferring step, the transferring unit transfers the visible image onto a recording medium. The transferring unit is generally classified into a transferring unit which directly transfers a visible image formed on a latent electrostatic image bearing member onto a recording medium, and a secondary transferring unit which primarily transfers a visible image onto an intermediate transfer member and secondarily transfers the image on the recording medium.

The visible image can be transferred, for example, by charging the latent electrostatic image bearing member using a transfer charger, and the transfer can be performed by the transferring unit. The transferring unit preferably includes a primary transferring unit and a secondary transferring unit. The primary transferring unit transfers a visible image onto an intermediate transfer member to form a composite transfer image. The secondary transferring unit transfers the composite transfer image onto a recording medium.

—Intermediate Transfer Member—

The intermediate transfer member is not particularly limited and can be appropriately selected from known transfer units according to the purpose. The intermediate transfer member is preferably a transfer belt or a transfer roller, for example.

The coefficient of static friction of the intermediate transfer member is preferably from 0.1 to 0.6 and more preferably from 0.3 to 0.5. The volume resistivity of the intermediate transfer member is preferably within a range from several Ω·cm to $10^3$ Ω·cm. When the volume resistivity of the intermediate transfer member is adjusted within a range from several Ω·cm to $10^3$ Ω·cm, the intermediate transfer member is prevented from being charged and charge applied by the charge applying unit is less likely to remain on the intermediate transfer member. Thus, it is possible to prevent transfer unevenness and easily apply a transfer bias upon the secondary transfer.

The material of the intermediate transfer member is not particularly limited and can be appropriately selected from known materials according to the purpose. The following materials are preferable:

(1) A material having high Young's modulus (tensile elastic modulus) is used for a single-layered belt. Examples of the material include polycarbonate (PC), polyvinylidene fluoride (PVDF), polyalkylene terephthalate (PAT), a blend material of polycarbonate (PC) and polyalkylene terephthalate (PAT), a blend material of ethylene tetrafluoroethylene copolymer (ETFE) and PC, a blend material of ETFE and PAT, a blend material of PC and PAT, and carbon black dispersed thermosetting polyimide. The single-layered belt having high Young's modulus is not deformed much when stress is applied upon image formation. The belt has an advantage that rib shift hardly occurs upon formation of the image.

(2) A belt has two or three layers including a base layer, a surface layer, and/or an intermediate layer. The belt (1) having high Young's modulus is used as the base layer, and the surface layer or the intermediate layer is formed on the outer periphery of the base layer. This belt having two or three layers can prevent voids of a line image, which occurs by the hardness of the single-layered belt.

(3) A resin, a rubber, or an elastomer is used for an elastic belt having relatively low Young's modulus. This elastic belt hardly causes voids of the line image due to its softness. Meandering can be prevented by making the elastic belt wider than a driving roller and a stretching roller and utilizing elasticity of the belt edge protruding from the rollers. Thus, it is possible to reduce production costs since a rib or meandering preventing device is not necessary.

Among these belts, the elastic belt (3) is particularly preferable.

The elastic belt deforms against a toner layer and a recording medium with poor smoothness at the transfer portion. Specifically, the elastic belt deforms against local unevenness. Accordingly, good adhesion is obtained without applying an extremely high transfer pressure to the toner layer. Moreover, an excellent uniform transfer image can be obtained without voids of characters on a recording medium having poor smoothness.

The resin used for the elastic belt is not particularly limited and can be appropriately selected according to the purpose. Example of the resin include polycarbonate resin, fluorine resin (ETFE, PVDF), styrene resin (homopolymer or copolymer containing styrene or substituted styrene) such as polystyrene resin, chloropolystyrene resin, poly-Δ-methylstyrene resin, styrene-butadiene copolymer, styrene-vinyl chloride copolymer, styrene-vinyl acetate copolymer, styrene-maleic acid copolymer, styrene-acrylate ester copolymer (e.g., styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate ester copolymer (e.g., styrene-methyl methacrylate copolymer, styrene-ethyl methacrylate copolymer, and styrene-phenyl methacrylate copolymer), styrene-α-chloromethyl acrylate copolymer, and styrene-acrylonitrile-acrylate ester copolymer, methyl methacrylate resin, butyl methacrylate resin, ethyl acrylate resin, butyl acrylate resin, modified acrylic resin (e.g., silicone modified acrylic resin, vinyl chloride resin modified acrylic resin, and acrylurethane resin), vinyl chloride resin, styrene-vinyl acetate copolymer, vinyl chloride-vinyl acetate copolymer, rosin modified maleic acid resin, phenol resin, epoxy resin, polyester resin, polyethylene resin, polypropylene resin, polybutadiene, polyvinylidene chloride resin, iomomer resin, polyurethane resin, silicone resin, ketone resin, ethylene-ethylacrylate copolymer, xylene resin, polyvinyl butyral resin, polyamide resin, and modified polyphenylene oxide resin. These resins may be used alone or in combination.

The rubber used for the elastic belt is not particularly limited and can be appropriately selected according to the purpose. Examples of the rubber include natural rubber, butyl rubber, fluorine rubber, acryl rubber, EPDM rubber, NBR rubber, acrylonitrile-butadiene-styrene rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluorine rubber, polysulfide rubber, polynorbornene rubber, and hydrogenated nitrile rubber. These rubbers may be used alone or in combination.

The elastomer used for the elastic belt is not particularly limited and can be appropriately selected according to the purpose. Examples of the elastomer include thermoplastic polystyrene elastomer, thermoplastic polyolefin elastomer, thermoplastic polyvinyl chloride elastomer, thermoplastic polyurethane elastomer, thermoplastic polyamide elastomer, thermoplastic polyurea elastomer, thermoplastic polyester elastomer, and thermoplastic fluorine elastomer. These elastomers may be used alone or in combination.

The conductive agent for controlling a resistivity, which is used for the elastic belt, is not particularly limited and can be appropriately selected according to the purpose. Examples of the conductive agent include carbon black, graphite, powders of metal such as aluminum and nickel; and conductive metal oxides such as tin oxide, titanium oxide, antimony oxide, indium oxide, potassium titanate, antimony oxide-tin oxide complex oxide (ATO), and indium oxide-tin oxide complex oxide (ITO). The conductive metal oxide may be coated with fine insulating particles of barium sulfate, magnesium silicate, or calcium carbonate.

The surface layer of the elastic belt can preferably prevent contamination of a latent electrostatic image bearing member due to an elastic material and decrease frictional resistance of the surface of the belt to reduce adhesion of the toner, thereby enhancing cleanability and secondary transferability. The surface layer preferably contains a binder resin such as polyurethane resin, polyester resin, or epoxy resin and a material capable of enhancing lubricating property by decreasing surface energy, such as powders or particles of fluororesin, fluorine compound, fluorinated carbon, titanium dioxide, or silicone carbide. It is also possible to use a fluorine rubber material in which a fluorine-rich surface layer is formed by heat treatment, thereby decreasing the surface energy.

A method for producing the elastic belt is not particularly limited and can be appropriately selected according to the purpose. Examples of the method include: (1) a centrifugal molding method for forming a belt by casting a material in a rotating cylindrical mold; (2) a spray coating method for forming a film by spraying a liquid coating material; (3) a dipping method for dipping a cylindrical mold in a solution of a material and pulling up the mold; (4) a casting method for casting a material in an inner mold or an outer mold; and (5) a method for winding a compound around a cylindrical mold to perform vulcanization and grinding.

A method for preventing elongation of the elastic belt is not particularly limited and can be appropriately selected according to the purpose. Examples of the method include: (1) a method for adding a material, which prevents elongation, to a core layer; and (2) a method for forming a rubber layer on a core layer which causes less elongation.

The material which prevents elongation is not particularly limited and can be appropriately selected according to the purpose. Examples of the material include natural fibers such as cotton and silk; synthetic fibers such as polyester fiber, nylon fiber, acryl fiber, polyolefin fiber, polyvinyl alcohol fiber, polyvinyl chloride fiber, polyvinylidene chloride fiber, polyurethane fiber, polyacetal fiber, polyfluoroethylene fiber, and phenol fiber; inorganic fibers such as carbon fiber, glass fiber, and boron fiber; and metal fibers such as iron fiber and copper fiber. These materials are preferably used after being formed into a woven fabric or yarn.

The method for forming a core layer is not particularly limited and can be appropriately selected according to the purpose. Examples of the method include: (1) a method for covering a metal mold with a cylindrical woven fabric and forming a coating layer thereon; (2) a method for immersing a cylindrical woven fabric in a liquid rubber or the like to form a coating layer on one or both sides of a core layer: and (3) a method for spirally winding a yarn around a metal mold or the like at optional pitches and forming a coating layer thereon.

The thickness of the coating layer varies depending on the hardness of the coating layer. When the coating layer is extremely thick, expansion and contraction of the surface become large, and the surface layer is likely to crack An extremely thick coating layer (approximately 1 mm or more) is not preferable because expansion and contraction increase, thereby increasing expansion and contraction of the image increase.

The transferring unit (primary transferring unit, secondary transferring unit) preferably includes at least a transferring device which charges the recording medium to transfer the visible image, which is formed on the latent electrostatic image bearing member, to the recording medium. One or more transferring devices may be employed. Examples of the transferring device include corona transferring device utilizing corona discharge, transferring belt, transferring roller, pressure transfer roller, and adhesive transferring device.

The recording medium is typically a plain paper, but the recording medium is not particularly limited. The recording medium can be appropriately selected according to the purpose as long as an unfixed image can be transferred after the development. A PET base or the like for OHP can also be used.

—Transferring Unit of Tandem Image Forming Apparatus—

In the tandem image forming apparatus, a plurality of image forming elements are disposed. Each of the image forming elements include at least a latent electrostatic image bearing member, a charging unit, a developing unit, and a transferring unit. This tandem image forming apparatus is equipped with four image forming elements for yellow, magenta, cyan and black so that a visible image of each color is formed by the corresponding image forming element in parallel and superposed on a recording medium or an intermediate transfer member. Therefore, a full-color image can be formed at high speed.

Figure 7:
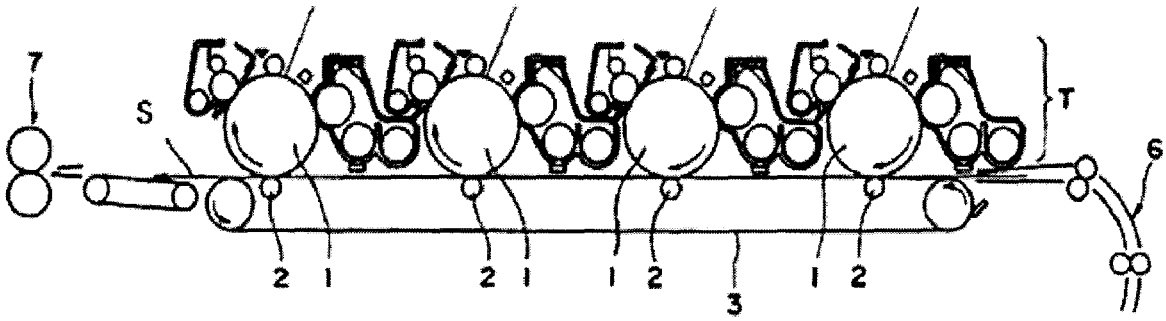
FIG. 7 is a schematic view showing an example of direct transfer in a tandem image forming apparatus of the present invention.
Figure 8:
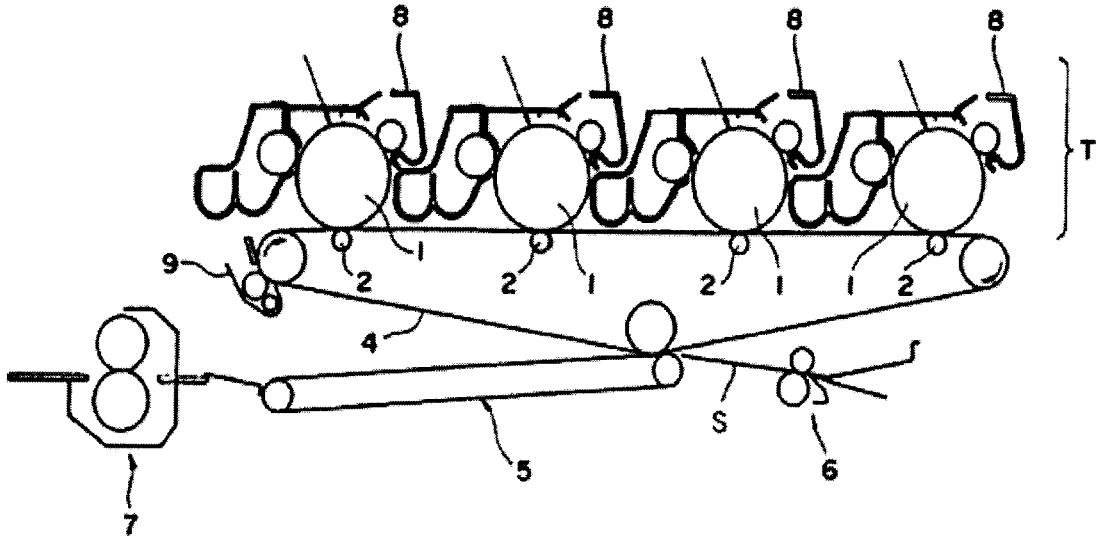
FIG. 8 is a schematic view showing an example of indirect transfer in the tandem image forming apparatus of the present invention.

The tandem image forming apparatus is classified into (1) a direct transferring system as shown in FIG. 7 and (2) an indirect transferring system as shown in FIG. 8. In the direct transferring system, a transferring unit 2 sequentially transfers the visible image formed on each of the latent electrostatic image bearing member 1 onto a recording medium S. At this time, the surface of the recording medium S moves to pass through transfer positions, which are regions facing the latent electrostatic image bearing member 1 of the plurality of image forming elements. In the indirect transferring system, a transferring unit (primary transferring unit) 2 sequentially transfers the visible image, which is on the latent electrostatic image bearing member 1 of each of the plurality of image forming elements, onto an intermediate transfer member 4. Thereafter, a secondary transferring unit 5 transfers the images on the intermediate transfer member 4 onto a recording medium S all at once. A roller may be used instead of a transfer belt, which serves as the secondary transfer unit in FIG. 8.

When the direct transferring system of (1) and the indirect transferring system of (2) are compared, it is necessary, in the direct transferring system of (1), to dispose a paper feeder 6 at a position upstream side of the tandem image forming section T, which includes the plurality of disposed latent electrostatic image bearing members, and dispose a fixing device 7 serving as a fixing unit at the downstream side. This makes the apparatus larger in the direction of transporting the recording medium. The indirect transferring system of (2), in contrast, has such an advantage that the secondary transfer position may be set to be relatively free and that the paper feeder 6 and the fixing device 7 can be arranged over the tandem image forming section T so as to make the apparatus smaller.

Moreover, in the direct transferring system of (1), the fixing device 7 is disposed closer to the tandem image forming section T in order to avoid making the apparatus larger in the direction of transporting the recording medium. This makes it impossible to dispose the fixing device 7 with a sufficient space to allow the recording medium S to flex. As a result, the fixing device 7 is likely to affect the imaging formation carried out in the upstream due to the impact of the tip of the recording medium S entering the fixing device 7 (the impact is particularly significant when the recording medium is thick), and/or the difference between the transportation speed of the recording medium passing the fixing device 7 and the transportation speed of the recording medium being carried by the transfer belt. In contrast, the fixing device 7 can be disposed with a sufficient margin to allow the recording medium S to flex in the indirect transferring system of (2). Therefore, the fixing device 7 hardly affects the imaging formation.

For the reasons described above, the indirect transferring system is viewed as more promising in recent years. In such a color image forming apparatus, residual toner on the latent electrostatic image bearing member 1 is removed by a cleaning device 8, which serves as a cleaning unit, after the primary transfer. Accordingly, the surface of the latent electrostatic image bearing member 1 is cleaned to prepare for the next image formation. Moreover, the residual toner on the intermediate transfer member 4 is removed by an intermediate transfer member cleaning device 9 after the secondary transfer. Accordingly, the surface of the intermediate transfer member 4 is cleaned to prepare for the next image formation.

<Fixing Step and Fixing Unit>

In the fixing step, a fixing unit fixes the image on the recording medium.

The fixing unit is not particularly limited and can be appropriately selected according to the purpose. A fixing device having fixing member and a heat source for heating the fixing member is preferably used.

The fixing members are not particularly limited and can be appropriately selected according to the purpose as long as they contact with each other to form a nip portion. Examples of the fixing member include a combination of an endless belt and a roller and a combination of rollers. In order to reduce the duration of warm-up and realize energy-saving, it is preferable to employ the combination of an endless belt and a roller, or a method of heating the surface of the fixing member by induction heating.

Examples of the fixing member include a known heating and pressurizing unit (a combination of a heating unit and a pressurizing unit). Examples of the combination of the endless belt and the roller, which serves as the heating and pressurizing unit, include a combination of a heat roller, a pressure roller, and an endless belt. Examples of the combination of the rollers include a combination of a heat roller and a pressure roller.

When an endless belt is used as the fixing member, the endless belt is preferably formed from a material having a low heat capacity. For example, an anti-offset layer is provided on a base material. Examples of the base material include nickel and polyimide. Examples of the anti-offset layer material include silicone rubber and fluorine resin.

When a roller is used as the fixing member, a core metal of the roller is preferably formed from a non-elastic material in order to prevent deformation under high pressure. The non-elastic material is not particularly limited and can be appropriately selected according purposes. The non-elastic material is preferably, for example, a material having high heat conductivity such as aluminum, iron, stainless steel, or brass. The surface of the roller is preferably coated with the anti-offset layer. The anti-offset layer material is not particularly limited and can be appropriately selected according to the purpose. Examples of the anti-offset layer material include RTV silicone rubber, tetrafluoroethylene-perfluoroalkyl vinyl ether (PFA), and polytetrafluoroethylene (PTFE).

In the fixing step, an image may be fixed on the recording medium by transferring the toner image onto the recording medium and passing the recording medium having the image transferred thereon through the nip portion. Alternatively, the image may be transferred and fixed simultaneously on the recording medium at the nip portion.

The fixing step may be performed each time the image of different color is transferred onto the recording medium or may be performed only once after superposing the images of different colors.

At least two fixing members contact each other to form the nip portion.

The surface pressure of the nip portion is not particularly limited and can be appropriately selected according to the purpose. The surface pressure is preferably 5 N/cm$^2$ or more, more preferably from 7 N/cm$^2$ to 100 N/cm$^2$, and still more preferably from 10 N/cm$^2$ to 60 N/cm$^2$. When the surface pressure of the nip portion is extremely high, the durability of the roller may be degraded. When the surface pressure of the nip portion is lower than 5N/cm$^2$, the image may be insufficiently fixed.

The temperature at which the toner image is fixed onto the recording medium (i.e., the surface temperature of the fixing member heated by the is heating unit) is not particularly limited and can be appropriately selected according to the purpose. The temperature is preferably from 120° C. to 170° C. and more preferably from 120° C. to 160° C. When the fixing temperature is less than 120° C., the image may be insufficiently fixed. When the fixing temperature exceeds 170° C., energy is not saved.

The fixing unit is generally classified into (1) those adopting internal heating mode in which the fixing unit has at least a roller or a belt, the surface thereof which does not contact the toner is heated, and the image transferred onto the recording medium is heated and pressurized to be fixed; and (2) those adopting external heating mode in which the fixing unit has at least a roller or a belt, the surface thereof which contact the toner is heated, and the image transferred onto the recording medium is heated and pressurized to be fixed. Note that the fixing unit may employ the combination of the internal heating mode and external heating mode.

A fixing unit adopting the internal heating mode (1) may include, for example, the fixing member having a heating unit incorporated therein. This heating unit may be a heat source such as electric heater or halogen lamp.

In a fixing unit adopting the external heating mode (2), at least part of one of the surfaces of the fixing members is preferably heated by the heating unit. The heating unit is not particularly limited and can be appropriately selected according to the purpose. Examples of the hearing unit include an electromagnetic induction heating unit.

The electromagnetic induction heating unit is not particularly limited and can be appropriately selected according to the purpose. The electromagnetic induction heating unit preferably includes a magnetic field generating unit and an electromagnetic induction heat generating unit.

The electromagnetic induction heating unit preferably includes an induction coil, a shield layer, and an insulating layer. The induction coil is disposed in the vicinity of the fixing member (e.g., a heat roller) and provided on the shield layer. The insulating layer is provided on the opposite side of the surface where the induction coil is provided on the shield layer. The heat roller is preferably constituted by a magnetic material or a heat pipe.

The induction coil is preferably disposed so as to enclose at least a semicylindrical portion on the side of the heat roller opposite to the surface where the heat roller and the fixing member (e.g., pressure roller and endless) contact each other.

—Fixing Unit Adopting Internal Heating Mode—

Figure 9:
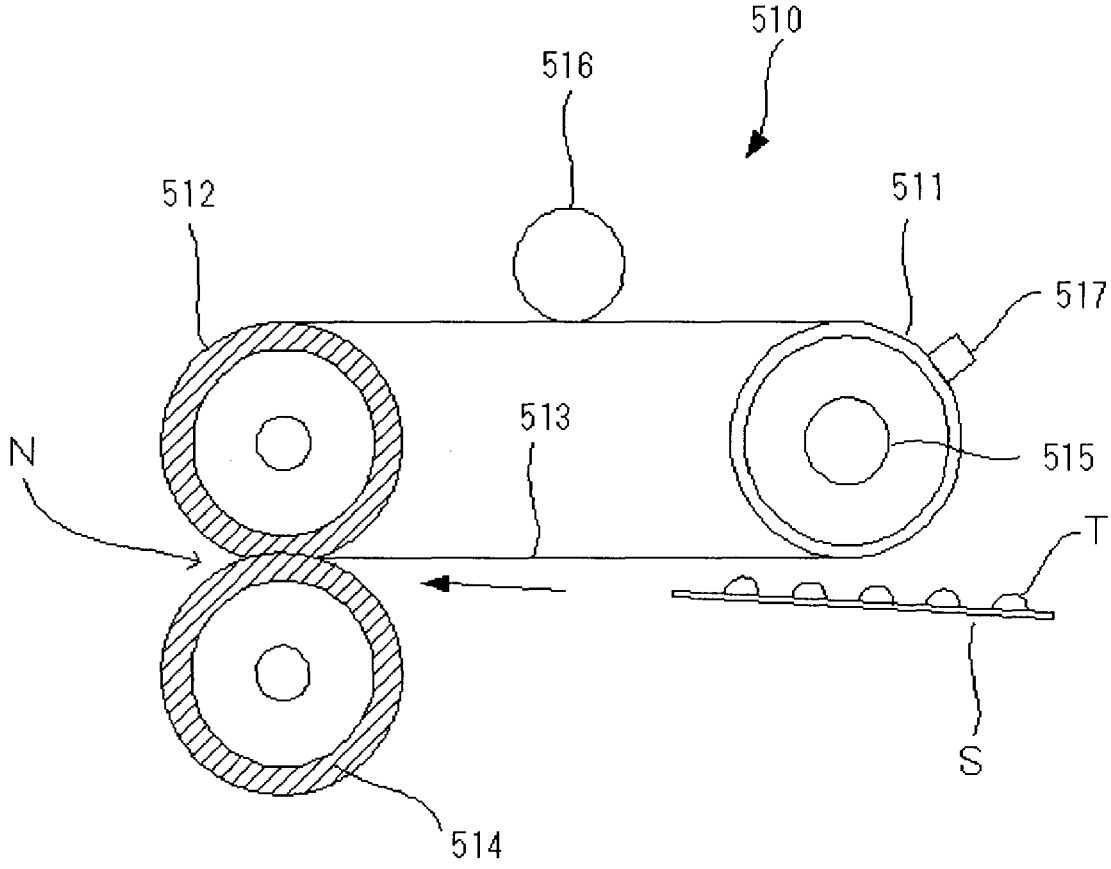
FIG. 9 is a schematic view showing an example of a belt fixing unit in an image forming apparatus of the present invention.

FIG. 9 shows a belt fixing device as an example of the fixing unit adopting the internal heating mode. The belt fixing device 510 shown in FIG. 9 includes a heat roller 511, a fixing roller 512, a fixing belt 513, and a pressure roller 514.

The fixing belt 513 is stretched by the heat roller 511 and the fixing roller 512 which are rotatably disposed inside the belt 513. The fixing belt 513 is heated to a predetermined temperature by the heat roller 511. The heat roller 511 incorporates a heat source 515 therein, and the temperature of the heat roller 511 is controlled by a temperature sensor 517 mounted in the vicinity of the heat roller 511. The fixing roller 512 is rotatably disposed inside the fixing belt 513 and contacts the inner surface of the fixing belt 513. The pressure roller 514 is rotatably disposed outside the fixing belt 513 and contacts the outer surface of the fixing belt 513 so as to press the fixing roller 512. Surface hardness of the fixing belt 513 is lower than that of the pressure roller 514. In a nip portion N formed between the fixing roller 512 and the pressure roller 514, an intermediate region, which is located between an introducing end and ejecting end of a recording medium S, is positioned closer to the fixing roller 512 than the introducing end and the ejecting end.

In the belt fixing device 510 shown in FIG. 9, the recording medium S, on which a toner image T to be fixed is formed, is transported to the heat roller 511 at first. Subsequently, the toner image T formed on the recording medium S is heated and melt by the heat roller 511 and the fixing belt 513 which are heated to a predetermined temperature by the built-in heat source 515. Under this condition, the recording medium S is inserted into the nip portion N formed between the fixing roller 512 and the pressure roller 514. The recording medium S inserted into the nip portion N contacts the surface of the fixing belt 513 which rotates in synchronization with the rotations of the fixing roller 512 and the pressure roller 514. The recording medium S is pressed while passing through the nip portion N so that the toner image T is fixed on the recording medium S.

Next, the recording medium S, on which the toner image T is fixed, passes through between the fixing roller 512 and the pressure roller 514 to be separated from the fixing belt 513 and transported to a tray (not shown). At this time, the recording medium S is ejected toward the pressure roller 514, and the recording medium S is prevented from being entangled with the fixing belt 513. The fixing belt 513 is cleaned by a cleaning roller 516.

Figure 10:
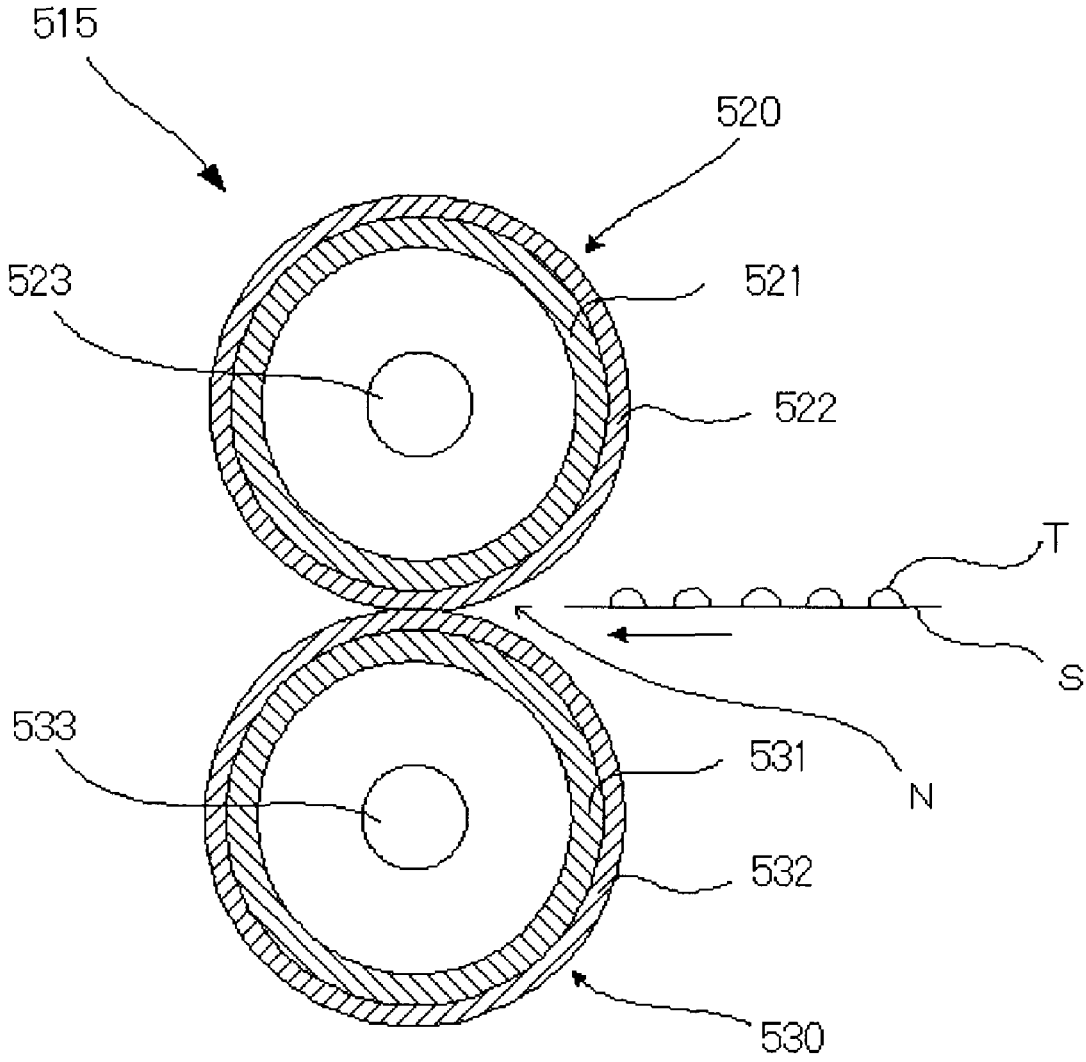
FIG. 10 is a schematic view showing an example of a heat roller fixing unit in an image forming apparatus of the present invention.

A heat roller fixing device 515 shown in FIG. 10 is provided with a heat roller 520 and a pressure roller 530. The heat roller 520 serves as the fixing member, and the pressure roller is disposed in contact therewith. The heat roller 520 has a hollow metal cylinder 521. The surface of the heat roller 520 is covered with an anti-offset layer 522, and a heating lamp 523 is disposed inside the heat roller 520. The pressure roller 530 has a metal cylinder 531. The surface of the pressure roller 530 is covered with an anti-offset layer 532. The metal cylinder 531 may be hallow, and a heating lamp 533 may be disposed inside the pressure roller 530.

The heat roller 520 and the pressure roller 530 are urged by a spring (not shown) into contact with each other while being capable of rotating, and a nip portion N is formed therebetween. Surface hardness of the anti-offset layer 522 of the heat roller 520 is lower than that of the anti-offset layer 532 of the pressure roller 530. In the nip portion N formed between the fixing roller 520 and the pressure roller 530, an intermediate region, which is located between an introducing end and ejecting end of a recording medium S, is positioned closer to the heat roller 520 than the introducing end and the ejecting end.

In the heat roller fixing device 515 shown in FIG. 10, the recording medium S, on which a toner image T to be fixed is formed, is transported to the nip portion N formed between the heat roller 520 and the pressure roller 530 at first. Subsequently, the toner image T on the recording medium S is heated and melt by the heat roller 520 which is heated to a predetermined temperature by the built-in heating lamp 523. At the same time, the recording medium S is pressed by the pressure roller 530 while passing through the nip portion so that the toner image T is fixed on the recording medium S.

Next, the recording medium S, on which the toner image T is fixed, passes through between the heat roller 520 and the pressure roller 530 and is transported to the tray (not shown). At this time, the recording medium S is ejected toward the pressure roller 530, and the recording medium S is prevented from being entangled with the pressure roller 530. The heat roller 520 is cleaned by a cleaning roller (not shown).

—Fixing Unit Adopting External Heating Mode—

Figure 11:
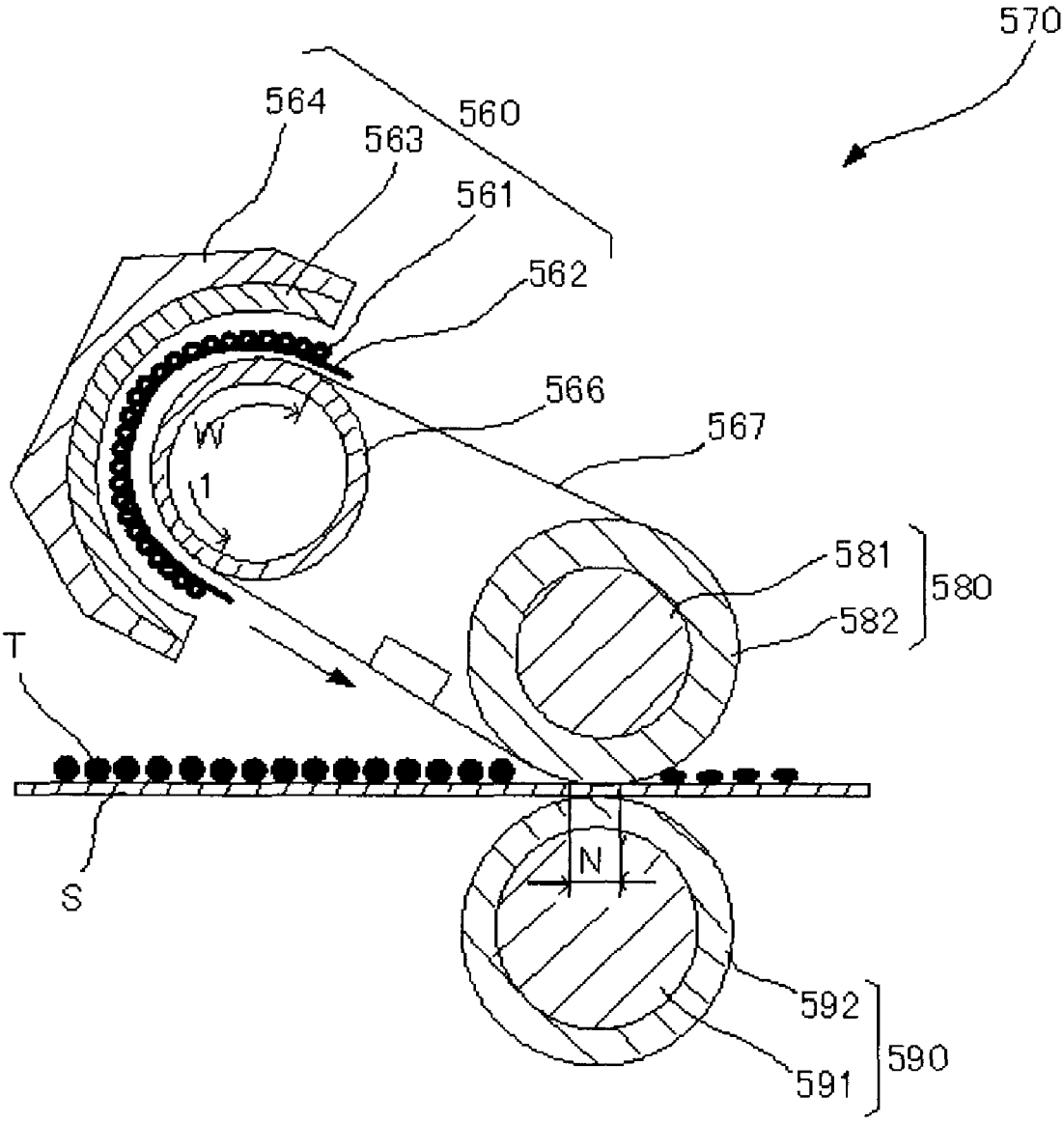
FIG. 11 is a schematic view showing an example of an electromagnetic induction heating fixing unit in an image forming apparatus of the present invention.

FIG. 11 shows an electromagnetic induction heating fixing device 570 as an example of the fixing unit adopting the external heating mode. The electromagnetic induction heating fixing device 570 includes a heat roller 566, a fixing roller 580, a fixing belt 567, a pressure roller 590, and an electromagnetic induction heat unit 560.

The fixing belt 567 is stretched by the heat roller 566 and the fixing roller 580 which are rotatably disposed inside the belt 513. The fixing belt 567 is heated to a predetermined temperature by the heat roller 566.

The heat roller 566 has a hollow cylindrical member made of a magnetic metal such as iron, cobalt, nickel, or an alloy thereof, which is, for example, 20 mm to 40 mm in outer diameter and 0.3 mm to 1.0 mm in thickness and has a low heat capacity to allow quick heat-up.

The fixing roller 580 has a core metal 581 made of stainless steel or the like. The surface of the fixing roller 580 is covered with an elastic layer 582 formed from silicone rubber which has thermal resistance and is in solid or foamed state. The fixing roller 580 is rotatably disposed inside the fixing belt 567 and contact the inner surface of the fixing belt 567. The fixing roller 580 has an outer diameter of about 20 mm to 40 mm, which is larger than that of the heat roller 566, to form a nip portion N having a predetermined width between the pressure roller 590 and the fixing roller 580 by the pressure of the pressure roller 590. The elastic layer 582 is formed so that the elastic layer 582 has a thickness of approximately 4 mm to 6 mm and the heat capacity of the heat roller 566 is smaller than that of the fixing roller 580. Thus, the duration of warming up the heat roller 566 is reduced.

The pressure roller 590 has a core metal 591 constituted by a cylindrical member. The cylindrical member is made of a metal having high thermal conductivity such as copper or aluminum. The surface of the pressure roller 590 is covered with an elastic layer 592 having high thermal resistance and toner releasability. The pressure roller 590 is rotatably disposed outside the fixing belt 567 and contacts the outer surface of the fixing belt 567 so as to press the fixing roller 580. The core metal 591 may be made of SUS instead of the metals described above.

The electromagnetic induction heating unit 560 is disposed in the vicinity of the heat roller 566 along the axial direction of the heat roller 566. The electromagnetic induction heating unit 560 includes an excitation coil 561 and a coil guide plate 562. The excitation coil 561 is a magnetic field generating unit and winds around the coil guide plate 562. The coil guide plate 562 has a semicylindrical shape and disposed near the outer peripheral surface of the heat roller 566. The excitation coil 561 is formed by winding a long excitation coil wire around the coil guide plate 562 alternately in the axial direction of the heat roller 566. The excitation coil 561 is connected to a drive power source (not shown) having an oscillation circuit of variable frequency. An excitation coil core 563 is disposed in the vicinity of the outside of the excitation coil 561. The excitation coil core 563 has semicylindrical shape and is made of a ferromagnetic material such as ferrite and fixed on an excitation coil core support member 564.

In the electromagnetic induction heating fixing device 570 shown in FIG. 11, when electricity is applied to the excitation coil 561 of the electromagnetic induction heating unit 560, an alternating magnetic field is formed around the electromagnetic induction heating unit 560. Accordingly, the heat roller 566, which is disposed near and surrounded by the excitation coil 561, is preheated uniformly and efficiently by the eddy current excitation. A recording medium S, on which a toner image T to be fixed is formed, is transported to a nip portion N between the fixing roller 580 and the pressure roller 590. The toner image T formed on the recording medium S is heated and melted by the fixing belt 567. The fixing belt 567 is heated at a contact area W1, which contacts the heat roller 566, by the heat roller 566, which is heated to a predetermined temperature by the electromagnetic induction heating unit 560. Under this condition, the recording medium S is inserted into the nip portion N formed between the fixing roller 580 and the pressure roller 590. The recording medium S inserted into the nip portion N contacts the surface of the fixing belt 567 which rotates in synchronization with the rotations of the fixing roller 580 and the pressure roller 590. The recording medium S is pressed while passing through the nip portion N so that the toner image T is fixed on the recording medium S.

Next, the recording medium S, on which the toner image T is fixed, passes through between the fixing roller 580 and the pressure roller 590 to be separated from the fixing belt 567 and transported to a tray (not shown). At this time, the recording medium S is ejected toward the pressure roller 590, and the recording medium S is prevented from being entangled with the fixing belt 567. The fixing belt 567 is cleaned by a cleaning roller (not shown).

Figure 12:
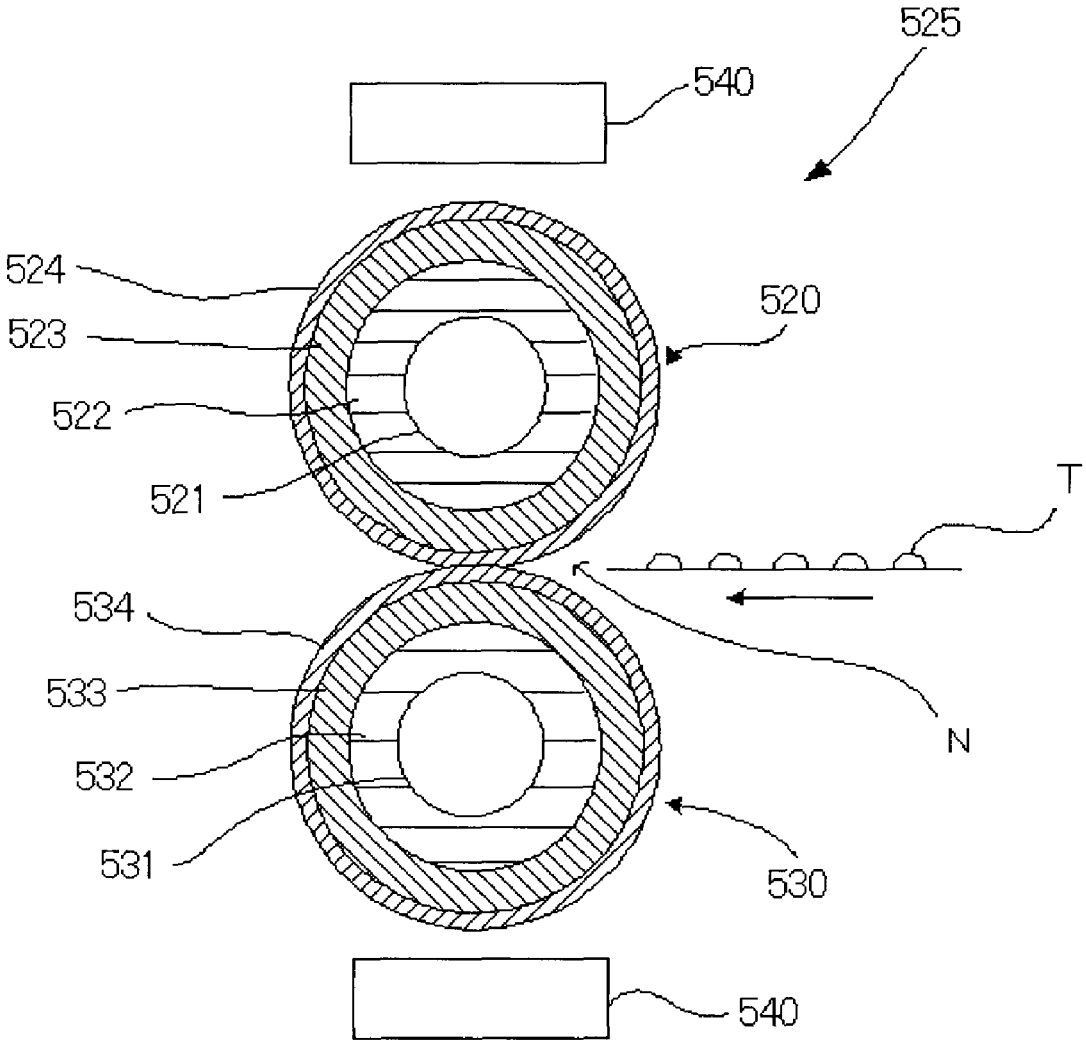
FIG. 12 is a schematic view showing another example of an electromagnetic induction heating fixing unit in an image forming apparatus of the present invention.

An electromagnetic induction heating roller fixing device 525 shown in is FIG. 12 includes a fixing roller 520, a pressure roller 530, and electromagnetic induction heat sources 540. The fixing roller 520 serves as the fixing member. The pressure roller 530 is disposed to contact the fixing roller 520. The electromagnetic induction heat sources 540 heat the fixing roller 520 and the pressure roller 530 from the outside.

The fixing roller 520 has a core metal 521. The surface of the core metal 521 is covered with a heat insulating elastic layer 522, a heat generating layer 523, and a releasing layer 524 which are formed in this order. The pressure roller 530 has a core metal 531. The surface of the core metal 531 is covered with a heat insulating elastic layer 532, a heat generating layer 533, and a releasing layer 534 which are formed in this order. The releasing layers 524 and 534 are made of tetrafluoroethylene-perfluoroalkyl vinyl ether (PFA).

The fixing roller 520 and the pressure roller 530 are urged by a spring (not shown) into contact with each other while being capable of rotating, and a nip portion N is formed therebetween.

The electromagnetic induction heat sources 540 are disposed in the vicinities of the fixing roller 520 and the pressure roller 530 and heat the heat generating layers 523 and 533 by electromagnetic induction.

In the fixing device shown in FIG. 12, the fixing roller 520 and the pressure roller 530 are preheated uniformly and efficiently by the electromagnetic induction heat sources 540. Since the device is constituted by a combination of rollers, high surface pressure can be easily achieved in the nip portion N.

<Cleaning Step and Cleaning Unit>

In the cleaning step, a cleaning unit preferably removes residual toner on the latent electrostatic image bearing member.

The latent electrostatic image bearing member can be cleaned without providing a cleaning unit (cleanerless system) when the developing unit has a developer bearing member, which contacts the surface of the latent electrostatic image bearing member, so as to develop the latent electrostatic image formed on the latent electrostatic image bearing member as well as collect the residual toner on the latent electrostatic image bearing member.

The cleaning unit is not particularly limited and can be appropriately selected from known cleaners as long as the cleaning unit removes the residual toner on the latent electrostatic image bearing member. Examples of the cleaning unit includes a magnetic brush cleaner, an electrostatic brush cleaner, an magnetic roller cleaner, a cleaning blade, a brush cleaner, and a web cleaner. Among these cleaners, it is particularly preferable to employ the cleaning blade which can significantly remove the toner and is compact and inexpensive.

Examples of a material of a rubber blade used for the cleaning blade include urethane rubber, silicone rubber, fluororubber, chloroprene rubber, and butadiene rubber. Among these, urethane rubber is particularly preferable.

Figure 13:
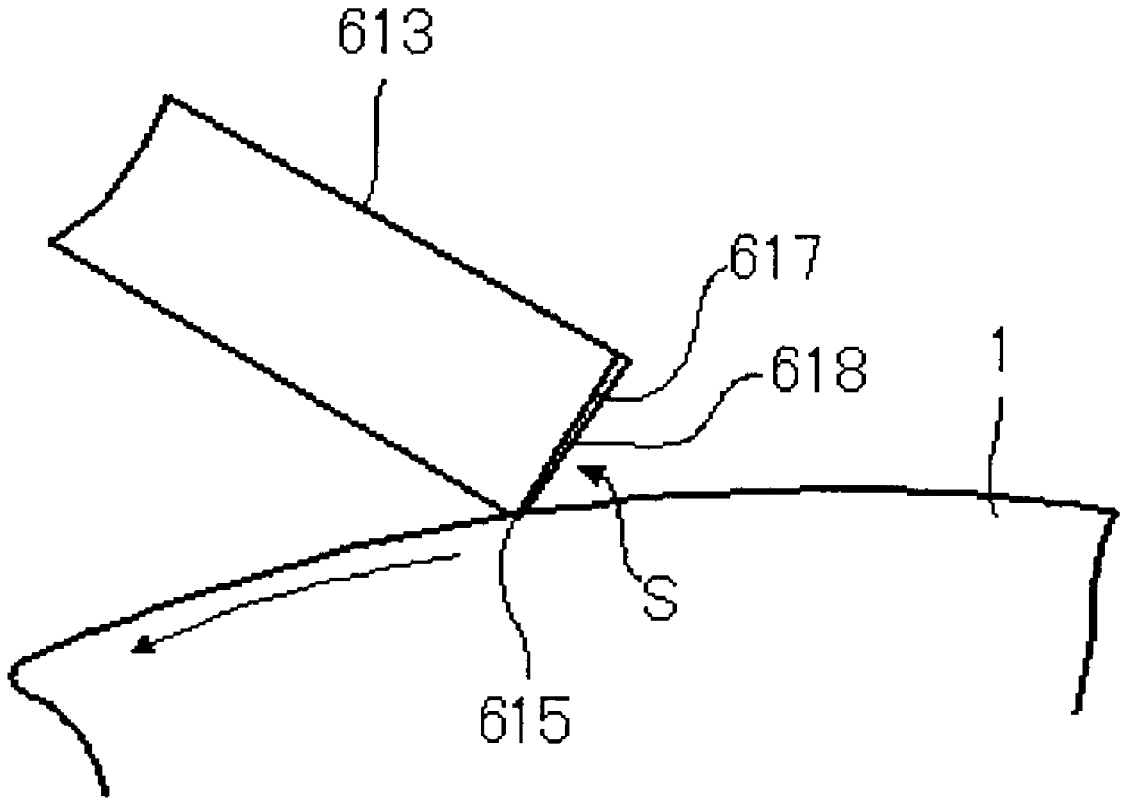
FIG. 13 is a schematic view showing an example of a cleaning blade in an image forming apparatus of the present invention.

FIG. 13 is an enlarged explanatory view showing the vicinity of a contact portion 615 between a cleaning blade 613 and a latent electrostatic image bearing member. The cleaning blade 613 is provided with a toner blocking surface 617 which forms a space S between the contact portion 615 and the surface of a photoconductor drum 1. The space S expands from the contact portion 615 toward the upstream in the rotating direction of the latent electrostatic image bearing member. In this embodiment, the toner blocking surface 617 extends from the contact portion 615 toward the upstream in the rotating direction of the photoconductor drum 1 so that the space S has an acute angle.

The toner blocking surface 617 is provided with a coated portion 618 which has a friction coefficient higher than that of the cleaning blade 613 as shown in FIG. 13. The coated portion 618 is made of a material (high friction material) having a friction coefficient higher than that of a material of the cleaning blade 613. Examples of the high friction material include diamond-like carbon (DLC) although the high friction material is not limited to DLC. The coated portion 618 is provided on the toner blocking surface 617 over an area which does not contact the surface of the photoconductor drum 1.

The cleaning unit includes a toner collecting vane, a toner collecting coil, and the like although they are not shown in FIG. 13. The toner collecting vane collects the residual toner that has been scraped by the cleaning blade, and the toner collecting coil transports the residual toner collected by the toner collecting vane to a collection portion.

—Cleanerless Image Forming Apparatus—

Figure 14:
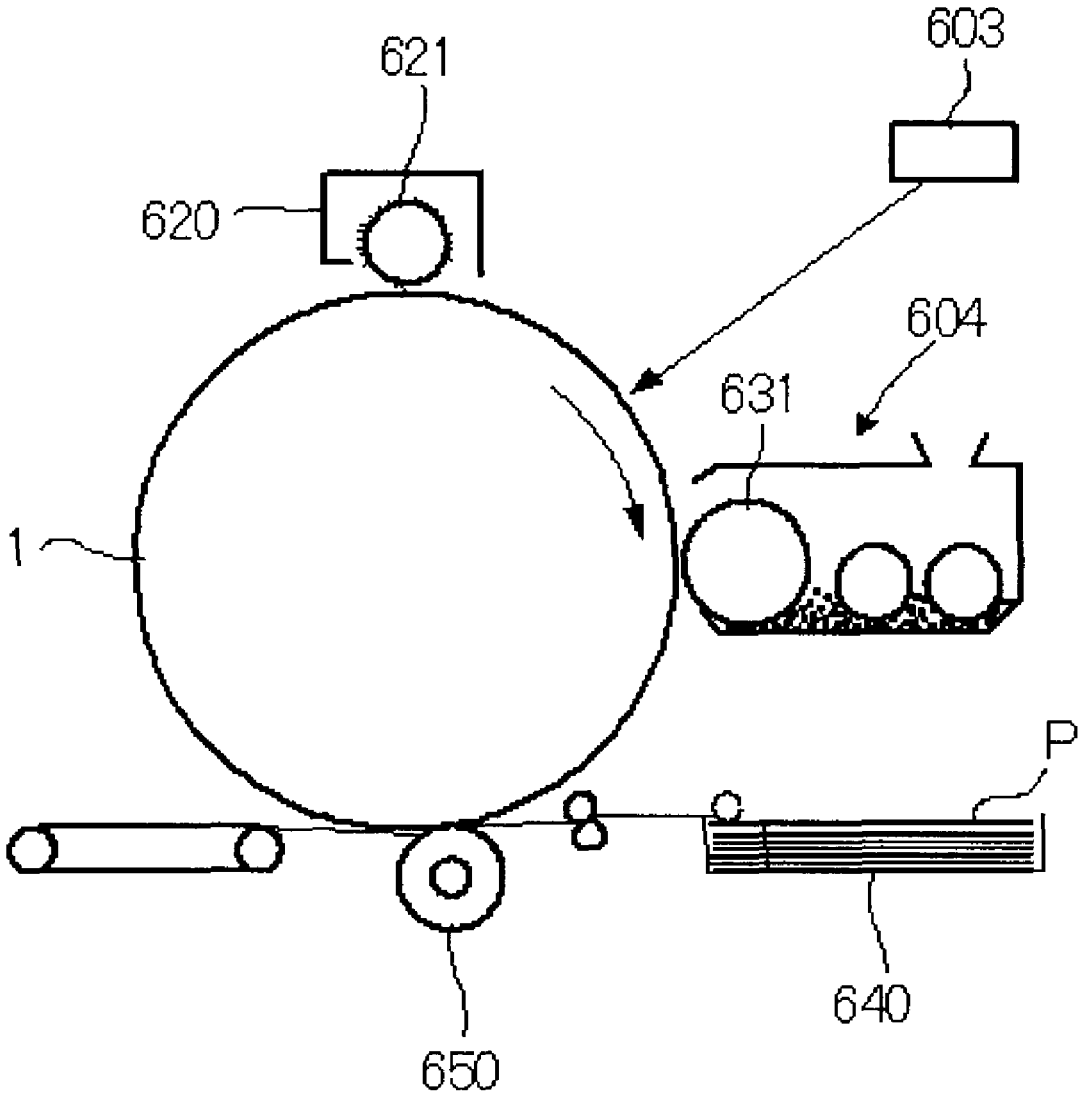
FIG. 14 is a schematic view showing an example of a cleanerless image forming apparatus of the present invention.

FIG. 14 is a schematic view showing an example of a cleanerless image forming apparatus in which the developing unit also serves as the cleaning unit.

In FIG. 14, the reference numeral 1 denotes a photoconductor drum serving as the latent electrostatic image bearing member. The reference numeral 620 denotes a brush charging device serving as a contact charging unit. The reference numeral 603 denotes an exposing device serving as an exposing unit. The reference numeral 604 denotes a developing device serving as the developing unit. The reference numeral 640 denotes a paper feeder cassette.

The reference numeral 650 denotes a roller transferring unit. The symbol P denotes a recording medium.

In the cleanerless image forming apparatus, the residual toner on the surface of the photoconductor drum 1 is moved after transfer to a position facing the contact charging device 620, which contacts the photoconductor drum 1, by the subsequent rotation of the photoconductor drum 1. The residual toner is temporarily collected by a magnetic brush (not shown) of the brush charging member 621 which contacts the photoconductor drum 1. The collected toner is again put on the surface of the photoconductor drum 1, and is finally collected with a developer by a developer bearing member 631 in the developing device 604. The photoconductor drum 1 is used repetitively for image formation.

When the developing unit 604 serves also as the cleaning unit, the developing unit 604 collects a small amount of residual toner on the photoconductor drum 1 by a developing bias (a potential difference between the DC voltage applied to the developer bearing member 631 and the surface potential of the photoconductor drum) after transfer.

In the cleanerless image forming apparatus in which the developing unit serves also as the cleaning unit, the residual toner is collected by the developing device 604 after transfer and used for the subsequent printing. As a result, waste toner is eliminated, and the apparatus does not require maintenance. Thus, the image forming apparatus becomes a cleanerless system, thereby providing a remarkable advantage with regard to space and achieving significant reduction in size of the image forming apparatus.

<Other Steps and Other Units>

In the charge eliminating step, a charge eliminating unit preferably performs charge elimination by applying a charge eliminating bias to the latent electrostatic image bearing member.

The charge eliminating unit is not particularly limited and can be appropriately selected from known charge eliminating devices as long as a charge eliminating bias can be applied to the latent electrostatic image bearing member. For example, the charge eliminating unit is preferably a charge eliminating lamp.

In the recycling step, a recycling unit can preferably recycle the electrophotographic toner which has been removed in the cleaning step to the developing unit. The recycling unit is not particularly limited and can be, for example, a known transporting unit.

In the controlling step, a controlling unit preferably controls the steps described above.

The controlling unit is not particularly limited and can be appropriately selected according to the purpose as long as the operation of each unit can be controlled. Examples of the controlling unit include devices such as a sequencer and a computer.

—Image Forming Apparatus and Image Forming Method—

Next, one embodiment for performing the image forming method of the present invention by the image forming apparatus of the present invention is described with reference to FIG. 15. An image forming apparatus 100 shown in FIG. 15 includes: a photoconductor drum 10 serving as the latent electrostatic image bearing member; a charging roller 20 serving as the charging unit; exposure 30 generated by an exposing device serving as the exposing unit; a developing device 40 serving as the developing unit; an intermediate transfer member 50; a cleaning blade 60 serving as the cleaning unit; and a charge eliminating lamp 70 serving as the charge eliminating unit.

The intermediate transfer member 50 is an endless belt designed to be movable in the direction indicated by an arrow in the drawing by three rollers 51. The rollers 51 are disposed inside the intermediate transfer member 50 to stretch the belt. Some of the three rollers 51 serve also as a transfer bias roller which is capable of applying a predetermined transfer bias (primary transfer bias) to the intermediate transfer member 50. A cleaning blade 90 for the intermediate transfer member 50 is disposed in the vicinity of the intermediate transfer member 50. Moreover, a transfer roller 80 is disposed facing the intermediate transfer member 50 to serve as the transferring unit which is capable of applying a transfer bias for transferring (secondary transfer) a visible image (toner image) to a recording medium 95. A corona charger 58 is disposed around the intermediate transfer member 50 to charge the visible image on the intermediate transfer member 50. Specifically, the corona charger 58 is located between a contact portion, which is between the latent electrostatic image bearing member 10 and the intermediate transfer member 50, and a contact portion, which is between the intermediate transfer member 50 and the recording medium 95, in the rotating direction of the intermediate transfer member 50.

The developing device includes: a developing belt 41 serving as the developer bearing member; and a black developing unit 45K, a yellow developing unit 45Y, a magenta developing unit 45M, and a cyan developing unit 45 C which are provided around the developing belt 41. The black developing unit 45K includes a developing agent container 42K, a developing agent feeding roller 43K, and a developing roller 44K The yellow developing unit 45Y includes a developing agent container 42Y, a developing agent feeding roller 43Y, and a developing roller 44Y. The magenta developing unit 45M includes a developing agent container 42M, a developing agent feeding roller 43M, and a developing roller 44M. The cyan developing unit 45C includes a developing agent container 42C, a developing agent feeding roller 43C, and a developing roller 44C. The developing belt 41 is an endless belt, which is rotatably stretched by a plurality of belt rollers, and part of the belt 41 contacts the latent electrostatic image bearing member 10.

Figure 15:
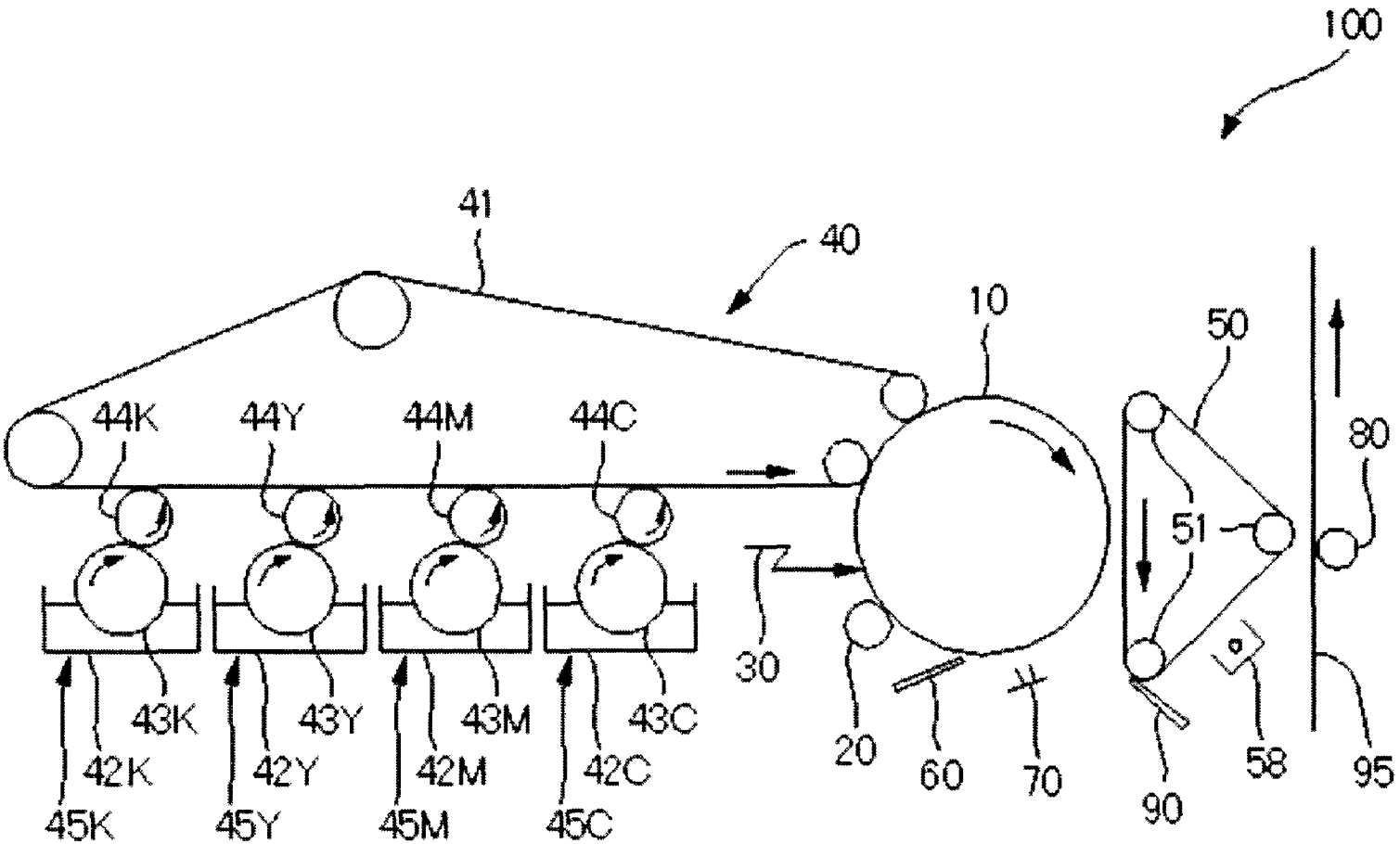
FIG. 15 is a schematic view showing an example of an image forming apparatus of the present invention.

In the image forming apparatus 100 shown in FIG. 15, the charging roller 20 charges the photoconductor drum 10 uniformly at first. The exposing device (not shown) applies imagewise exposure 30 on the photoconductor drum to form a latent electrostatic image. The latent electrostatic image formed on the photoconductor drum 10 is developed by feeding a toner from the developing device 40 to form a visible image. The visible image is transferred onto the intermediate transfer member 50 by a voltage applied from the rollers 51 (primary transfer). The visible image is further transferred onto the recording medium 95 (secondary transfer). As a result, a transferred image is formed on the recording medium 95. The residual toner on the latent electrostatic image bearing member 10 is removed by the cleaning blade 60, and the electric charge on the latent electrostatic image bearing member 10 is once removed by the charge eliminating lamp 70.

Figure 16:
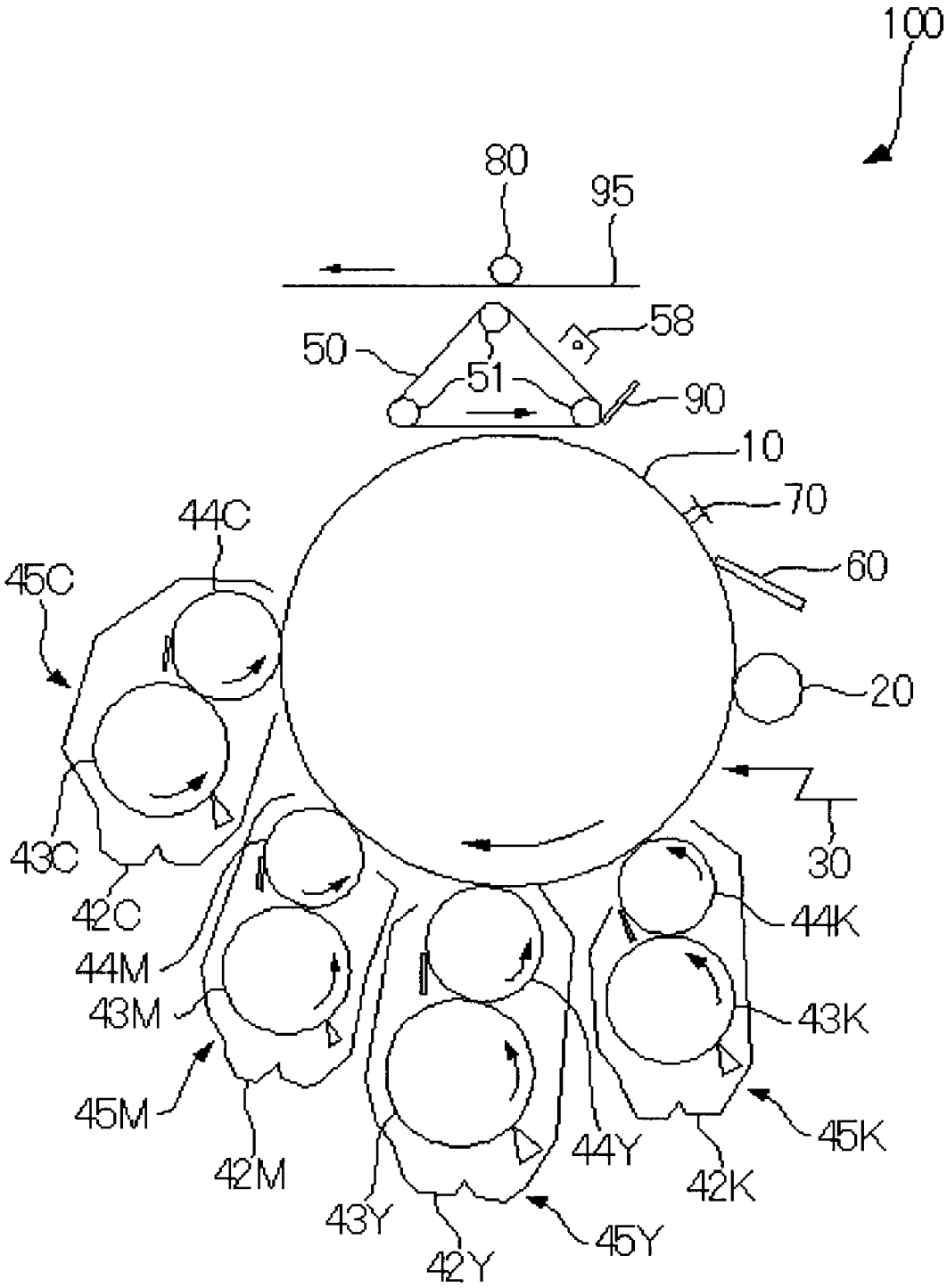
FIG. 16 is a schematic view showing another example of an image forming apparatus of the present invention.

Next, another embodiment for performing the image forming method of the present invention by the image forming apparatus of the present invention is described with reference to FIG. 16. An image forming apparatus 100 shown in FIG. 16 has a structure and effects similar to those of the image forming apparatus 100 shown in FIG. 15, except that the developing belt 41 serving as the developer bearing member is not provided and that the black developing unit 45K, the yellow developing unit 45Y, the magenta developing unit 45M, and the cyan developing unit 45 C are disposed to directly face the latent electrostatic image bearing member 10. In FIG. 16, the same reference numerals as in FIG. 15 denote the same parts.

—Tandem Image Forming Apparatus and Image Forming Method—

Figure 17:
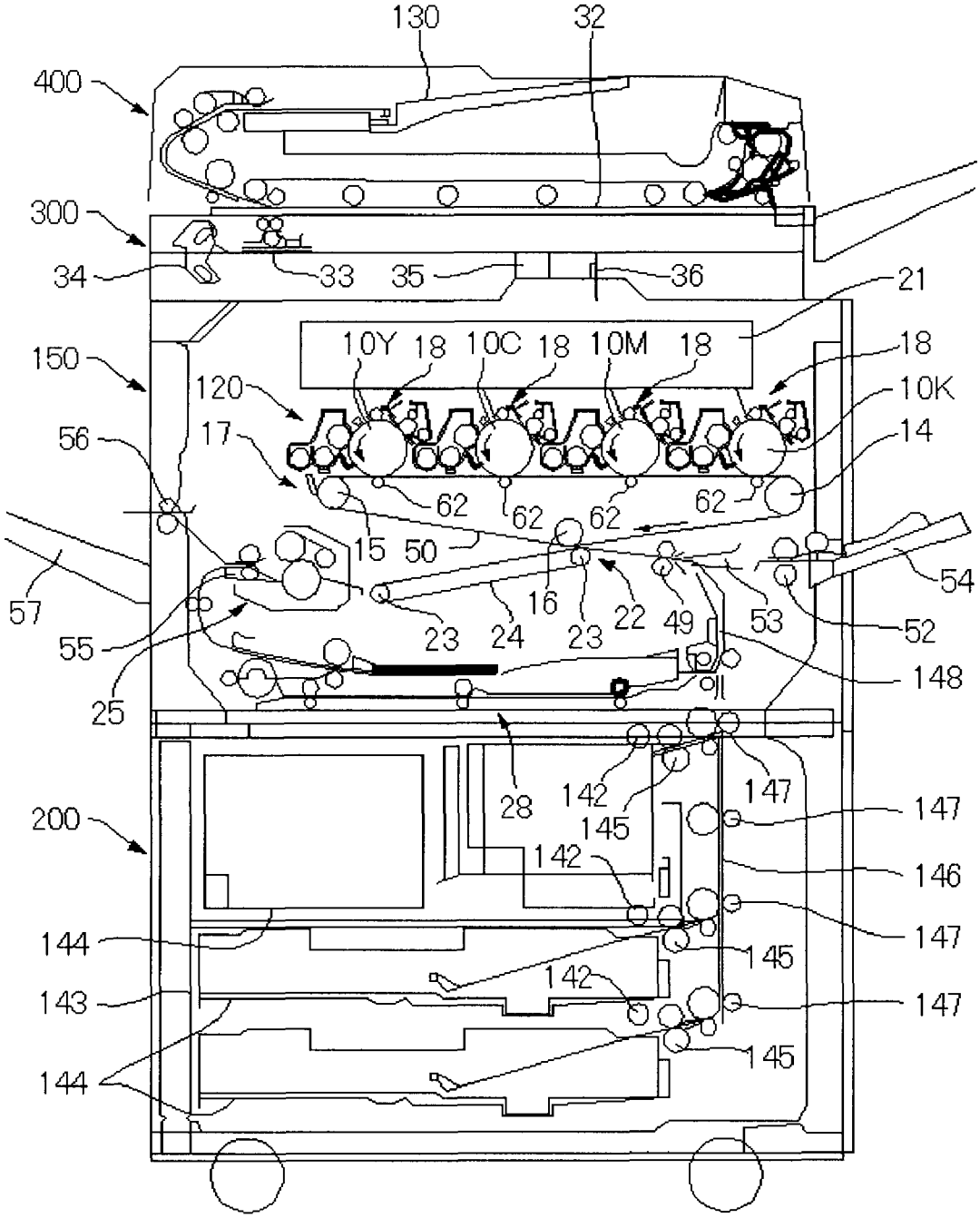
FIG. 17 is a schematic view showing an example of a tandem image forming apparatus of the present invention.

Next, still another embodiment for performing the image forming method of the present invention by the image forming apparatus of the present invention is described with reference to FIG. 17. A tandem image forming apparatus shown in FIG. 17 is a tandem color image forming apparatus. The tandem color image forming apparatus includes a copying device 150, a paper feeding table 200, a scanner 300, and an automatic document feeder (ADF) 400.

An intermediate transfer member 50, an endless belt, is provided in the center of the copying device 150. The intermediate transfer member 50 is stretched by support rollers 14, 15, and 16 so as to rotate clockwise in FIG. 17. A cleaning unit 17 for the intermediate transfer member 50 is disposed in the vicinity of the support roller 15 to remove the residual toner on the intermediate transfer member 50. A tandem developing unit 120 is disposed and includes four image forming units 18 for yellow, cyan, magenta, and black, which are aligned along the transporting direction of the intermediate transfer member 50 to face the intermediate transfer member stretched by the support roller 14 and the support roller 15. An exposing device 21 is disposed in the vicinity of the tandem developing unit 120. A secondary transferring unit 22 is disposed on a side opposite to a side where the tandem developing unit 120 is disposed, with respect to the intermediate transfer member 50. In the secondary transferring unit 22, a secondary transfer belt 24, an endless belt, is stretched by a pair of rollers 23 so that the recording medium transported on the secondary transfer belt 24 and the intermediate transfer member 50 can contact each other. A fixing device 25 is arranged in the vicinity of the secondary transferring unit 22.

An inverting device 28 is disposed in the vicinities of the secondary transferring unit 22 and the fixing device 25 to invert the recording medium to form images on both sides of the recording medium.

Next, full-color image (color copy) formation using the tandem developing unit 120 is described. First, an original is set on a stage 130 of the automatic document feeder (ADF) 400. Alternatively, an original is set on a contact glass 32 of the scanner 300 by opening the automatic document feeder 400, and the automatic document feeder 400 is closed.

When a start button (not shown) is pressed, the scanner 300 starts to operate after the original has been transported onto the contact glass 32 in the case where the original was set on the automatic document feeder 400. The scanner 300 starts to operate immediately when the original was set on the contact glass 32. Thereafter, a first carriage 33 and a second carriage 34 start to run. The light from the light source is applied by the first carriage 33, and the reflected light from the surface of the original is reflected on a mirror of the second carriage 34. The light is transmitted through a focusing lens 35 and received by a reading sensor 36 so that the color original (the color image) is read to generate black, yellow, magenta, and cyan image information.

Figure 18:
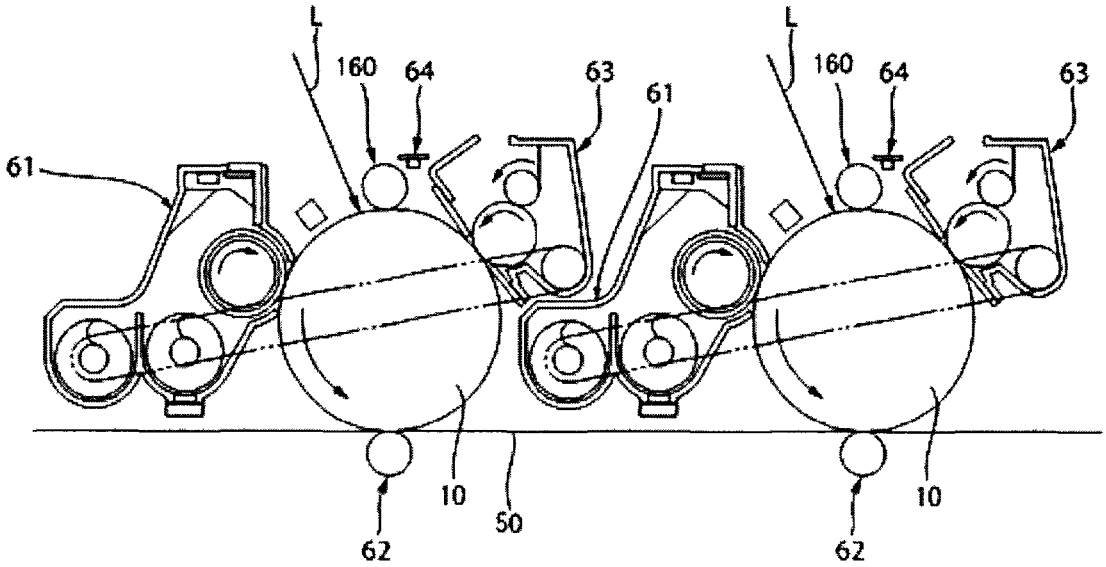
FIG. 18 is an enlarged view of each image forming element in FIG. 17.

Each piece of the black, yellow, magenta, and cyan image information is transmitted to the corresponding image forming units 18 (black image forming unit, yellow image forming unit, magenta image forming unit, and cyan image forming unit) of the tandem developing unit 120. Toner images of black, yellow, magenta, and cyan are formed in the corresponding image forming units. As shown in FIG. 18, each of the image forming units 18 (the black image forming unit, the yellow image forming unit, the magenta image forming unit, and the cyan image forming unit) of the tandem developing unit 120 includes: the latent electrostatic image bearing member 10 (a latent electrostatic image bearing member for black 10K a latent electrostatic image bearing member for yellow 10Y, a latent electrostatic image bearing member for magenta 10M, or a latent electrostatic image bearing member for cyan 10C); a charging device 160 for uniformly charging the latent electrostatic image bearing member 10; the exposing device which imagewisely radiates (L in FIG. 18) the latent electrostatic image bearing member of each color based on the image information on each color; a developing device 61 which develops the latent electrostatic image using the color toner (yellow toner, magenta toner, cyan toner, or black toner) and forms the toner image from the color toner; a transfer charger 62 for transferring the toner image onto the intermediate transfer member 50; a cleaning device 63; and a charge eliminating device 64. As a result, the monochrome images (a black image, a yellow image, a magenta image, and cyan image) can be formed based on the each color image information. The black image is formed on the latent electrostatic image bearing member for black 10K The yellow image is formed on the latent electrostatic image bearing member for yellow 10Y. The magenta image is formed on the latent electrostatic image bearing member for magenta 10M. The cyan image is formed on the latent electrostatic image bearing member for cyan 10C. Each of black image, the yellow image, the magenta image, and the cyan image is sequentially transferred (primary transfer) onto the intermediate transfer member 50 rotated by the support rollers 14, 15, and 16. The black image, the yellow image, the magenta image, and the cyan image are superposed on the intermediate transfer member 50 to form a synthetic color image (transferred color image).

In the paper feeding table 200, one of paper feed rollers 142 is selectively rotated to feed the recording medium from one of paper feed cassettes 144 provided in multiple stages in a paper bank 143. The recording medium is separated one by one by a separating roller 145 and sent to a paper feed passage 146. The recording medium is transported by transportation rollers 147 and led to a paper feed passage 148 within the copying device 150. The recording medium contacts a resist roller 49 to stop. Alternatively, the recording medium placed on a manual feed tray 54 is supplied by rotating the paper feed roller 142 and put into a manual paper feed passage 53 while being separated one by one by a separating roller 52. The recording medium contacts the resist roller 49 to stop. The resist roller 49 is usually grounded to be used. However, the resist roller 49 may be biased to be used in order to remove paper dust generated from the recording medium. The resist roller 49 is rotated in synchronization with the synthetic color image (transferred color image) synthesized on the intermediate transfer member 50 so that the recording medium is supplied to between the intermediate transfer member 50 and the secondary transferring unit 22. The synthetic color image (transferred color image) is transferred (secondary transfer) onto the recording medium by the secondary transferring unit 22. The color image is transferred and formed on the recording medium. The residual toner on the intermediate transfer member 50 is cleaned by the cleaning device 17 for the intermediate transfer member 50 after the image is transferred.

The recording medium, on which the color image is transferred and formed, is transported by the secondary transferring unit 22 to a fixing device 25. The synthetic color image (transferred color image) is fixed on the recording medium by heat and pressure in the fixing device 25. Thereafter, the passage is selected by a selector claw 55, and the recording medium is ejected by an ejecting roller 56 and stacked on a paper discharge tray 57. Alternatively, the passage is selected by the selector claw 55, and the recording medium is inverted by the inverting device 28. The recording medium is led to the transferring position again, where the image is formed on the back of the recording medium. Thereafter, the recording medium is ejected by the ejecting roller 56 and stacked on the paper discharge tray 57.

<Toner Container>

A toner container accommodates the toner or developer.

The container is not particularly limited and can be appropriately selected from known containers. For example, the container preferably includes a toner container and a cap.

The size, shape, structure and material of the toner container are not particularly limited and can be appropriately selected according to the purpose. For example, the shape is preferably cylindrical. More preferably, spiral unevenness is formed on the internal periphery; the toner, the content of the toner container, can be moved to an outlet by rotating the container; and part of or entire spiral portion has a bellow function.

The material of the toner container is not particularly limited and preferably has good dimensional accuracy. For example, resin is preferable. Examples of the preferable resin include a polyester resin, a polyethylene resin, a polypropylene resin, a polystyrene resin, a polyvinyl chloride resin, a polyacrylic resin, a polycarbonate resin, an ABS resin, and a polyacetal resin.

The toner container is easily preserved, transported, and handled. The toner container is suitably used to refill the toner by being detachably attached to the process cartridge or the image forming apparatus of the present invention.

(Process Cartridge)

The process cartridge of the present invention includes at least a latent electrostatic image bearing member and a developing unit. The latent electrostatic image bearing member bears a latent electrostatic image. The developing unit develops the latent electrostatic image formed on the latent electrostatic image bearing member with a toner to form a visible image. The process cartridge may further include other units optionally selected as necessary, such as a charging unit, an exposing unit, a transferring unit, a cleaning unit, and a charge eliminating unit.

The toner contains at least a binder resin and a colorant. The binder resin contains a polyester resin (A) and a polyester resin (B) which has a softening point 10° C. or more higher than that of the polyester resin (A).

The polyester resin (A) is a (meth)acrylic acid-modified rosin derived resin having a polyester unit obtained by polycondensation of an alcohol component and a carboxylic acid component. The alcohol component contains 65 mol % or more of 1,2-propanediol in a dihydric alcohol component, and the carboxylic acid component contains a (meth)acrylic acid-modified rosin.

The polyester resin (B) is a purified rosin derived resin having a polyester unit obtained by polycondensation of an alcohol component and a carboxylic acid component. The alcohol component contains a total of 70 mol % or more of 1,2-propanediol and 1,3-propanediol in a dihydric alcohol component, and the carboxylic acid component contains a purified rosin.

The aforementioned polyester resins (A) and (B) for the image forming apparatus and the image forming method can be used for the process cartridge.

The developing unit includes at least a developer container and a developer bearing member. The developer container contains the toner or the developer, and the developer bearing member bears and transports the toner of the developer contained in the developer container. The developing unit may further include a layer thickness regulating member and the like. The layer thickness regulating member regulates a thickness of a toner layer on the developer bearing member. Specifically, the aforementioned one-component developing unit or the two-component developing unit for the image forming apparatus and the image forming method can be preferably used.

Moreover, the aforementioned charging unit, the expositing unit, the transferring unit, the cleaning unit, and the charge eliminating unit for the image forming apparatus can be selectively used as necessary.

The process cartridge can be detachably provided for various electrophotographic image forming apparatus, facsimiles, and printers. It is particularly preferable that the process cartridge be detachably provided for the image forming apparatus of the present invention.

Figure 19:
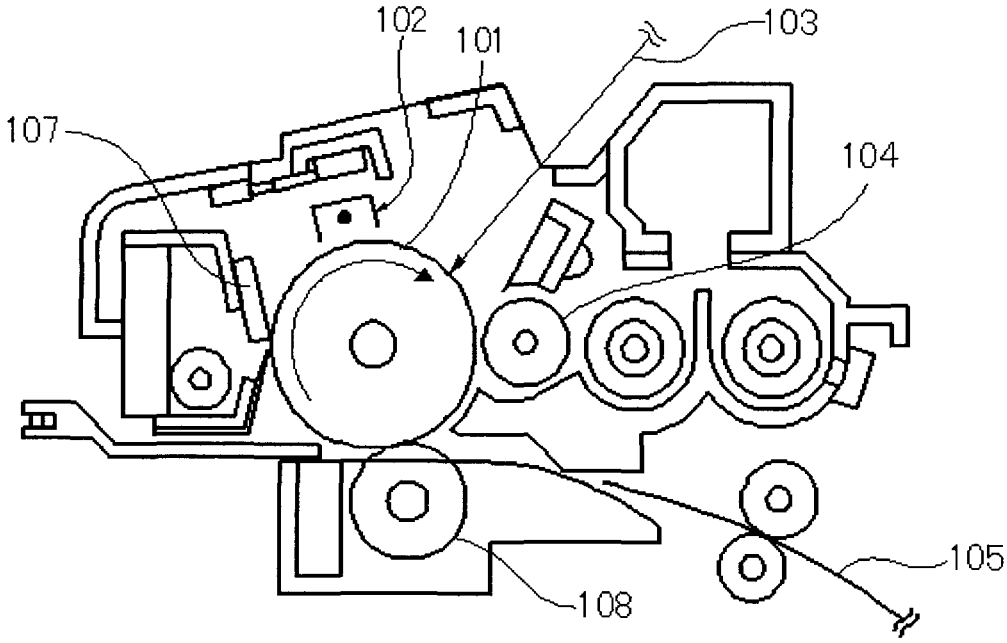
FIG. 19 is a schematic view showing an example of a process cartridge of the present invention.

As shown in FIG. 19, the process cartridge incorporates a latent electrostatic image bearing member 101 and includes a charging unit 102, a developing unit 104, a transferring unit 108, and a cleaning unit 107, for example. The process cartridge may farther include other units as necessary. In FIG. 19, the reference numeral 103 denotes exposure by an exposing unit, and the reference numeral 105 denotes a recording medium.

Next, an image forming process by the process cartridge shown in FIG. 19 is illustrated. While a latent electrostatic image bearing member 101 rotates in the direction indicated by the arrow, a latent electrostatic image corresponding to an exposed image is formed on the surface by charge applied by the charging unit 102 and the exposure 103 by the exposing unit (not shown). The latent electrostatic image is developed by the developing unit 104, and the obtained visible image is transferred onto the recording medium 105 by a transferring unit 108 and printed out. The surface of the latent electrostatic image bearing member 101 is cleaned by the cleaning unit 107, and the charge is eliminated by a charge eliminating unit (not shown) after the image is transferred. This operation is repeated again.

According to the present invention, the problems of the conventional image forming apparatus, image forming method, and a process cartridge can be overcome. Therefore, it is possible to provide an image forming apparatus, an image forming method, and a process cartridge, which employ a toner having excellent low-temperature fixing property, anti-offset property, storage stability, charging property, and anti-filming property and causing less odor, and are enabled to form an extremely high quality image without varying a color tone over long-term printing or abnormality such as decrease in density or a background smear.

EXAMPLES

In the following Examples and Comparative Examples, "softening point of resin," "softening point of rosin," "glass transition temperatures (Tg) of resin and rosin," "acid values of polyester resin and rosin," "hydroxyl value of resin," "amount of low molecular weight component with a molecular weight of 500 or less," "SP value of rosin," "(meth)acrylic acid modification degree of rosin," and "maximum endothermic peak of wax" were measured as described hereinafter.

<Measurement of Softening Point of Resin>

A sample was 1 g of a resin. Using Flow Tester (CFT-500D manufactured by Shimadzu Corporation), the resin was extruded from a nozzle having a diameter of 1 mm and a length of 1 mm by applying a load of 1.96 MPa with a plunger while the resin was heated at a temperature raising rate of 6° C./min. A fall amount of the plunger in Flow Tester with respect to the temperature was plotted, and the temperature, at which a half amount of the sample was flowed out, was taken as a softening point.

<Measurement of Softening Point of Rosin>

(1) Preparation of Sample

First, 10 g of a rosin was melted on a hot plate at 170° C. for 2 hours. In an opening state, the rosin was naturally cooled down for one hour under an environment of a temperature of 25° C. and a relative humidity of 50%. Subsequently, the rosin was pulverized by a coffee mill (National MK-61M) for 10 seconds to obtain a sample.

(2) Measurement

Using Flow Tester (CFT-500D manufactured by Shimadzu Corporation), 1 g of the sample was extruded from a nozzle having a diameter of 1 mm and a length of 1 mm by applying a load of 1.96 MPa with a plunger while the sample was heated at a temperature raising rate of 6° C./min. A fall amount of the plunger in Flow Tester with respect to the temperature was plotted, and the temperature, at which a half amount of the sample was flowed out, was taken as a softening point.

<Measurement of Glass Transition Temperatures (Tg) of Resin and Rosin>

Using a differential scanning calorimeter (DSC210 manufactured by Seiko Electronic Industry Co., Ltd), 0.01 g to 0.02 g of samples were weighed in an aluminum pan. The samples were heated to 200° C. and cooled down to 0° C. at a temperature falling rate of 10° C./min. The samples were heated at a temperature raising rate of 10° C./min. The temperature at an intersection of an extension line of a base line at temperature lower than maximum endothermic peak temperature and a tangent line showing a maximum slope from a rising slope of a peak to a top of a peak was taken as a glass transition temperature.

<Acid Values of Resin and Rosin>

Acid values were measured based on the method described in JIS K0070. Note that only a measuring solvent was changed from a mixed solvent of ethanol and ether defined in JIS K0070 to a mixed solvent of acetone and toluene (acetone:toluene=1:1 (volume ratio)).

<Hydroxyl Value of Resin>

A hydroxyl value was measured based on the method described in JIS K0070.

<Amount of Low Molecular Weight Component with Molecular Weight of 500 or Less>

Molecular weight distribution was measured by gel permeation chromatography (GPC). 10 ml of tetrahydrofuran was added to 30 mg of toner and mixed for one hour by a ball mill. The mixture was filtered using a fluororesin filter having a pore size of 2 μm (FP-200 manufactured by Sumitomo Electric Industries, Ltd.) to remove insoluble components, and a sample solution was prepared. Tetrahydrofuran, an eluent, was allowed to flow at a flow rate of 1 ml per minute, and a column was stabilized in a constant temperature bath at 40° C. 100 μl of the sample solution was added to the column, and the measurement was performed. "GMHLX+G3000HXL" (manufactured by Tosoh Corporation) was used as an analytical column, and a calibration curve of a molecular weight was obtained using several types of monodisperse polystyrenes ($2.63\times10^3$, $2.06\times10^4$, $1.02\times10^5$ manufactured by Tosoh Corporation, and $2.10\times10^3$, $7.00\times10^3$, $5.04\times10^4$ manufactured by GL Sciences Inc.) as standard samples.

The amount (%) of a low molecular weight component having a molecular weight of 500 or less was calculated based on a proportion of an area of the corresponding region in a chart area obtained by an RI (refractive index) detector to the entire chart area (Area of Corresponding Region/Entire Chart Area).

<SP Value of Rosin>

A melted sample 2.1 g was poured into a predetermined ring and cooled down to room temperature. The SP value was measured based on JIS B7410 under the following conditions.

Measuring Device: Automatic ring-and-ball softening point tester (ASP-MGK2, manufactured by Meitech Company, Ltd.)

Temperature Raising Rate: −5° C./min

Heating Initiation Temperature: 40° C.

Measuring Solvent: Glycerin

<Measurement of Modification Degree of (Meth)acrylic Acid-Modified Rosin>

The modification of the (Meth)acrylic acid-modified rosin was calculated by the following equation (1):

$$\text{Modification Degree of (Meth)acrylic Acid} = \frac{X_1 - Y}{X_2 - Y} \times 100 \quad \text{(Equation 1)}$$

In the equation (1), $X_1$ denotes an SP value of a (meth) acrylic acid-modified rosin to calculate the modification thereof, $X_2$ denotes a saturated SP value of a (meth)acrylic acid-modified rosin obtained by reacting 1 mol of (meth) acrylic acid with 1 mol of a rosin, and Y denotes an SP value of a rosin.

The saturated SP value means an SP value obtained when the reaction of the (meth)acrylic acid with the rosin is repeated until the SP value of the resulting (meth)acrylic acid-modified rosin reaches a saturation value. When an acid value is X (mg KOH/g), 1 g of the rosin is reacted with x mg ($X\times10^{-3}$ g) of potassium hydroxide (molecular weight: 56.1). Thus, a molecular weight of 1 mol of a rosin can be calculated by the equation, molecular weight=(56,100/X).

<Maximum Endothermic Peak of Wax>

Using differential scanning calorimeters (TA-60WS and DSC-60 Shimadzu Corporation) as DSC measuring equipment, the maximum endothermic peak of wax was obtained based on a measured DSC curve. The measurement was performed based on ASTM D3418-82. The DSC curve used herein was obtained by heating and cooling down the wax and heating the wax again at a temperature raising rate of 10° C./min.

Synthesis Example 1

—Purification of Rosin—

To a 2,000 ml volumetric distilling flask equipped with a distilling tube, a reflux condenser, and a receiver, 1,000 g of a tall rosin was added and distilled under a reduced pressure of 1 kPa to collect a distillate at 195° C. to 250° C. as a fraction. Hereinafter, a tall rosin subjected to purification is referred to as an unpurified rosin, and a rosin collected as the distillate is referred to as a purified rosin.

First, 20 g of each rosin was pulverized by a coffee mill (National MK-61M) for 5 seconds and sieved by a screen having an opening size of 1 mm. The rosin powder 0.5 g was added in a vial for head space (20 ml). After sampling a head space gas, impurities in an unpurified rosin and a purified rosin were analyzed in the following manner by head space GC-MS. The results are shown in Table 1.

<Measurement Conditions for Head Space GC-MS>

A. Head Space Sampler (HP7694 manufactured by Agilent Co.)

Sample Temperature: 200° C.
Loop Temperature: 200° C.
Transfer Line Temperature: 200° C.
Sample Heat Balance Time: 30 minutes
Vial Pressure Gas: Helium (He)
Vial Pressure Time: 0.3 minutes
Loop Filling Time: 0.03 minutes
Loop Equilibrium Time: 0.3 minutes
Injection Time: 1 minute B. GC (Gas Chromatography) (HP6890 manufactured by Agilent Co.)

Analytic Column: DB-1 (60 m−320 μm−5 μm)
Carrier: Helium (He)
Flow Conditions: 1 ml/min
Injection Inlet Temperature: 210° C.
Column Head Pressure: 34.2 kPa
Injection Mode: split
Split Ratio: 10:1
Oven Temperature Conditions: 45° C. (3 min)−10° C./min−280° C. (15 min)

C. MS (Mass Spectrometry) (HP5973 manufactured by Agilent Co.)

Ionization Method: EI (Electron Ionization)
Interface Temperature: 280° C.
Ion Source Temperature: 230° C.
Quadrupole Temperature: 150° C.
Detection Mode: Scan 29 m/s to 350 m/s

TABLE 1

| | Hexanoic Acid | Pentanoic Acid | Benzaldehyde | n-Hexanal | 2-Pentylfuran | SP Value (° C.) Softening Point (° C.) | Acid Value (mg KOH/g) | Molecular Weight per 1 mol |
|---|---|---|---|---|---|---|---|---|
| Unpurified Rosin | $0.9 \times 10^7$ | $0.6 \times 10^7$ | $0.6 \times 10^7$ | $1.8 \times 10^7$ | $1.1 \times 10^7$ | 77.0<br>74.3 | 169 | 332 |
| Purified Rosin | $0.4 \times 10^7$ | $0.2 \times 10^7$ | $0.2 \times 10^7$ | $1.4 \times 10^7$ | $0.7 \times 10^7$ | 76.8<br>75.1 | 166 | 338 |

<Measurement of Saturated SP Value of Acrylic Acid-Modified Rosin using Unpurified Rosin>

To a 1,000 ml volumetric flask equipped with a distilling tube, a reflux condenser, and a receiver, 332 g (1 mol) of an unpurified rosin (SP value: 77.0° C. and 72 g (1 mol) of acrylic acid were added. After heating from 160° C. to 230° C. for 8 hours, it was confirmed that the SP value did not increase at 230° C. The unreacted acrylic acid and a low boiling point substance were distilled off under a reduced pressure of 5.3 kPa to obtain an acrylic acid-modified rosin. The SP value of the obtained acrylic acid-modified rosin, in other words, a saturated SP value of an acrylic acid-modified rosin using an unpurified rosin was 110.1° C.

<Measurement of Saturated SP Value of Acrylic Acid-Modified Rosin using Purified Rosin>

To a 1,000 ml volumetric flask equipped with a distilling tube, a reflux condenser, and a receiver, 338 g (1 mol) of a purified rosin (SP value: 76.8° C.) and 72 g (1 mol) of acrylic acid were added. After heating from 160° C. to 230° C. for 8 hours, it was confirmed that the SP value did not increase at 230° C. The unreacted acrylic acid and a low boiling point substance were distilled off under a reduced pressure of 5.3 kPa to obtain an acrylic acid-modified rosin. The SP value of the obtained acrylic acid-modified rosin, in other words, a saturated SP value of an acrylic acid-modified rosin using a purified rosin was 110.4° C.

Synthesis Example 2

—Synthesis of Acrylic Acid-Modified Rosin A—

To a 10 L volumetric flask equipped with a distilling tube, a reflux condenser, and a receiver, 6,084 g (18 mol) of a purified rosin (SP value: 76.8° C.) and 907.9 g (12.6 mol) of acrylic acid were added. After heating from 160° C. to 220° C. for 8 hours, the reaction was performed at 220° C. for 2 hours. Distillation was performed under a reduced pressure of 5.3 kPa at 220° C. to obtain an acrylic acid-modified rosin A. The SP value, glass transition temperature, and modification degree of the obtained acrylic acid-modified rosin A were 110.4° C., 57.1° C., and 100, respectively.

Synthesis Example 3

—Synthesis of Acrylic Acid-Modified Rosin B—

To a 10 L volumetric flask equipped with a distilling tube, a reflux condenser, and a receiver, 6,084 g (18 mol) of a purified rosin (SP value: 76.8° C.) and 648.5 g (9.0 mol) of acrylic acid were added. After heating from 160° C. to 220° C. for 8 hours, the reaction was performed at 220° C. for 2 hours. Distillation was performed under a reduced pressure of 5.3 kPa at 220° C. to obtain an acrylic acid-modified rosin B. The SP value, glass transition temperature, and modification degree of the obtained acrylic acid-modified rosin B were 99.1° C., 53.2° C., and 66, respectively.

<Synthesis of Polyester Resin>

An alcohol component, a carboxylic acid component except trimellitic anhydride, and an esterifying catalyst, which are shown in Tables 2 and 3, were added to a 5 liter volumetric four-necked flask equipped with a nitrogen introducing tube, a dewatering tube, a stirrer, and a thermocouple. Polycondensation was performed under a nitrogen atmosphere at 230° C. for 10 hours, and the reaction was performed at 230° C. under 8 kPa for one hour. After the mixture was cooled down to 220° C., each trimellitic anhydride shown in Tables 2 and 3 was added, and the reaction was performed under a normal pressure (101 kPa) for one hour. The reaction was performed at 220° C. under 20 kPa until the temperature reached a desired softening point. Consequently, polyester resins L1 to L7 and H1 to H7 were synthesized.

TABLE 2

| | Resin L1 | Resin L2 | Resin L3 | Resin L4 | Resin L5 | Resin L6 | Resin L7 |
|---|---|---|---|---|---|---|---|
| Alcohol Component | | | | | | | |
| 1,3-Propanediol | 399 g | — | — | — | — | — | 457 g |
| 1,2-Propanediol | 742 g | 1,141 g | 1,141 g | 1,141 g | 1,141 g | 1,141 g | 685 g |
| Carboxylic Acid Component | | | | | | | |
| Terephthalic Acid | 1,744 g | 1,495 g | 1,495 g | 1,495 g | 1,495 g | 1,495 g | 1,744 g |
| Trimellitic Anhydride | 288 g | 288 g | 288 g | 288 g | 288 g | 288 g | 288 g |
| Acrylic Acid-Modified Rosin A | 562 g | 1124 g | — | 1124 g | — | — | 562 g |
| Acrylic Acid-Modified Rosin B | — | — | 1,124 g | — | — | — | — |
| Purified Rosin | — | — | — | — | 907 g | — | — |
| Esterifying Catalyst | | | | | | | |
| Tin(II) 2-Ethylhexanoate | 19 g | 20 g | 20 g | 20 g | 19 g | 15 g | 19 g |
| Amount of Rosin in Carboxylic Acid Component (wt %) | 21.7 | 38.7 | 38.7 | 38.7 | 33.7 | 0.0 | 21.7 |
| Amount of 1,2-Propanediol in Alcohol Component | 65 | 100 | 100 | 100 | 100 | 100 | 60 |

TABLE 2-continued

| | Resin L1 | Resin L2 | Resin L3 | Resin L4 | Resin L5 | Resin L6 | Resin L7 |
|---|---|---|---|---|---|---|---|
| Resin Properties | | | | | | | |
| Softening Point (° C.) | 107.6 | 109.2 | 108.1 | 101.1 | 107.9 | 102.7 | 105.2 |
| Glass Transition Point (° C.) | 59.3 | 61.5 | 58.7 | 61.3 | 57.6 | 56.0 | 59.3 |
| Acid Value (mg KOH/g) | 40.5 | 42.2 | 35.8 | 41.6 | 31.7 | 43.1 | 40.0 |

TABLE 3

| | Resin H1 | Resin H2 | Resin H3 | Resin H4 | Resin H5 | Resin H6 | Resin H7 |
|---|---|---|---|---|---|---|---|
| Alcohol Component | | | | | | | |
| 1,3-Propanediol | 114 g | 228 g | 228 g | 228 g | — | 228 g | 114 g |
| 1,2-Propanediol | 799 g | 913 g | 913 g | 913 g | 1,141 g | 913 g | 628 g |
| 2,3-butanediol | 135 g | — | — | — | — | — | 473 g |
| Glycerin | 276 g | — | — | — | — | — | — |
| Carboxylic Acid Component | | | | | | | |
| Terephthalic Acid | 1,744 g | 1,744 g | 1,744 g | 1,744 g | 1,744 g | 1,744 g | 1,744 g |
| Trimellitic Anhydride | 288 g | 288 g | 288 g | 288 g | 288 g | 288 g | 288 g |
| Acrylic Acid-Modified Rosin A | — | — | 1,124 g | — | — | — | — |
| Purified Rosin | 907 g | 907 g | — | — | 907 g | 907 g | 907 g |
| Esterifying Catalyst | | | | | | | |
| Tin(II) 2-Ethylhexanoate | 21 g | 20 g | 21 g | 16 g | 20 g | 20 g | 21 g |
| Amount of Rosin in Carboxylic Acid Component (wt %) | 30.9 | 30.9 | 35.6 | 0.0 | 30.9 | 30.9 | 30.9 |
| Amount of 1,2-Propanediol and 1,3-Propanediol in Alochol Component (mol %) | 73 | 100 | 100 | 100 | 100 | 100 | 65 |
| Molar Ratio (1,2-Propanediol/1,3-Propanediol) | 87/13 | 80/20 | 80/20 | 80/20 | 100/0 | 80/20 | 85/15 |
| Resin Properties | | | | | | | |
| Softening Point (° C.) | 150.5 | 144.5 | 151.1 | 142.8 | 146.9 | 116.8 | 144.4 |
| Glass Transition Point (° C.) | 62.1 | 61.0 | 62.7 | 56.7 | 62.1 | 58.0 | 60.8 |
| Acid Value (mg KOH/g) | 31.2 | 32.4 | 40.2 | 42.3 | 42.9 | 30.9 | 31.4 |

<Synthesis of Hybrid Resin>

To a 5 liter volumetric four-necked flask equipped with a nitrogen introducing tube, a dewatering tube, a stirrer, a dropping funnel, and a thermocouple, 748 g of terephthalic acid, 144 g of trimellitic anhydride, 1,808 g of bisphenol A (2, 2) propylene oxide, 712 g of bisphenol A (2, 2) ethyleneoxide (all of them are polycondensation monomers), and 17 g of dibutyltin oxide (esterifying catalyst) were added. To the dropping funnel, 937 g of styrene, 32 g of acrylic acid, 193 g of 2-ethylhexylacrylate (all of them are addition polymerization monomers), and 58 g of t-butylhydroperoxide (a polymerization initiator) were added. The mixture of the addition polymerization was dropped for 5 hours while being stirred under a nitrogen atmosphere at 135° C. The reaction was performed at 135° C. for 6 hours. The mixture was heated to 210° C. in 3 hours, and the reaction was performed at 210° C. under 10 kPa until the temperature reached a desired softening point. Consequently, a hybrid resin (HB1) was synthesized.

The softening point, glass transition temperature, and acid value of the obtained hybrid resin (HB1) were 115.0° C., 57.7° C., 18.1 mg KOH/g, respectively.

Production Example 1

—Preparation of Masterbatch 1—

A pigment with the following composition, a polyester resin L1, and pure water were mixed in a ratio (mass ratio) of 1:1:0.5 and kneaded by a twin roller. Kneading was performed at 70° C., and water was evaporated by raising the roller temperature to 120° C. to prepare a masterbatch 1 (MB-1), including a cyan toner masterbatch 1 (MB-C1), a magenta toner masterbatch 1 (MB-M1), a yellow toner masterbatch 1 (MB-Y1), and a black toner masterbatch 1 (MB-K1).

[Formulation of Cyan Toner Masterbatch 1 (MB-C1)]

Polyester Resin L1: 100 parts by mass

Cyan Pigment (C.I. Pigment Blue 15:3): 100 parts by mass

Pure Water: 50 parts by mass

[Formulation of Magenta Toner Masterbatch 1 (MB-M1)]

Polyester Resin L1: 100 parts by mass

Magenta Pigment (C.I. Pigment Red 122): 100 parts by mass

Pure Water: 50 parts by mass

[Formulation of Yellow Toner Masterbatch 1 (MB-Y1)]

Polyester Resin L1: 100 parts by mass

Yellow Pigment (C.I. Pigment Yellow 180): 100 parts by mass

Pure Water: 50 parts by mass

[Formulation of Black Toner Masterbatch 1 (MB-K1)]

Polyester Resin L1: 100 parts by mass

Black Pigment (Carbon Black): 100 parts by mass

Pure Water: 50 parts by mass

Production Example 2

—Preparation of Masterbatch 2—

A masterbatch 2 (MB-2), including a cyan toner masterbatch 2 (MB-C2), a magenta toner masterbatch 2 (MB-M2), a yellow toner masterbatch 2 (MB-Y2), and a black toner masterbatch 2 (MB-K2), was prepared in the same manner as in Production Example 1, except that the polyester resin L1 was replaced with the polyester resin L2.

Production Example 3

—Preparation of Masterbatch 3—

A masterbatch 3 (MB-3), including a cyan toner masterbatch 3 (MB-C3), a magenta toner masterbatch 3 (MB-M3), a yellow toner masterbatch 3 (MB-Y3), and a black toner masterbatch 3 (MB-K3), was prepared in the same manner as in Production Example 1, except that the polyester resin L1 was replaced with the polyester resin L3.

Production Example 4

—Preparation of Masterbatch 4—

A masterbatch 4 (MB-4), including a cyan toner masterbatch 4 (MB-C4), a magenta toner masterbatch 4 (MB-M4), a yellow toner masterbatch 4 (MB-Y4), and a black toner masterbatch 4 (MB-K4), was prepared in the same manner as in Production Example 1, except that the polyester resin L1 was replaced with the polyester resin L4.

Production Example 5

—Preparation of Masterbatch 5—

A masterbatch 5 (MB-5), including a cyan toner masterbatch 5 (MB-C5), a magenta toner masterbatch 5 (MB-M5), a yellow toner masterbatch 5 (MB-Y5), and a black toner masterbatch 5 (MB-K5), was prepared in the same manner as in Production Example 1, except that the polyester resin L1 was replaced with the polyester resin L5.

Production Example 6

—Preparation of Masterbatch 6—

A masterbatch 6 (MB-6), including a cyan toner masterbatch 6 (MB-C6), a magenta toner masterbatch 6 (MB-M6), a yellow toner masterbatch 6 (MB-Y6), and a black toner masterbatch 6 (MB-K6), was prepared in the same manner as in Production Example 1, except that the polyester resin L1 was replaced with the polyester resin L6.

Production Example 7

—Preparation of Masterbatch 7—

A masterbatch 7 (MB-7), including a cyan toner masterbatch 7 (MB-C7), a magenta toner masterbatch 7 (MB-M7), a yellow toner masterbatch 7 (MB-Y7), and a black toner masterbatch 7 (MB-K7), was prepared in the same manner as in Production Example 1, except that the polyester resin L1 was replaced with the polyester resin L7.

Production Example 8

<Preparation of Toner 1>

A toner 1, including a cyan toner 1, a magenta toner 1, a yellow toner 1 and a black toner 1, was prepared as described hereinafter.

—Production of Cyan Toner 1—

A binder resin, a releasing agent, and a cyan toner masterbatch (one of masterbatches of four colors), which are materials of the toner 1 shown in Table 4, were premixed by a HENSCHEL MIXER (FM10B manufactured by Mitsui Miike Machinery Co., Ltd.) in proportions specified in Table 4. The mixture was melted and kneaded by a TWIN SCREW EXTRUDER (PCM-30 manufactured by Ikegai Corporation) at a temperature from 100° C. to 130° C. The kneaded mixture was cooled down to room temperature and roughly pulverized into 200 μm to 300 μm by a hammer mill. Subsequently, the obtained particles were finely pulverized by a supersonic jet pulverizer (RABOJET manufactured by Nippon Pneumatic Industry Co., Ltd.) so that weight average particle diameter became 6.2±0.3 μm while a pulverizing air pressure was appropriately adjusted. The particles were classified by an air classifier (MDS-I manufactured by Nippon Pneumatic Industry Co., Ltd.,) to obtain toner base particles having a weight average particle diameter of 7 μm±0.2 μm and 10% by number of fine particles of 4 μm or less while a louver opening was appropriately adjusted. Thereafter, 100 parts by mass of the toner base particles and 1.0 part by mass of an additive (HDK-2000 manufactured by Clariant Co., Ltd.) were stirred and mixed by a HENSCHEL MIXER to manufacture a cyan toner 1. A difference (ΔTm) between Tm (A) and Tm (B), which are respective softening points of the polyester resins (A) and (B) used to obtained the toner, is shown in Table 4.

—Production of Magenta Toner 1—

A magenta toner 1 was produced in the same manner as in the production method of the cyan toner 1, except that a magenta toner masterbatch was used instead of the cyan toner masterbatch (one of the masterbatches used as a material for the toner 1 shown in Table 4) in proportions shown in Table 4.

—Production of Yellow Toner 1—

A yellow toner 1 was produced in the same manner as in the production method of the cyan toner 1, except that a yellow toner masterbatch was used instead of the cyan toner masterbatch (one of the masterbatches used as a material for the toner 1 shown in Table 4) in proportions shown in Table 4.

—Production of Black Toner 1—

A black toner 1 was produced in the same manner as in the production method of the cyan toner 1, except that a black toner masterbatch was used instead of the cyan toner masterbatch (one of the masterbatches used as a material for the toner 1 shown in Table 4) in proportions shown in Table 4.

Production Examples 9 to 22

<Production of Toners 2 to 14>

Toners 2 to 14, each including cyan toners 2 to 14, magenta toners 2 to 14, yellow toners 2 to 14, and black toners 2 to 14, were produced in the same manner as in Production Example of Toner 1, in proportions and a combination of the materials shown in Table 4.

TABLE 4

| | Material | | | | | |
|---|---|---|---|---|---|---|
| | Binder Resin | | | | | |
| | Polyester Resin (A) | Polyester Resin (B) | Hybrid Resin | Releasing Agent | Masterbatch | Δ Tm (° C.) |
| Toner 1 | L1(40) | H1(50) | — | W1(5) | MB-1(20) | 43 |
| Toner 2 | L2(40) | H2(50) | — | W1(5) | MB-2(20) | 35 |

TABLE 4-continued

| | Material | | | | | |
|---|---|---|---|---|---|---|
| | Binder Resin | | | | | |
| | Polyester Resin (A) | Polyester Resin (B) | Hybrid Resin | Releasing Agent | Masterbatch | Δ Tm (° C.) |
| Toner 3 | L3(40) | H2(50) | — | W1(5) | MB-3(20) | 36 |
| Toner 4 | L2(35) | H2(45) | HB1(10) | W1(5) | MB-2(20) | 35 |
| Toner 5 | L4(40) | H6(50) | — | W1(5) | MB-3(20) | 13 |
| Toner 6 | L2(35) | H2(45) | HB1(10) | W2(5) | MB-2(20) | 35 |
| Toner 7 | L2(40) | H3(50) | — | W1(5) | MB-2(20) | 42 |
| Toner 8 | L2(40) | H4(50) | — | W1(5) | MB-2(20) | 34 |
| Toner 9 | L2(40) | H5(50) | — | W1(5) | MB-2(20) | 38 |
| Toner 10 | L2(40) | H6(50) | — | W1(5) | MB-2(20) | 8 |
| Toner 11 | L2(40) | H7(50) | — | W1(5) | MB-2(20) | 35 |
| Toner 12 | L5(40) | H2(50) | — | W1(5) | MB-2(20) | 37 |
| Toner 13 | L6(40) | H2(50) | — | W1(5) | MB-2(20) | 42 |
| Toner 14 | L7(40) | H2(50) | — | W1(5) | MB-2(20) | 37 |

*In Table 4, a value in a bracket indicates a proportion (parts by mass)

*A releasing agent W1 in Table 4 is paraffin wax (HNP-9PD manufactured by Nippon Seiro Co., Ltd., melting point: 76.1° C.), and a releasing agent W2 is de-free fatty acid carnauba wax (WA-03 manufactured by Toakasei Co., Ltd, melting point: 82.8° C.).

—Evaluation of Toner Properties—

The obtained toners 1 to 14 were evaluated in terms of their pulverizability, thermal resistance and storage stability, and odor as described hereinafter. The results are shown in Table 5.

<Pulverizability of Toner>

The melted and kneaded mixtures of the combinations of resins shown in Table 4, which were used as binder resins in Examples and Comparative Examples, were roughly pulverized by a hammer mill so that the particle diameter became 200 μm to 300 μm. 10.00 g of the particles were weighed and pulverized for 30 seconds by a mill&mixer MM-I (manufactured by Hitachi Living Systems) and sieved by a screen having 30 mesh (opening: 500 μm). A mass (A) of the resin which did not pass through the screen was measured, and a residual ratio was obtained by the following expression (i). This sequence of the operations was repeated three times. An average value of the average residual ratio was used as an index, and the pulverizability of the toner was evaluated based on the following criteria. The smaller the average value of the residual ratio, the better the pulverizability of the toner.

(Expression (i))

$$\text{Residual Ratio}=[(A)/\text{Resin Mass before Pulverization (10.00 g)}]\times 100$$

[Evaluation Criteria]

A: Residual ratio was less than 5%

B: Residual ratio was 5% or more and less than 10%

C: Residual ratio was 10% or more and less than 15%

D: Residual ratio was 15% or more and less than 20%

E: Residual ratio was 20% or more

<Thermal Resistance and Storage Stability of Toner>

The thermal resistance and storage stability were measured by a penetration tester (manufactured by Nikka Engineering Co., Ltd.). Specifically, 10 g of each toner was added to a 30 ml glass container (screw vial) under an environment of a temperature 20° C. to 25° C. and a relative humidity (RH) of 40% to 60%, and the glass container was covered with a lid. The glass container with the toner contained therein was tapped 100 times and left in a constant temperature bath for 24 hours at a temperature of 50° C. The penetration was measured by the penetration tester, and the thermal resistance and storage stability were evaluated based on the following criteria. The larger the penetration, the better the thermal resistance and storage stability. The worst result among the results of four colors was used for the evaluation.

[Evaluation Criteria]

A: Penetration was 30 mm or more

B: Penetration was from 20 mm to 29 mm

C: Penetration was from 15 mm to 19 mm

D: Penetration was from 8 mm to 14 mm

E: Penetration was 7 mm or less

<Odor of Toner>

In an aluminum cup (FM-409 (the body) manufactured by Teraoka Corporation), 20 g of each toner was placed. The aluminum cup was stood still for 30 minutes on a hot plate that had been heated to 150° C., and odor generated from the toner was evaluated based on the following evaluation criteria.

[Evaluation Criteria]

A: No Odor

B: Almost No Odor

C: Slight odor, but the toner can be practically used

D: Strong odor

TABLE 5

| | Pulverization | Thermal Resistance and Storage Stability | Odor |
|---|---|---|---|
| Toner 1 | A | B | A |
| Toner 2 | A | A | A |
| Toner 3 | A | B | A |
| Toner 4 | A | A | A |
| Toner 5 | A | B | A |
| Toner 6 | A | A | A |
| Toner 7 | A | D | A |
| Toner 8 | B | D | D |
| Toner 9 | B | B | A |
| Toner 10 | A | D | A |
| Toner 11 | B | B | A |
| Toner 12 | A | D | A |
| Toner 13 | B | E | D |
| Toner 14 | C | B | A |

Examples 1 to 5 and Comparative Examples 1 to 8

—Image Formation and Evaluation—

Figure 20:
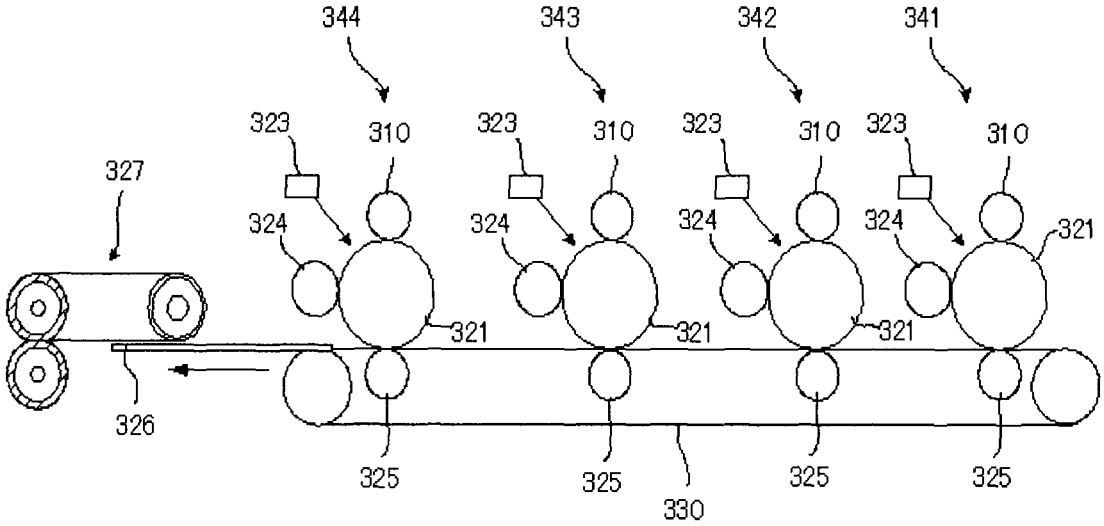
FIG. 20 is a schematic view showing an image forming apparatus A used in Examples.

Each of the toners 1 to 5 and 7 to 14 thus prepared was loaded into an image forming apparatus A shown in FIG. 20, and an image was formed. Various properties were evaluated as described hereinafter. The results are shown in Table 6.

<Image Forming Apparatus A>

An image forming apparatus A shown in FIG. 20 is a tandem image forming apparatus of a direct transferring system, which employs a contact charging system, a one-component developing system, a direct transferring system, a cleanerless system, and an internal heating belt fixing system.

In the image forming apparatus A shown in FIG. 20, a contact charging roller as shown in FIG. 1 is used as a charging unit 310. A one-component developing apparatus as shown in FIG. 5 is used as a developing unit 324, and this developing apparatus employs a cleanerless system capable of collecting the residual toner. A belt fixing device as shown in FIG. 9 is employed as a fixing unit 327, and this fixing device employs a halogen lamp as a heat source for a heat roller. In FIG. 20, the reference numeral 330 denotes a conveyance belt.

A charging unit 310, an exposing unit 323, a developing unit 324, and a transferring unit 325 are disposed around a photoconductor drum 321 of an image forming element 341 in the image forming apparatus A shown in FIG. 20. The surface of the photoconductor drum 321 is charged by the charging unit 310 and exposed by the exposing unit 323 as the photoconductor drum 321 of the image forming element 341 rotates. Accordingly, a latent electrostatic image corresponding to an exposed image is formed on the surface of the photoconductor drum 321. This latent electrostatic image is developed with a yellow toner by the developing unit 324 to form a visible image on the photoconductor drum 321 by the yellow toner. This visible image is transferred onto a recording medium 326 by the transferring unit 325, and the residual toner on the photoconductor drum 321 is collected by the developing unit 324. Similarly, visible images of a magenta toner, a cyan toner, and a black toner are superimposed on the recording medium 326 by corresponding image forming elements 342, 343, and 344. The color image formed on the recording medium 326 is fixed by a fixing unit 327.

<Fixing Property>

—Low-Temperature Fixing Property—

Using the image forming apparatus A, a monochrome solid image was formed on thick transfer paper (copying paper <135>manufactured by NBS Ricoh Co., Ltd.) with an amount of toner adhesion of 0.85 mg/cm$^2$±0.1 mg/cm$^2$ by each color of black, cyan, magenta, and yellow. A temperature of a fixing belt was adjusted to perform the fixing. The surface of the obtained fixed image was painted by a drawing tester (AD-401 manufactured by Ueshima Seisakusho Co., Ltd) with a ruby needle (tip radius: 260 μm to 320 μm, tip angle: 60°) and a load of 50 g. The painted surface was strongly rubbed 5 times with a fiber (HONEYCOT #440 manufactured by Hanylon Co., Ltd.), and a fixing temperature at which the image was hardly scraped was obtained as the minimum fixing temperature. The low-temperature fixing property was evaluated based on the following criteria. The solid image was formed on the transfer paper at 3.0 cm apart from the tip in a transport direction. The worst result among the results of four colors was used for the evaluation.

[Evaluation Criteria]

A: Minimum fixing temperature was 120° C. or less

B: Minimum fixing temperature was 121° C. or more and 130° C. or less

C: Minimum fixing temperature was 131° C. or more and 145° C. or less

D: Minimum fixing temperature was 146° C. or more and 155° C. or less

E: Minimum fixing temperature was 156° C. or more

<Anti-Hot Offset Property>

Using the image forming apparatus A, a monochrome solid image was formed on standard transfer paper (Type 6200 manufactured by Ricoh Co., Ltd.) with an amount of toner adhesion of 0.85 mg/cm$^2$±0.1 mg/cm$^2$ by each color of black, cyan, magenta, and yellow. A temperature of a fixing belt was adjusted to perform a fixing test. Presence of hot offset was evaluated by visual observation. The maximum temperature at which hot offset did not occur was obtained as the maximum fixing temperature, and the anti-offset property was evaluated based on the following criteria. The solid image was formed on the transfer paper at 3.0 cm apart from the tip in a transport direction. The worst result among the results of four colors was used for the evaluation.

[Evaluation Criteria]

A: Maximum fixing temperature was 230° C. or more

B: Maximum fixing temperature was 210° C. or more and less than 230° C.

C: Maximum fixing temperature was 190° C. or more and less than 210° C.

D: Maximum fixing temperature was 180° C. or more and less than 190° C.

E: Maximum fixing temperature was less than 180° C.

<Initial Image Quality>

Using the image forming apparatus A, an image evaluation chart was output in full-color mode. Initial image quality was evaluated in terms of a change in color tone (hue) and presence of fog, image density, and fading. Presence of abnormality and image quality were evaluated by visual observation into five stages.

[Evaluation Criteria]

A: Image abnormality was not observed: Excellent

B: Compared with the original, a color tone and image density were slightly different, and a background smear was slightly observed. However, it can be practically used: Good C: Color tone and image density were different, and a background smear was observed D: Changes in color tone and image density and a background smear were clearly observed E: Changes in color tone and image density and a background smear were greatly clearly observed, and a normal image cannot be obtained.

<Stability Over Time>

Using the image forming apparatus A, 50,000 sheets of an image chart of an 80% image area (20% image area for each color) were output in full-color mode. Thereafter, evaluation was performed in the same manner as the initial image quality. The images were compared with the initial images and evaluated based on the following criteria

[Evaluation Criteria]

A: Image abnormality was not observed: Excellent

B: Compared with the original, a color tone and image density were slightly different, and a background smear was slightly observed. However, it can be practically used: Good C: Color tone and image density were different, and a background smear was observed D: Changes in color tone and image density and a background smear were clearly observed E: Changes in color tone and image density and a background smear were greatly clearly observed, and a normal image cannot be obtained.

Examples 6 to 8

—Preparation of Carrier—

A coating material having the following composition was dispersed by a stirrer for 10 minutes to prepare a coating solution. This coating solution and 5,000 parts by mass of a core material (Cu—Zn ferrite particles, weight average particle diameter=35 μm) were added in a coating device. The coating device, which includes a rotary bottom plate disc and a stirring blade disc provided in the fluidized bed and performs coating while forming a spinning stream. The coating solution was applied to a core material. The obtained coated core material was baked in an electric furnace at 250° C. for 2 hours to prepare a carrier.

[Composition of Coating Material]

Toluene: 450 parts by mass

Silicone resin (SR2400 manufactured by Dow Corning Toray Silicon Co., Ltd., nonvolatile content: 50% by mass): 450 parts Aminosilane (SH6020 manufactured by Dow Corning Toray Silicon Co., Ltd.): 10 parts by mass Carbon black: 10 parts by mass —Preparation of Two-Component Developer—

Two-component developers were prepared by a normal method using 5% by mass of the toners 2, 4, and 6 to 8 thus prepared and 95% by mass of the carrier thus prepared.

—Image Formation and Evaluation—

Figure 21:
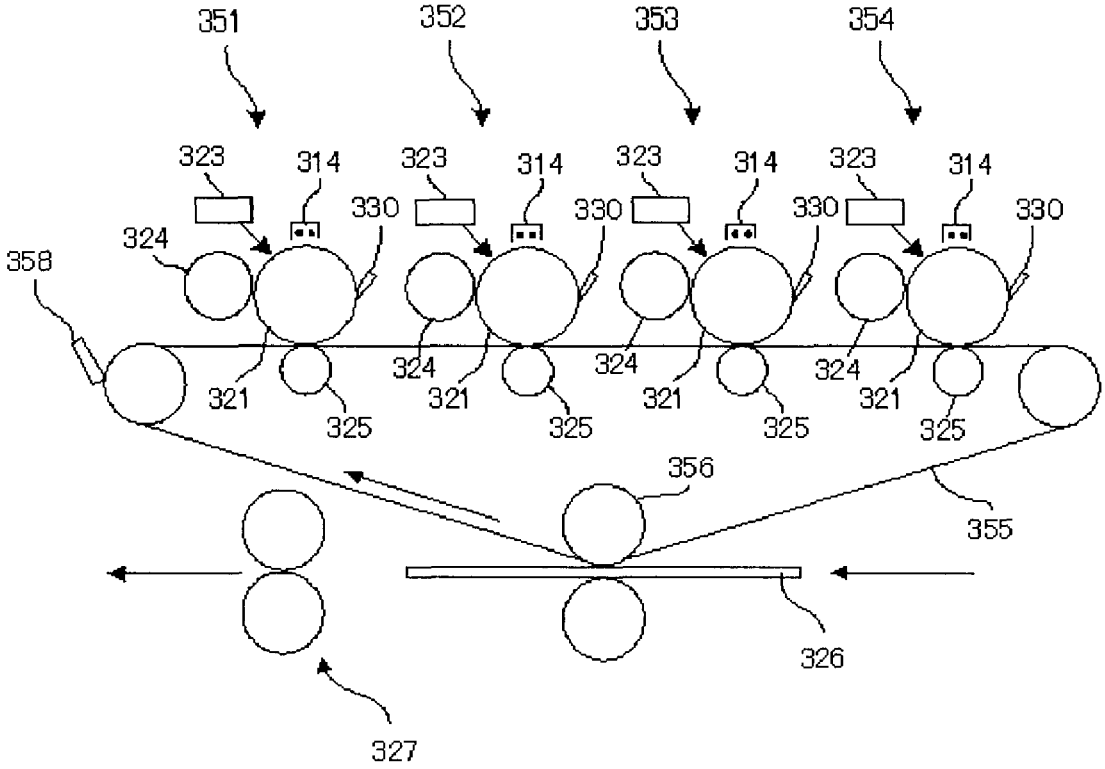
FIG. 21 is a schematic view showing an image forming apparatus B used in Examples.

Each of the two-component developers were loaded into an image forming apparatus B shown in FIG. 21 to form an image. Fixing property, durability, and image quality were evaluated in the same manner as in Examples 1 to 5 and Comparative Examples 1 to 8. Carrier contamination was evaluated as described hereinafter. The results are shown in Table 6.

<Image Forming Apparatus B>

An image forming apparatus B shown in FIG. 21 is a tandem image forming apparatus of an indirect transferring system, which employs a non-contact charging system, a two-component developing system, a secondary transferring system, a blade cleaning system, and an external heating roller fixing system.

In the image forming apparatus B shown in FIG. 21, a non-contact corona charger as shown in FIG. 3 is employed as a charging unit 314. A two-component developing apparatus as shown in FIG. 6 is employed as a developing unit 324. A cleaning blade as shown in FIG. 10 is employed as a cleaning unit 330. A roller fixing device adopting an electromagnetic induction heating system as shown in FIG. 12 is employed as a fixing unit 327.

A charging unit 314, an exposing unit 323, a developing unit 324, and a primary transferring unit 325, and a cleaning unit 330 are disposed around a photoconductor drum 321 of an image forming element 351 in the image forming apparatus B shown in FIG. 21. The surface of the photoconductor drum 321 is charged by the charging unit 314 and exposed by the exposing unit 323 as the photoconductor drum 321 of the image forming element 351 rotates. Accordingly, a latent electrostatic image corresponding to an exposed image is formed on the surface of the photoconductor drum 321. This latent electrostatic image is developed with a yellow toner by the developing unit 324 to form a visible image on the photoconductor drum 321 by the yellow toner. This visible image is transferred onto an intermediate transfer belt 355 by the primary transferring unit 325, and the residual yellow toner on the photoconductor drum 321 is removed by the cleaning unit 330. Similarly, visible images of a magenta toner, a cyan toner, and a black toner are formed on the intermediate transfer belt 355 by corresponding image forming elements 352, 353, and 354. The color image on the intermediate transfer belt 355 is transferred onto a recording medium 326 by a transferring device 356, and the residual toner on the intermediate transfer belt 355 is removed by an intermediate transfer belt cleaning unit 358. The color image formed on the recording medium 326 is fixed by a fixing unit 327.

<Carrier Contamination>

Carrier contamination is an index for carrier contamination of the toner. When the toner has high mechanical strength, carrier contamination is reduced.

Specifically, carrier contamination was evaluated as described hereinafter. Using the image forming apparatus B, a developer used for outputting 100 sheets and 30,000 sheets of an image chart of a 50% image area in monochrome mode was extracted. An appropriate amount of the developer was added in a gauge with a mesh having an opening of 32 μm. Air was blown to separate the toner and the carrier. One gram of the obtained carrier was put in a 50 ml glass vial and 10 ml of chloroform was added. The vial was manually shaken 50 times and left for 10 minutes. Thereafter, a supernatant chloroform solution was put in a glass cell, and the transmittance of the chloroform solution was measured by using a turbidimeter. Evaluation was performed based on the following criteria.

[Evaluation Criteria]

A: Transmittance was 95% or more

B: Transmittance was 90% or more and 94% or less

C: Transmittance was 80% or more and 89% or less

D: Transmittance was 70% or more and 79% or less

E: Transmittance was 69% or less

TABLE 6

| | Toner | Evaluation Machine | Low-Temperature Fixing Property | Anti-Hot Offset Property | Initial Image | Stability Over Time (Durability) | Carrier Contamination |
|---|---|---|---|---|---|---|---|
| Ex. 1 | Toner 1 | A | B | B | A | B | B |
| Ex. 2 | Toner 2 | A | A | A | A | A | B |
| Ex. 3 | Toner 3 | A | A | B | A | B | B |
| Ex. 4 | Toner 4 | A | A | A | A | A | A |
| Ex. 5 | Toner 5 | A | A | B | A | B | B |
| Ex. 6 | Toner 2 | B | A | A | A | A | B |
| Ex. 7 | Toner 4 | B | A | A | A | A | A |
| Ex. 8 | Toner 6 | B | A | A | A | A | A |
| Com. Ex. 1 | Toner 7 | A | A | D | B | E | E |
| Com. Ex. 2 | Toner 8 | A | B | E | C | E | D |
| Com. Ex. 3 | Toner 9 | A | D | B | B | D | B |
| Com. Ex. 4 | Toner 10 | A | A | D | B | D | D |
| Com. Ex. 5 | Toner 11 | A | D | B | A | C | B |
| Com. Ex. 6 | Toner 12 | A | B | D | B | C | C |

TABLE 6-continued

| | Toner | Evaluation Machine | Low-Temperature Fixing Property | Anti-Hot Offset Property | Initial Image | Stability Over Time (Durability) | Carrier Contamination |
|---|---|---|---|---|---|---|---|
| Com. Ex. 7 | Toner 13 | A | B | E | C | E | E |
| Com. Ex. 8 | Toner 14 | A | D | B | A | C | B |

An image forming apparatus, an image forming method, and a process cartridge according to the present invention are enabled to form an extremely high quality image, which has excellent low-temperature fixing property, anti-offset property, and durability, without varying a color tone over long-term printing or abnormality such as decrease in density, fog, or fading. Therefore, an image forming apparatus, an image forming method, and a process cartridge of the present invention can be widely used, for example for a laser printer, a direct digital plate maker, a full-color laser copier using a direct or indirect electrographic multicolor image developing system, a full-color laser printer, and a full-color plain paper facsimile.

What is claimed is:

1. An image forming method, comprising steps of:

charging a surface of a latent electrostatic image bearing member;

exposing the surface, which is charged, of the latent electrostatic image bearing member to form a latent electrostatic image;

developing the latent electrostatic image with a toner to form a visible image;

transferring the visible image onto a recording medium; and fixing the image on the recording medium, wherein the toner comprises at least a binder resin and a colorant, and the binder resin comprises a polyester resin (A) and a polyester resin (B) which has a softening point 10° C. or more higher than that of the polyester resin (A), the polyester resin (A) is a (meth)acrylic acid-modified rosin derived resin having a polyester unit obtained by polycondensation of an alcohol component and a carboxylic acid component, the alcohol component containing 65 mol % or more of 1,2-propanediol in a dihydric alcohol component, and the carboxylic acid component containing a (meth)acrylic acid-modified rosin, and the polyester resin (B) is a purified rosin derived resin having a polyester unit obtained by polycondensation of an alcohol component and a carboxylic acid component, the alcohol component containing a total of 70 mol % or more of 1,2-propanediol and 1,3-propanediol in a dihydric alcohol component, and the carboxylic acid component containing a purified rosin.

* * * * *